US008004477B2

(12) United States Patent
Uchino et al.

(10) Patent No.: US 8,004,477 B2
(45) Date of Patent: Aug. 23, 2011

(54) DISPLAY APPARATUS AND DRIVING METHOD THEREOF

(75) Inventors: Katsuhide Uchino, Kanagawa (JP); Junichi Yamashita, Tokyo (JP); Gaku Izumi, Tokyo (JP); Kazuo Nakamura, Kanagawa (JP); Tetsuro Yamamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 1287 days.

(21) Appl. No.: 11/595,856

(22) Filed: Nov. 13, 2006

(65) Prior Publication Data

US 2007/0115225 A1 May 24, 2007

(30) Foreign Application Priority Data

Nov. 14, 2005 (JP) ..... P2005-328337
Nov. 29, 2005 (JP) ..... P2005-344207
Dec. 26, 2005 (JP) ..... P2005-372621

(51) Int. Cl.
*G09G 3/30* (2006.01)

(52) U.S. Cl. ..... 345/76; 345/55; 345/98; 345/99; 345/204

(58) Field of Classification Search ..... 345/76, 345/55, 98–99, 204
See application file for complete search history.

(56) References Cited

U.S. PATENT DOCUMENTS 6,040,815 A * 3/2000 Erhart et al. ..... 345/98
2004/0174349 A1* 9/2004 Libsch et al. ..... 345/204
2004/0263437 A1 12/2004 Hattori
2005/0007357 A1 1/2005 Yamashita et al.
2005/0067970 A1 3/2005 Libsch et al.

FOREIGN PATENT DOCUMENTS

| | | |
|---|---|---|
| EP | 1 772 847 A1 | 4/2007 |
| JP | 2003-255856 | 9/2003 |
| JP | 2003-271095 | 9/2003 |
| JP | 2004-029791 | 1/2004 |
| JP | 2004-093682 | 3/2004 |
| JP | 2004-133240 | 4/2004 |
| WO | WO 2005/015530 A1 | 2/2005 |

OTHER PUBLICATIONS

EPO Search Report Dated Feb. 14, 2007; 5 pages.
European Search Report; Application No./Patent No. 06124072.7-1228; Dated Jun. 20, 2007.

* cited by examiner

*Primary Examiner* — Richard Hjerpe
*Assistant Examiner* — Leonid Shapiro
(74) *Attorney, Agent, or Firm* — Rader, Fishman & Grauer PLLC

(57) ABSTRACT

Disclosed herein is a display apparatus including a pixel-array unit, a scanner unit and a signal unit. The pixel-array unit has pixels laid out to form a matrix and each provided at an intersection of first and second scanning lines each oriented in a row direction of the matrix and a signal line oriented in a column direction of the matrix. The signal unit provides a video signal to the signal line. The scanner unit sequentially scans the pixels of the matrix in row units by supplying first and second control signals to the first and second scanning lines respectively.

20 Claims, 30 Drawing Sheets

$$I_{ds} = k\mu (V_{gs} - V_{th})^2 = k\mu (V_{sig} - \Delta V)^2$$

DISPLAY APPARATUS AND DRIVING METHOD THEREOF

CROSS REFERENCES TO RELATED APPLICATIONS

The present invention contains subject matter related to Japanese Patent Application JP 2005-328337, JP 2005-344207, and JP 2005-372621, filed in the Japanese Patent Office on Nov. 14, 2005, Nov. 29, 2005, and Dec. 26, 2005, respectively, the entire contents of which being incorporated herein by reference.

BACKGROUND OF THE INVENTION

1. Field of the Invention

The present invention relates to a display apparatus for displaying an image by driving a current to flow to a light emitting device placed in each pixel. To put it in more detail, the present invention relates to an image display apparatus pertaining to the so-called active-matrix type category as a display apparatus employing an insulated-gate type field-effect transistor in every pixel as a transistor for controlling the magnitude of a current flowing through a light emitting device included in the pixel as a device typically made of an organic EL device.

2. Description of the Related Art

In an image display apparatus such as a liquid-crystal display apparatus, a large number of liquid-crystal pixels are laid out to form a matrix. An image is displayed by controlling the transmittance and reflectance of a light beam arriving at each pixel in accordance with information on the image to be displayed. This principle also holds true of other display apparatus such as an organic EL display apparatus employing an organic display device in each pixel. Unlike the liquid-crystal pixel, however, an organic EL device is a self-light-emitting device requiring no backlight. Thus, the organic EL display apparatus has excellent visibility in comparison with the liquid-crystal display apparatus. Other merits offered by the organic EL display apparatus include a high response speed. In addition, the luminance level (or the gradation) can be controlled in accordance with the magnitude of a current flowing through the organic EL display device by execution of the so-called current control, which is much different from the voltage control of the liquid-crystal display device.

Much like the liquid-crystal display apparatus, the organic EL display apparatus may adopt a simple matrix method or an active matrix method as the driving method. The simple matrix method requires a simple configuration of the image display apparatus, but has a problem that an image display apparatus having a large size and a high degree of fineness is difficult to implement. Thus, at the present time, the active matrix method is being developed by a large number of manufacturers of image display apparatus. In accordance with this active matrix method, the current flowing through a light emitting device employed in every pixel circuit is controlled by using an active device also included in the pixel circuit. In general, the active device is a TFT (a thin film transistor). The active matrix method is described in the following documents: Japanese Patent Laid-open No. 2003-255856 (Patent Document 1); Japanese Patent Laid-open No. 2003-271095 (Patent Document 2); Japanese Patent Laid-open No. 2004-133240 (Patent Document 3); Japanese Patent Laid-open No. 2004-029791 (Patent Document 4); Japanese Patent Laid-open No. 2004-093682 (Patent Document 5).

SUMMARY OF THE INVENTION

The conventional pixel circuits forming a pixel matrix are each provided at an intersection of a scanning line oriented in the row direction of the matrix as a line for supplying a control signal and a signal line oriented in the column direction of the matrix as a line for supplying a video signal. The conventional pixel circuit includes at least a sampling transistor, a capacitor, a drive transistor and a light emitting device. The control signal supplied by the scanning line causes the sampling transistor to enter a conductive state of sampling the video signal supplied by the signal unit to the signal line. The capacitor holds an input voltage represented by the sampled video signal. The drive transistor generates an output current during a predetermined light emission period in accordance with the input voltage held by the capacitor. It is to be noted that, in general, the output current generated by the drive transistor exhibits a characteristic of dependence on mobility of carriers in a channel area of the drive transistor and a threshold voltage of the drive transistor. The output current generated by the drive transistor causes the light emitting device to emit a light beam at a luminance representing the video signal.

The input voltage held by the capacitor is supplied to the gate of the drive transistor, causing the output current to flow to the light emitting device through the source and drain of the drive transistor. In general, the luminance of the light emitted by the light emitting device is proportional to the magnitude of the current output by the drive transistor to the device, and the magnitude of the current is controlled by the input voltage held by the capacitor and applied to the gate of the transistor. In the conventional pixel circuit, by changing the input voltage applied to the gate of the drive transistor in accordance with the input video signal, the magnitude of the current flowing to the light emitting device can be controlled.

The operating characteristic of the drive transistor is expressed by Eq. 1 as follows.

$$Ids=(1/2)\mu(W/L)Cox(Vgs-Vth)2 \quad \text{Eq. 1}$$

In Eq. 1 representing the characteristic of the drive transistor, notation Ids denotes the current flowing between the source and drain of the transistor. In the pixel circuit, this current is the aforementioned output current supplied to the light emitting device. Notation Vgs denotes a voltage applied to the gate of the drive transistor with the source of the transistor taken as a reference. In the pixel circuit, this voltage is the aforementioned input voltage. Notation Vth denotes the threshold voltage of the drive transistor. Notation μ denotes the mobility of carriers in a semiconductor thin film composing the channel of the drive transistor. Notation W denotes the width of the channel and notation L denotes the length of the channel. Notation Cox denotes the capacitance of the gate. As is obvious from Eq. 1 representing the characteristic of the drive transistor, when the input voltage Vgs applied to the gate exceeds the threshold voltage Vth with the thin-film transistor operating in a saturated region, the thin-film transistor serving as the drive transistor is put in a conductive state, causing the drain current Ids to flow between the drain and the source. From the principle point of view, as suggested by Eq. 1, a constant gate voltage Vgs causes an always constant drain current Ids to be supplied to the light emitting device. Thus, if video signals all having the same level are supplied to their respective pixels composing the display screen, all the pixels emit light beams having the same luminance. As a result, uniformity of the display screen should be obtained.

In actuality, however, the TFT (Thin-Film Transistor) made of a semiconductor thin film such as polysilicon exhibits variations in device characteristics among individual transistors. In particular, the threshold voltage Vth varies from transistor to transistor. That is to say, there are variations in threshold voltage Vth among drive transistors. As is obvious from Eq. 1 representing the characteristic of the drive transistor as described before, if the threshold voltage Vth varies from transistor to transistor, the drain current Ids also varies from transistor to transistor even for the same gate voltage Vgs. Thus, the luminance also varies from pixel to pixel, causing the display screen to lose the uniformity. In order to solve this problem, efforts to develop a pixel circuit having a function to cancel the effect of the variations in threshold voltage Vth among drive transistors have been made from the past. A typical pixel circuit having such a function is disclosed in documents such as Patent Document 3.

However, the configuration of the conventional display apparatus including pixel circuits each having an embedded threshold-voltage correction function for canceling effects of the variations in threshold voltage Vth among drive transistors is complicated, serving as a barrier to the downsizing of the pixel circuit or the enhancement of its fineness. In addition, a pixel circuit including the embedded conventional threshold-voltage correction function is not efficient and difficult to design. On top of that, a pixel circuit including the embedded conventional threshold-voltage correction function has a relatively large number of configuration elements causing a low yield.

Addressing the problems described above, inventors of the present invention have made efforts to raise the efficiency of the pixel circuit with the function included for the purpose of canceling an effect of variations in threshold voltage and, hence, attaining improvement of the fineness of the display screen and improvement of the yield of the pixel circuit. In order to achieve this purpose, the present invention provides an image display apparatus including a pixel-array unit, a scanner unit and a signal unit. The pixel-array unit has pixels, which are laid out to form a matrix and each provided at an intersection of first and scanning lines oriented in the row direction of the matrix and a signal line oriented in the column direction of the matrix. The signal unit provides a video signal to each signal line. The scanner unit sequentially scans each row of the matrix by supplying first and second control signals to the first and second scanning lines respectively. Each of the pixels includes at least a sampling transistor, a pixel capacitor connected to the sampling transistor, a drive transistor connected to the sampling transistor as well as the pixel capacitor, a light emitting device connected to the drive transistor, and a switching transistor for connecting the drive transistor to a power supply. The first control signal supplied by the scanner unit through the first scanning line causes the sampling transistor to enter a conductive state of sampling the electric potential of a video signal supplied by the signal unit to the signal line and storing the sampled electric potential in the pixel capacitor. The pixel capacitor applies an input voltage to the gate of the drive transistor in accordance with the sampled electric potential of the video signal. Driven by the input voltage, the drive transistor supplies an output current according to the input voltage to the light emitting device. The output current exhibits a characteristic of dependence on the threshold voltage of the drive transistor. The output current generated by the drive transistor causes the light emitting device to emit a light beam with a luminance according to the electric potential of the video signal during a light emission period. The second control signal supplied by the scanner unit through the second scanning line causes the switching transistor to enter a conductive state of connecting the drive transistor to the power supply during the light emission period. During a period other than the light emission period, the switching transistor is put in a non-conductive state in order to disconnect the drive transistor from the power supply. The image display apparatus is characterized in that, during a horizontal scanning period, the scanner unit supplies the first control signal to the first scanning line in a control operation to put the sampling transistor in on and off states and the second control signal to the second scanning line in a control operation to put the switching transistor in on and off states and, in order to compensate the pixel capacitor for an effect of the characteristic exhibited by the output current of the drive transistor as a characteristic of dependence on the threshold voltage of the drive transistor, the pixel carries out following operations. These operations are a preparatory operation to reset the pixel capacitor, a compensatory operation to compensate the pixel capacitor by storing a voltage in the reset pixel capacitor as a voltage for canceling an effect of the threshold voltage, and a sampling operation to sample the signal electric potential of a video signal supplied by the signal unit to the signal line and storing the sampled electric potential in the compensated pixel capacitor.

During a horizontal scanning period, on the other hand, the signal unit switches a signal appearing on the signal line among a first fixed electric potential, a second fixed electric potential and a signal electric potential of the video signal in order to provide each pixel with electric potentials needed for the preparatory operation, the compensatory operation and the sampling operation through the signal line. To be more specific, first of all, after continuously supplying a video signal to the signal line at the first fixed electric potential of a high level, the signal unit switches the video signal to the second fixed electric potential of a low level in order to make the preparatory operation executable. Then, while the second fixed electric potential of a low level is being sustained, the compensatory operation is carried out. Subsequently, the signal unit switches the video signal appearing on the signal line from the second fixed electric potential to the signal electric potential, allowing the sampling operation to be carried out. The signal unit includes a signal generation circuit for generating the signal electric potential and an output circuit for carrying out a synthesis process by inserting the first fixed electric potential and the second fixed electric potential into the signal electric potential output by the signal generation circuit to generate a video signal switched among the first fixed electric potential, the second fixed electric potential and the signal electric potential and for outputting the video signal to each signal line. In this case, since the signal unit outputs a video signal synthesizing the signal electric potential not exceeding an ordinary rating value with the high-level first fixed electric potential exceeding the rating value, the signal generation circuit has an ordinary withstand voltage for generating the signal electric potential not exceeding the rating value and, on the other hand, the output circuit is made capable of withstanding the high-level first fixed electric potential exceeding the rating value.

In an operation mode, the drive transistor exhibits a characteristic displaying dependence of an output current generated by the transistor on the mobility of carriers in a channel area in the transistor in addition to dependence on the threshold voltage of the transistor. In a horizontal scanning period, a scanner unit outputs a second control signal to the second scanning line in order to further control the switching transistor. In addition, in order to cancel the effect of the characteristic showing dependence of the output current on the mobility of carriers, an operation is carried out to compensate an input voltage applied to the drive transistor for the effect. The compensatory operation is carried out by drawing the output current from the drive transistor with a signal electric potential sampled, and feeding back the drawn output current to the pixel capacitor in a negative feedback operation.

The image display apparatus provided by the present invention is characterized in that the image display apparatus includes a pixel array, a scanner, and a driver. In the pixel array, each of the pixel circuits is placed at an intersection of first and second scanning lines oriented in the row direction of the matrix and a data signal line oriented in the column direction of the matrix. The driver provides a video signal to the signal line whereas the scanner unit sequentially supplies first and second control signals to pixel circuits on a pixel row through the first and second scanning lines respectively one row after another in order to scan the pixel rows. Each of the pixel circuits has a sampling transistor, a pixel capacitor connected to the sampling transistor, a drive transistor connected to the sampling transistor as well as the pixel capacitor, a light emitting device connected to the drive transistor and a switching transistor for connecting the drive transistor to a power supply. The first control signal supplied by the scanner unit to the first scanning line puts the sampling transistor in an on state of sampling the signal electric potential of the video signal supplied by the signal unit to the signal line and storing the sampled signal electric potential in the pixel capacitor. The pixel capacitor applies an input voltage according to the signal electric potential stored in the pixel capacitor as the electric potential of the sampled video signal to the gate of the drive transistor. Driven by the input voltage, the drive transistor supplies an output current according to the input voltage to the light emitting device. During a light emission period, the output current generated by the drive transistor causes the light emitting device to emit a light beam with a luminance according to the electric potential of the video signal. The second control signal supplied by the scanner unit to the second scanning line puts the switching transistor in an on state of connecting the drive transistor to the power supply in the light emission period. In a no light emission period, on the other hand, the switching transistor is put in an off state in order to disconnect the drive transistor from the power supply. As described above, in a horizontal scanning period, the scanner unit supplies the first control signal to the first scanning line in a control operation to put the sampling transistor in on and off states. By the same token, the scanner unit supplies the second control signal to the second scanning line in a control operation to put the switching transistor in on and off states. The sampling and the switching transistors are controlled in this way in order to carry out a compensatory operation to eliminate the effect of variations in output current generated by the drive transistor and a sampling operation to sample the signal electric potential of the video signal and store the sampled signal electric potential in the pixel capacitor as described above. The compensatory operation needs to be carried out because the output current generated by the drive transistor varies from transistor to transistor. During the horizontal scanning period, the driver serving as the signal unit switches the video signal appearing on the signal line from a fixed electric potential to a signal electric potential and vice versa. The fixed electric potential is an electric potential provided to the pixel circuit through the signal line as an electric potential needed during the compensatory operation. On the other hand, the signal electric potential is the electric potential of the video signal provided to the pixel circuit through the signal line as a video signal sampled during the sampling operation.

To put it concretely, the driver has a signal generation circuit for generating the signal electric potential and an output circuit for carrying out a synthesis process by inserting the fixed electric potential into the signal electric potential generated by the signal generation circuit to generate a video signal switched between the fixed electric potential and the signal electric potential and for outputting the video signal to each signal line. The driver is characterized in that the driver outputs a video signal synthesizing the signal electric potential not exceeding an ordinary rating value with the high-level fixed electric potential exceeding the rating value, and the signal generation circuit included in the driver has an ordinary withstand voltage for generating the signal electric potential not exceeding the rating value and, on the other hand, only the output circuit is made capable of withstanding the high-level fixed electric potential exceeding the rating value.

In addition, an image display apparatus provided by the present invention includes a pixel-array unit, a scanner unit and a signal unit. The pixel-array unit has pixels laid out to form a pixel matrix and each provided at an intersection of first and second scanning lines oriented in the row direction of the matrix and a signal line oriented in the column direction of the matrix. The signal unit provides a video signal to the signal line. The scanner unit provides first and second control signals to the first and second scanning lines respectively in order to sequentially scan rows of pixels. Each of the pixels includes at least a sampling transistor, a pixel capacitor connected to the sampling transistor, a drive transistor connected to the sampling transistor as well as the pixel capacitor, a light emitting device connected to the drive transistor and a switching transistor for connecting the drive transistor to a power supply. The first control signal supplied by the scanner unit through the first scanning line causes the sampling transistor to enter a conductive state of sampling the electric potential of a video signal supplied by the signal unit to the signal line and storing the sampled electric potential in the pixel capacitor. The pixel capacitor applies an input voltage to the gate of the drive transistor in accordance with the sampled electric potential of the video signal. Driven by the input voltage, the drive transistor supplies an output current according to the input voltage to the light emitting device. The output current exhibits a characteristic of dependence on the threshold voltage of the drive transistor. The second control signal supplied by the scanner unit through the second scanning line causes the switching transistor to enter a conductive state of connecting the drive transistor to the power supply during the light emission period. During a period other than the light emission period, the switching transistor is put in a non-conductive state in order to disconnect the drive transistor from the power supply. During a light emission period, the output current generated by the drive transistor causes the light emitting device to emit a light beam with a luminance according to the electric potential of the video signal. The image display apparatus is characterized in that, during a horizontal scanning period, the scanner unit supplies the first control signal to the first scanning line in a control operation to put the sampling transistor in on and off states and the second control signal to the second scanning line in a control operation to put the switching transistor in on and off states and, in order to compensate the pixel capacitor for an effect of the characteristic exhibited by the output current of the drive transistor as a characteristic of dependence on the threshold voltage of the drive transistor, the pixel carries out following operations. These operations are: preparatory operations to reset the pixel capacitor; a compensatory operation to store a voltage in the reset pixel capacitor as a voltage for canceling an effect of the threshold voltage; and a sampling operation to sample the signal electric potential of a video signal supplied by the signal unit to the signal line and store the sampled electric potential in the compensated pixel capacitor. The scanner unit is characterized in that the scanner utilizes previous horizontal scanning periods allocated to rows of pixels preceding the current row of pixels to carry out the preparatory operations at different times by distributing the preparatory operations among the previous horizontal scanning periods and sets the interval between any two of the consecutive preparatory operations at a value large enough for discharging a voltage from the light emitting device.

It is desirable to provide a scanner unit capable of carrying out the compensatory operation at different times by utilizing previous horizontal scanning periods allocated to rows of pixels preceding the current row of pixels and distributing the compensatory operation among the previous horizontal scanning periods after completion of the preparatory operations. During a horizontal scanning period, the signal unit switches a signal appearing on the signal line among a first fixed electric potential, a second fixed electric potential and a signal electric potential of the video signal in order to provide each pixel with electric potentials needed for the preparatory operation, the compensatory operation and the sampling operation through the signal line. To put it concretely, the signal unit supplies the first fixed electric potential of a high level during the preparatory operation, the second fixed electric potential of a low level during the compensatory operation and the signal electric potential of the video signal during the sampling operation. The output current generated by the drive transistor exhibits a characteristic of dependence on not only the threshold voltage of the drive transistor, but also mobility of carriers in a channel area in the drive transistor. The scanner unit outputs second control signal to the second scanning line in order to further control the switching transistor during a horizontal scanning period. For the purpose of canceling the effect of the dependence of the output current on the mobility of carriers, with the signal electric potential being sampled, the output current is drawn from the drive transistor and fed back to the pixel capacitor in a negative feedback operation in order to carry out the compensatory operation of compensating the input voltage for the characteristic of dependence.

In addition, an apparatus driving method provided by the present invention is adopted in an image display apparatus including a pixel-array unit, a scanner unit and a signal unit. The pixel-array unit has pixels, which are laid out to form a matrix and each provided at an intersection of first and second scanning lines oriented in the row direction of the matrix and a signal line oriented in the column direction of the matrix. The signal unit provides a video signal to each signal line. The scanner unit sequentially scans each row of the matrix by supplying first and second control signals to the first and second scanning lines respectively. Each of the pixels includes at least a sampling transistor, a pixel capacitor connected to the sampling transistor, a drive transistor connected to the sampling transistor as well as the pixel capacitor, a light emitting device connected to the drive transistor and a switching transistor for connecting the drive transistor to a power supply. The first control signal supplied by the scanner unit through the first scanning line causes the sampling transistor to enter a conductive state of sampling the electric potential of a video signal supplied by the signal unit to the signal line and storing the sampled electric potential in the pixel capacitor. The pixel capacitor applies an input voltage to the gate of the drive transistor in accordance with the sampled electric potential of the video signal. Driven by the input voltage, the drive transistor supplies an output current according to the input voltage to the light emitting device. The output current exhibits a characteristic of dependence on the threshold voltage of the drive transistor. The second control signal supplied by the scanner unit through the second scanning line causes the switching transistor to enter a conductive state of connecting the drive transistor to the power supply during the light emission period, and causes the switching transistor to enter a non-conductive state of disconnecting the drive transistor from the power supply during the light emission period. During a light emission period, the output current generated by the drive transistor causes the light emitting device to emit a light beam with a luminance according to the electric potential of the video signal. The apparatus driving method is characterized in that, during a horizontal scanning period, the scanner unit supplies the first control signal to the first scanning line in a control operation to put the sampling transistor in on and off states and the second control signal to the second scanning line in a control operation to put the switching transistor in on and off states and, in order to compensate the pixel capacitor for an effect of the characteristic exhibited by the output current of the drive transistor as a characteristic of dependence on the threshold voltage of the drive transistor. The pixel carries out: preparatory operations to reset the pixel capacitor; a compensatory operation to store a voltage in the reset pixel capacitor as a voltage for canceling an effect of the threshold voltage; and a sampling operation to sample the electric potential of a video signal supplied by the signal unit to the signal line and store the sampled electric potential in the compensated pixel capacitor. The scanner unit is characterized in that the scanner utilizes previous horizontal scanning periods each allocated to a row of pixels preceding the current row of pixels to carry out the preparatory operations at different times by distributing the preparatory operations among the previous horizontal scanning periods and sets the interval between any two the consecutive preparatory operations at a value large enough for discharging a voltage from the light emitting device.

In addition, an image display apparatus provided by the present invention includes a pixel-array unit, a scanner unit and a signal unit. The pixel-array unit has pixels, which are laid out to form a matrix and each provided at an intersection of first and scanning lines oriented in the row direction of the matrix and a signal line oriented in the column direction of the matrix. The signal unit provides a video signal to each signal line. The scanner unit sequentially scans each row of the matrix by supplying first and second control signals to the first and second scanning lines respectively. Each of the pixels includes at least a sampling transistor, a pixel capacitor connected to the sampling transistor, a drive transistor connected to the sampling transistor as well as the pixel capacitor, a light emitting device connected to the drive transistor and a switching transistor for connecting the drive transistor to a power-supply line. The first control signal supplied by the scanner unit through the first scanning line causes the sampling transistor to enter a conductive state of sampling the electric potential of a video signal supplied by the signal unit to the signal line and storing the sampled electric potential in the pixel capacitor. The pixel capacitor applies an input voltage to the gate of the drive transistor in accordance with the sampled electric potential of the video signal. Driven by the input voltage, the drive transistor supplies an output current according to the input voltage to the light emitting device. The output current exhibits a characteristic of dependence on the threshold voltage of the drive transistor. The output current causes the light emitting device to emit a light beam with a luminance according to the electric potential of the video signal during a light emission period. The second control signal supplied by the scanner unit through the second scanning line causes the switching transistor to enter a conductive state of connecting the drive transistor to the power-supply line during the light emission period. During a period other than the light emission period, the switching transistor is put in a non-conductive state of disconnecting the drive transistor from the power-supply line. The scanner unit supplies the first control signal to the first scanning line in a control operation to put the sampling transistor in on and off states and the second control signal to the second scanning line in a control operation to put the switching transistor in on and off states whereas the pixel carries out following operations. These operations are: a compensatory operation in order to compensate the pixel capacitor for an effect of the characteristic exhibited by the output current of the drive transistor as a characteristic of dependence on the threshold voltage of the drive transistor; and a sampling operation in order to sample the signal electric potential of a video signal supplied by the signal unit to the signal line and store the sampled electric potential in the compensated pixel capacitor.

To put it concretely, the signal unit switches a signal appearing on the signal line between a fixed electric potential and a signal electric potential of the video signal in order to provide each pixel with electric potentials needed for the compensatory operation and the sampling operation through the signal line. To put it more concretely, the signal unit supplies the fixed electric potential during the compensatory operation and, then, the signal electric potential of the video signal during the sampling operation.

The power-supply line is provided in the pixel-array unit in parallel to the first and second scanning lines. The scanner unit includes a power-supply line scanner for scanning power-supply lines in the same way as the scanning lines are scanned. Thus, an electric potential needed for the compensatory operation can be supplied to each pixel through the power-supply line. During a period of the compensatory operation, the power-supply line scanner switches a power-supply electric potential appearing on the power-supply line from an ordinary power-supply electric potential supplied during a light emission period to the electric potential needed for the compensatory operation and supplies the electric potential needed for the compensatory operation to the pixels through the power-supply line. It is desirable to have the scanner unit output the first and second control signals to the first and second scanning lines respectively during a horizontal scanning period allocated to a row of pixels in order to carry out the compensatory and sampling operations during the horizontal scanning period.

In addition, an apparatus driving method provided by the present invention is adopted in an image display apparatus including a pixel-array unit, a scanner unit and a signal unit. The pixel-array unit has pixels, which are laid out to form a matrix and each provided at an intersection of first and second scanning lines each oriented in the row direction of the matrix and a signal line oriented in the column direction of the matrix. The signal unit provides a video signal to each signal line. The scanner unit sequentially scans each row of the matrix by supplying first and second control signals to first and second scanning lines respectively. Each of the pixels includes a sampling transistor, a pixel capacitor connected to the sampling transistor, a drive transistor connected to the sampling transistor as well as the pixel capacitor, a light emitting device connected to the drive transistor and a switching transistor for connecting the drive transistor to a power-supply line. The first control signal supplied by the scanner unit through the first scanning line causes the sampling transistor to enter a conductive state of sampling the electric potential of a video signal supplied by the signal unit to the signal line and storing the sampled electric potential in the pixel capacitor. The pixel capacitor applies an input voltage between the gate and source of the drive transistor in accordance with the sampled electric potential of the video signal. Driven by the input voltage, the drive transistor supplies an output current according to the input voltage to the light emitting device. The output current exhibits a characteristic of dependence on the threshold voltage of the drive transistor. The output current causes the light emitting device to emit a light beam with a luminance according to the electric potential of the video signal during a light emission period. The second control signal supplied by the scanner unit through the second scanning line causes the switching transistor to enter a conductive state of connecting the drive transistor to the power-supply line during the light emission period. During a period other than the light emission period, the switching transistor is put in a non-conductive state of disconnecting the drive transistor from the power-supply line. The scanner unit supplies the first control signal to the first scanning line in a control operation to put the sampling transistor in on and off states and the second control signal to the second scanning line in a control operation to put the switching transistor in on and off states, whereas the pixel carries out following operations. These operations are: a compensatory operation in order to compensate the pixel capacitor for an effect of the characteristic exhibited by the output current of the drive transistor as a characteristic of dependence on the threshold voltage of the drive transistor; and a sampling operation in order to sample the signal electric potential of a video signal supplied by the signal unit to the signal line and store the sampled electric potential in the compensated pixel capacitor.

In accordance with an embodiment of the present invention, the image display apparatus has a threshold-voltage compensatory function embedded in each pixel circuit. In a horizontal scanning period (1H) allocated to each row of pixels, the image display apparatus carries out a threshold-voltage compensation preparatory operation, an actual threshold-voltage compensatory operation and an operation to sample the voltage of a video signal by making use of an effect of gate coupling. Thus, the number of components composing the pixel circuit can be reduced. To put it concretely, the pixel circuit provided by the present invention includes only three transistors, one pixel capacitor and one light emitting device. As a result, the number of power-supply lines and the number of gate lines (or scanning lines) can also be reduced so that the number of crossovers between wires can be decreased substantially. Accordingly, the yield of a panel forming the image display apparatus can be improved and, at the same time, the degree of panel fineness can also be raised as well. In addition, in accordance with an embodiment of the present invention, besides a sampling operation, a compensatory operation can also be carried out during a horizontal scanning period. Thus, in addition to a signal electric potential, a fixed electric potential for a control purpose can also be provided on same data signal line as the signal electric potential. In this way, the image display apparatus according to the present invention is capable of providing the pixel-array unit with not only image data through the data signal line, but also a fixed voltage through the same data signal line as a voltage for controlling the pixel circuit. Thus, by using only a small number of components, it is possible to implement a compensatory unit configured to compensate each of pixel circuits for an effect of the variations in characteristics among drive transistors employed in different pixel circuits. In addition, even if the fixed voltage for controlling the pixel circuit is higher than a maximum rating voltage of an ordinary driver IC serving as a signal unit for generating the signal appearing on the data signal line, only an output circuit of the driver IC needs to be made tolerable against the high fixed voltage. That is to say, it is not necessary to make the entire driver IC tolerable against the high fixed voltage. Thus, it is possible to prevent the cost of the driver IC from rising due to the increasing physical size of the driver IC as encountered in an effort to enlarge the scale of image display apparatus or increase the pitch between pins of the driver IC. As a result, the image display apparatus is capable of keeping up with a panel having a high resolution.

In addition, in accordance with an embodiment of the present invention, the scanner unit employed in the image display apparatus outputs control signals to their respective scanning lines during a horizontal scanning period in order to control pixel circuits. The pixel circuit is controlled in this way in order to carry out following operations. These operations are: a compensatory operation of compensating a pixel capacitor employed in the pixel circuit for an effect of a characteristic exhibited by an output current of a drive transistor employed in the pixel circuit as a characteristic of dependence on the threshold voltage of the drive transistor; and a sampling operation of sampling the electric potential of a video signal supplied by a signal unit to a signal line and storing the sample electric potential in the compensated pixel capacitor. At that time, the scanner unit utilizes previous horizontal scanning periods each allocated to a row of pixels preceding the current row of pixels to carry out the compensatory operation to compensate the pixel capacitor at different times by distributing the compensatory operation among the previous horizontal scanning periods. By distributing the compensatory operation, which is to be carried out to compensate the pixel capacitor for the effect of a characteristic exhibited by an output current of a drive transistor employed in the pixel circuit as a characteristic of dependence on the threshold voltage of the drive transistor, among a plurality of horizontal scanning periods in this way, a sufficiently long compensation period can be assured. This is because results of the compensatory operation distributed among a plurality of horizontal scanning periods can be accumulated so that, when the operation to sample a video signal is carried out in a horizontal scanning period eventually, an adequate voltage corresponding to the threshold voltage of a drive transistor has been stored in the pixel capacitor. As a result, it is possible to carry out a sufficient compensatory operation of compensating the pixel capacitor for the effect of a characteristic exhibited by an output current of the drive transistor employed in the pixel circuit as a characteristic of dependence on the threshold voltage even if the driving frequency of the image display apparatus is increased, resulting in short horizontal scanning periods.

In particular, in accordance with an embodiment of the present invention, the image display apparatus carries out a threshold-voltage compensation preparatory operation, an actual threshold-voltage compensatory operation and an operation to sample the voltage of a video signal in a horizontal scanning period. By carrying out necessary operations during a horizontal scanning period in this way, necessary video-signal and control voltages are supplied to the pixel circuit by a signal unit through the signal line. Thus, the pixel circuit can be designed to include only a small number of components. By the way, the pixel circuit provided by the present invention has only three transistors, one pixel capacitor and one light emitting device. Thus, the number of components composing the pixel circuit is very small in comparison with the conventional pixel circuit having a threshold-voltage compensation function. In order to carry out an actual threshold-voltage compensatory operation and an operation to sample the voltage of a video signal in a horizontal scanning period; however, it may be impossible to assure a needed sufficiently long operating time in case the horizontal scanning period becomes short due to an increased driving frequency. In order to solve this problem, the present invention carries out the threshold-voltage compensation preparatory operation in a plurality of horizontal scanning periods by distributing the threshold-voltage compensation preparatory operation among the horizontal scanning periods. Then, results of the compensatory operation distributed among the horizontal scanning periods are accumulated so that, in essence, it is possible to assure the needed sufficiently long operating time.

In accordance with an embodiment of the present invention, the threshold-voltage compensation preparatory operation is carried out by making use of an effect of capacitive coupling. The threshold-voltage compensation preparatory operation making use of an effect of capacitive coupling is carried out a plurality of times. The interval between any two consecutive pulses triggering two consecutive threshold-voltage compensation preparatory operations is set at a value large enough for discharging a voltage from the light emitting device. In this way, the number of minus coupling operations per row can be reduced. In the present invention, the interval between two consecutive driving control pulses applied to the gate of the sampling transistor in order carry out a threshold-voltage compensation preparatory operation is set at such a value that the light emitting device is fully cut off at the end of the interval. By carrying out this threshold-voltage compensation preparatory operation repeatedly a number of times, an effect of the variations in gate electric potential disappears so that it is possible to obtain a needed voltage to be applied between the gate and source of a drive transistor. By setting the interval between any two consecutive pulses triggering two consecutive threshold-voltage compensation preparatory operations at a sufficiently large value in this way, the number of pulses each triggering a threshold-voltage compensation preparatory operation can be considerably reduced to a value, which is small in comparison with the conventional pixel circuit. In accordance with an embodiment of the present invention, in an organic EL panel with light emitting devices each having a large capacitance or in a panel similar to such a panel, the threshold-voltage compensation period is split into a plurality of sub-periods and the interval between any two consecutive driving control pulses each triggering a threshold-voltage compensation operation is set at such a value that the light emitting device is fully cut off at the end of the interval. Thus, the number of pulses each triggering a threshold-voltage compensatory operation can be considerably reduced to a value small.

In addition, in accordance with an embodiment of the present invention, the scanner unit employed in the image display apparatus as a unit for sequentially scanning rows of pixels executes control of turning on and off the sampling and switching transistors included in each pixel circuit in order to carry out a compensatory operation to compensate the pixel capacitor for an effect of the threshold voltage of the drive transistor and an operation to sample a video signal. In this way, the image display apparatus is capable of suppressing the effect of variations in threshold voltage among drive transistors employed in different pixel circuits. Thus, it is possible to obtain a uniform picture quality without unevenness and variations. In addition, the pixel capacitor employed in each pixel circuit applies an input voltage according to the electric potential of a sampled video signal between the gate and source of the drive transistor. Since the pixel capacitor sustains the electric potential applied between the gate and source of the drive transistor at a constant value, the drive transistor works as a constant current generator supplying a constant output current to the light emitting device. Thus, even if the I-V characteristic of the light emitting device deteriorates with the lapse of time, the constant output current keeps flowing to the light emitting device all the time, causing the device to emit a light beam at a constant luminance according to the sampled video signal. The pixel circuit capable of coping with variations in characteristics among different drive transistors and deteriorations of the I-V characteristic of the light emitting device with the lapse of time in this way can be configured to include only a sampling transistor, a switching transistor, a drive transistor and a pixel capacitor. Thus, the pixel circuit employed in the image display apparatus provided by the present invention has a configuration including only four components, i.e., three transistors and one capacitive element. Since the number of components (that is, the three transistors and the pixel capacitor) composing the pixel circuit provided by the present invention is small, it is expected that the fineness of the panel can be enhanced and the yield of the pixel circuit can be raised. As a result, the image display apparatus provided by the present invention can be configured to have only three gate lines and three power-supply lines for each of the three R, G and B trio primary colors. Accordingly, since the area occupied by the gate lines and the power-supply lines is small in comparison with the area occupied by the pixel circuit itself, the fineness of the panel can be enhanced and the yield of the pixel circuit can be raised.

DETAILED DESCRIPTION OF THE PREFERRED EMBODIMENTS

Figure 1:
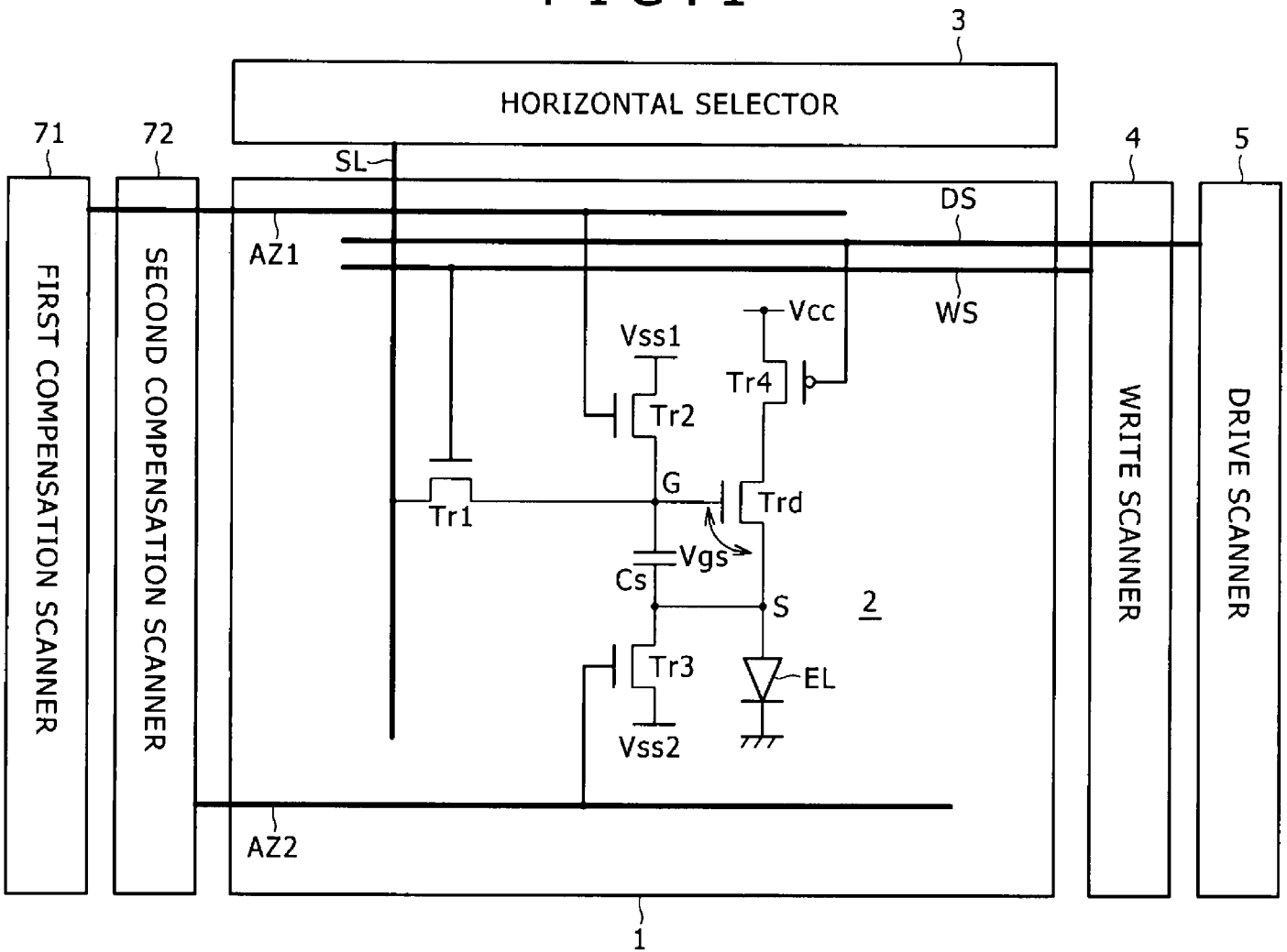
FIG. 1 is a block diagram showing a typical reference implementation of an image display apparatus.

Preferred embodiments of the present invention are described in detail by referring to diagrams as follows. First of all, a typical reference implementation of an image display apparatus serving as the origin of the present invention is explained by referring to FIG. 1. As shown in the figure, the active-matrix image display apparatus includes a pixel-array unit 1 serving as the main unit and its peripheral circuits. The peripheral circuits include a horizontal selector 3, a write scanner 4, a drive scanner 5, a first compensation scanner 71 and a second compensation scanner 72. The pixel-array unit 1 has pixel circuits 2 laid out to form a matrix. Each of the pixel circuits 2 is placed at an intersection of a scanning line WS oriented in the row direction of the matrix and a data signal line SL oriented in the column direction of the matrix. In order to make the figure easy to understand, only one pixel circuit 2 is shown in an enlarged form. The horizontal selector 3 drives the data signal line SL. The horizontal selector 3 is a signal unit for providing a video signal to the data signal line SL. The write scanner 4 drives the first scanning line WS. It is to be noted that, in addition to the first scanning line WS, scanning lines DS, AZ1 and AZ2 are provided in parallel to the first scanning line WS. The drive scanner 5, the first compensation scanner 71 and the second compensation scanner 72 drive the second scanning line DS, the scanning line AZ1 and the scanning line AZ2 respectively. The write scanner 4, the drive scanner 5, the first compensation scanner 71 and the second compensation scanner 72 form a scanner unit for sequentially scanning rows of pixels of the matrix for every horizontal scanning period. When the pixel circuit 2 is selected by the first scanning line WS, the pixel circuit 2 samples the video signal supplied by the data signal line SL. When the pixel circuit 2 is selected by the second scanning line DS, a light emitting device EL employed in the pixel circuit 2 is driven in accordance with the sampled video signal. When the pixel circuit 2 is selected by the scanning lines AZ1 and AZ2, the pixel circuit 2 carries out a compensatory operation determined in advance.

The pixel circuit 2 has five thin-film transistors, i. e., transistors Tr1 to Tr4 and a transistor Trd, a capacitive device (or a pixel capacitor) Cs and the light-emitting device EL cited above. The transistors Tr1 to Tr3 and the drive transistor Trd are each an N-channel polysilicon TFT (thin-film transistor). Meanwhile, the switching transistor Tr4 is a P-channel polysilicon TFT. The capacitive device Cs forms a capacitor unit of the pixel circuit 2. The light emitting device EL is typically an organic EL device designed in the form of a diode having an anode and a cathode. However, the scope of the present invention is by no means limited to the configuration having such a pixel circuit 2. In addition, the light emitting device EL can be generally any device, which emits light when driven by a current.

The drive transistor Trd serving as the central component of the pixel circuit 2 has its gate G connected to one terminal of the pixel capacitor Cs and its source S connected to the other terminal of the pixel capacitor Cs. The gate G of the drive transistor Trd is also connected to another reference electric potential Vss1 through the switching transistor Tr2. The drain of the drive transistor Trd is connected to a power supply Vcc through the switching transistor Tr4. The gate of the switching transistor Tr2 is connected to the scanning line AZ1 and the gate of the switching transistor Tr4 is connected to the second scanning line DS. The anode of the light emitting device EL is connected to the source S of the drive transistor Trd and the cathode of the light emitting device EL is connected to the ground. In some cases, the electric potential of the ground is referred to as Vcath. The source S of the drive transistor Trd is connected to a predetermined reference electric potential Vss2 through the switching transistor Tr3. The gate of the switching transistor Tr3 is connected to the scanning line AZ2. The sampling transistor Tr1 is provided between the data signal line SL and the gate G of the drive transistor Trd. The gate of the sampling transistor Tr1 is connected to the first scanning line WS.

In the configuration described above, the first control signal WS supplied by the first scanning line WS during a predetermined sampling period causes the sampling transistor Tr1 to enter a conductive state, sampling the video signal Vsig supplied by the data signal line SL and storing the sampled video signal Vsig in the pixel capacitor Cs. In accordance with the sampled video signal Vsig, the pixel capacitor Cs applies an input voltage Vgs between the gate G and source S of the drive transistor Trd. During a predetermined light emission period, the drive transistor Trd provides the light emitting device EL with an output current (or drain current) Ids according to the input voltage Vgs. It is to be noted that the output current Ids generated by the drive transistor Trd exhibits a characteristic of dependence on a mobility μ of carriers in a channel area of the drive transistor Trd and a threshold voltage Vth of the drive transistor Trd. The output current Ids generated by the drive transistor Trd causes the light emitting device EL to emit a light beam at a luminance representing the video signal Vsig.

The typical reference implementation of the image display apparatus serving as the origin of the present invention is characterized in that the pixel circuit 2 employs a compensation unit including the switching transistors Tr2 to Tr4. In order to nullify effects of the dependence of the output current Ids on the mobility μ of carriers in a channel area of the drive transistor Trd, the input voltage Vgs held in the pixel capacitor Cs is compensated in advance for the effect at the beginning of the light emission period. To put it concretely, in accordance with the control signals WS and DS supplied by the scanning lines WS and DS respectively, the compensation unit including the switching transistors Tr2 to Tr4 operates during a portion of the sampling period in order to draw the output current Ids from the drive transistor Trd with the video signal Vsig sampled and feed back the drawn output current Ids to the pixel capacitor Cs in a negative feedback operation so as to compensate the input voltage Vgs for the effect of the dependence of the output current Ids on the carrier mobility μ. In addition, in order to nullify the effect of the dependence of the output current Ids on the threshold voltage Vth of the drive transistor Trd, prior to the sampling period, the threshold voltage Vth is detected and the detected threshold voltage Vth is added to the input voltage Vgs.

In the case of the typical reference implementation of the image display apparatus, the drive transistor Trd is an N-channel transistor, the drain and the source S of which are connected to the power supply Vcc and the light emitting device EL respectively. In this case, at the beginning of the light emission period overlapping with the later portion of the sampling period preceding the light emission period, the compensation unit described above draws the output current Ids from the drive transistor Trd and feeds back the drawn output current Ids to the pixel capacitor Cs in a negative feedback operation. At the beginning of the light emission period, the compensation unit also operates in order to draw the output current Ids from the source S of the drive transistor Trd and direct the drawn output current Ids to the capacitive component of the light emitting device EL as well. To put it concretely, the light emitting device EL is a light emitting device designed in the form of a diode having an anode connected to the source S of the drive transistor Trd and a cathode connected to the ground. In this configuration, the compensation unit including the switching transistors Tr2 to Tr4 sets the anode and cathode of the diode-type light emitting device EL in an inversely biased state in advance so that, when the output current Ids drawn from the source S of the drive transistor Trd flows into the light emitting device EL, the light emitting device EL functions as a capacitive device equivalent to the capacitive component cited above. It is to be noted that the compensation unit is capable of adjusting the width t of a sub-period included in the latter part of the sampling period as a sub-period during which the output current Ids is being drawn from the source S of the drive transistor Trd. Thus, the amount of the output current Ids fed back to the pixel capacitor Cs in a negative feedback operation can be optimized.

Figure 2:
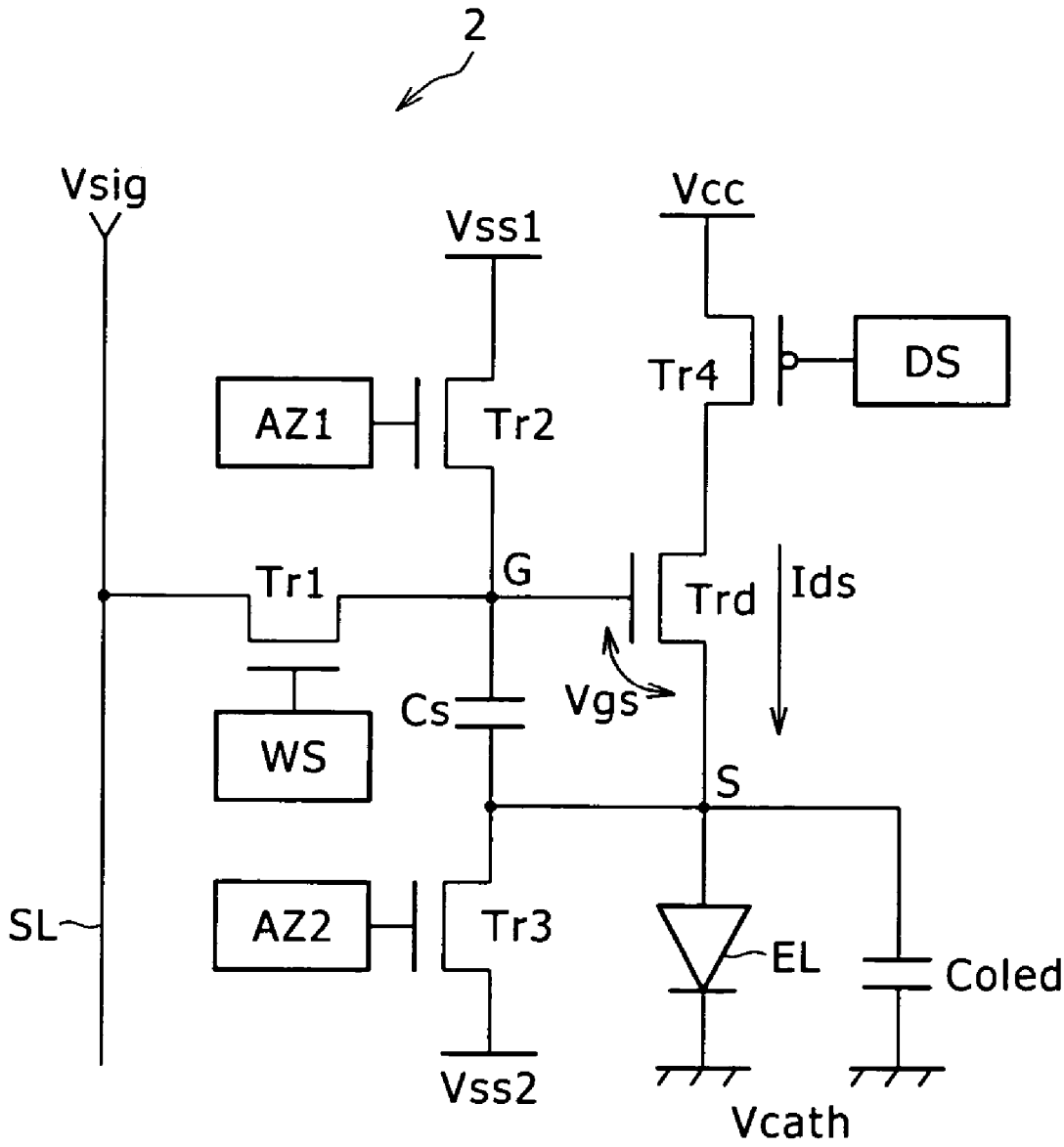
FIG. 2 is a diagram showing a model of a pixel circuit employed in the image display apparatus shown in FIG. 1.

FIG. 2 is a diagram showing a model of the pixel circuit 2 employed in the image display apparatus shown in FIG. 1. In order to make the model easy to understand, the video signal Vsig sampled by the sampling transistor Tr1, the input voltage Vgs applied to the drive transistor Trd, the output current Ids generated by the drive transistor Trd and the capacitive component Coled of the light emitting device EL are additionally shown. Operations carried out by the pixel circuit 2 employed in the typical reference implementation of the image display apparatus are explained by referring to FIG. 2 as follows.

Figure 3:
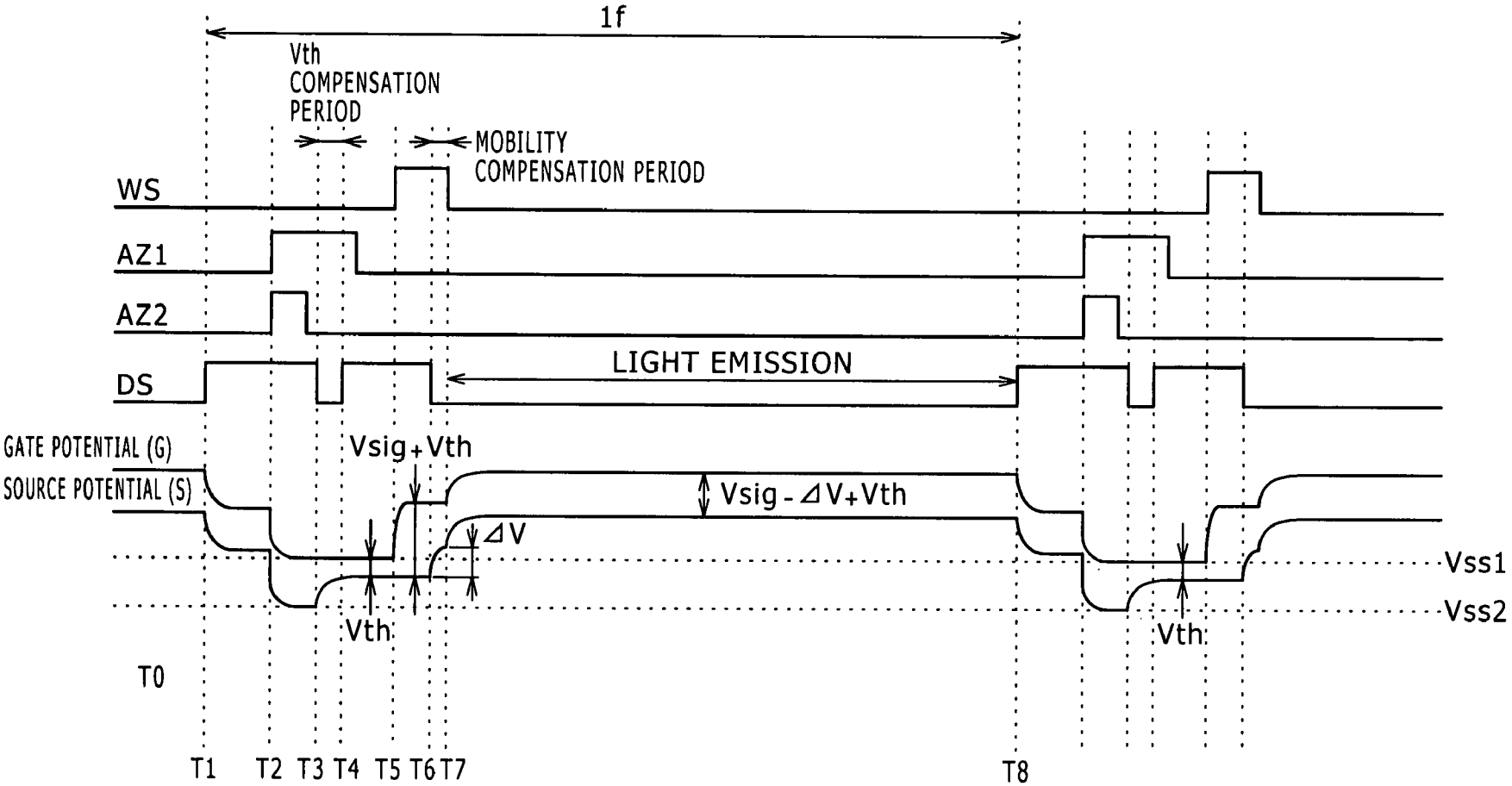
FIG. 3 shows timing charts to be referred to in explanation of operations carried out by the image display apparatus shown in FIGS. 1 and 2.

FIG. 3 shows timing charts of the pixel circuit 2 shown in FIG. 2. The operations carried out by the circuit shown in FIG. 2 as the pixel circuit 2 employed in the typical reference implementation of the image display apparatus are explained more concretely by referring to timing charts shown in FIG. 3 as follows. FIG. 3 shows the waveforms of control signals provided by the scanning lines WS, AZ1, AZ2 and DS along a time axis T. In order to make the diagram simple, each specific one of the control signals is denoted by a notation denoting a scanning line conveying the specific control signal. Since the transistors Tr1, Tr2 and Tr3 are each an N-channel transistor, the control signals conveyed by the scanning lines WS, AZ1 and AZ2 are each an active-high signal set at a high level in an active state and set at a low level in order to deactivate the signal. Since the switching transistor Tr4 is a P-channel transistor, on the other hand, the control signal conveyed by the second scanning line DS is an active-low signal set at a low level in an active state and set at a high level in order to deactivate the signal. It is to be noted that FIG. 3 shows not only the timing charts of the waveforms of control signals provided by the scanning lines WS, AZ1, AZ2 and DS, but also the timing charts of the waveforms of the electric potentials appearing at the gate G and source S of the drive transistor Trd.

In the timing charts shown in FIG. 3, a period between timings T1 and T8 is one field (1f). During the period of 1f, rows of the pixel array are sequentially scanned once. The timing charts represent the waveforms of the control signals WS, AZ1, AZ2 and DS applied to pixels on each of the rows.

With a timing T0 prior to the start of the field, all the control signals WS, AZ1, AZ2 and DS are set at a low level. Thus, the N-channel transistors Tr1, Tr2 and Tr3 are in an off state. On the other hand, only the P-channel switching transistor Tr4 is in an on state. Thus, since the drive transistor Trd is connected to the power supply Vcc through the on-state switching transistor Tr4, the drive transistor Trd is supplying an output current Ids to the light emitting device EL in accordance with the predetermined input voltage Vgs. As a result, the light emitting device EL is emitting a light beam with the timing T0. The input voltage Vgs applied to the drive transistor Trd is expressed by the difference in electric potential between the gate G and source S of the drive transistor Trd.

With the timing T1 at the start of the field, the second control signal DS is raised from the low level to a high level, putting the switching transistor Tr4 in an off state and, hence, detaching the drive transistor Trd from the power supply Vcc. Thus, the light emission is terminated, and a no light emission period is started. As a result, with the timing T1, all the transistors Tr1 to Tr4 are in the off state.

Then, with the timing T2, the control signals AZ1 and AZ2 are raised from the low level to a high level, putting the switching transistors Tr2 and Tr3 in an on state. As a result, the gate G of the drive transistor Trd is connected to the reference electric potential Vss1 whereas the source S of the drive transistor Trd is connected to the reference electric potential Vss2. A relation (Vss1−Vss2)>Vth holds true. The difference (Vss1−Vss2) is applied to the gate G of the drive transistor Trd as Vgs>Vth. Thus, a threshold-voltage compensatory operation to be carried out with the timing T3 is prepared. In other words, a period from the timing T2 to the timing T3 corresponds to a reset period of the drive transistor Trd. In addition, the reference electric potential Vss2 is set to satisfy a relation VthEL>Vss2 where notation VthEL denotes the threshold voltage of the light emitting device EL. Thus, a minus bias is applied to the light emitting device EL, putting the light emitting device EL in the so-called inversely biased state. The inversely biased state is needed in order to normally carry out the threshold-voltage compensatory operation and a mobility compensatory operation later.

With the timing T3, the control signal AZ2 is pulled down to the low level to be followed immediately by the second control signal DS. Thus, the switching transistor Tr3 is put in an off state but the switching transistor Tr4 is put in an on state. As a result, the output current Ids flows to the pixel capacitor Cs, starting the threshold-voltage compensatory operation. At that time, the gate G of the drive transistor Trd is held at the reference electric potential Vss1 so that the output current Ids is flowing till the drive transistor Trd is cut off. When the drive transistor Trd is cut off, the electric potential appearing at the source S of the drive transistor Trd becomes equal to a difference of (Vss1−Vth). With the timing T4 after the operation to cut off the drain current, the second control signal DS is set back at the high level in order to put the switching transistor Tr4 in an off state. In addition, the control signal AZ1 is also changed to the low level in order to put the switching transistor Tr2 in an off state as well. As a result, the threshold voltage Vth is held at the pixel capacitor Cs as a fixed voltage. Thus, a period from the timing T3 to the timing T4 is a period for detecting the threshold voltage Vth. For this reason, the period from the timing T3 to the timing T4 is referred to as a threshold-voltage compensation period.

With the timing T5 after the threshold-voltage compensatory operation carried out as described above, the first control signal WS is changed to the high level in order to put the sampling transistor Tr1 in an on state. Thus, the video signal Vsig is stored in the pixel capacitor Cs. The capacitance of the pixel capacitor Cs is sufficiently small in comparison with the equivalent capacitance Coled of the light emitting device EL. As a result, most of the video signal Vsig is almost all stored in the pixel capacitor Cs. Accurately speaking, the video signal Vsig relative to the reference electric potential Vss1 (that is, a difference of Vsig−Vss1) is stored in the pixel capacitor Cs. Thus, the input voltage Vgs applied between the gate G and source S of the drive transistor Trd becomes equal to the sum of the threshold voltage Vth detected and held earlier and the difference of (Vsig−Vss1) sampled this time.

That is to say, the input voltage Vgs is equal to (Vsig−Vss1+Vth). In order to make the following explanation simple, let us assume that the reference electric potential Vss1 is 0 V. In this case, the input voltage Vgs is equal to (Vsig+Vth) as is indicated in the timing charts shown in FIG. 3. The process to sample the video signal Vsig continues to the timing T7 with which the first control signal WS is restored to the low level. That is to say, a period from the timing T5 to the timing T7 is a sampling period.

With the timing T6 preceding the timing T7 with which the sampling period will be ended, the second control signal DS is changed to the low level in order to put the switching transistor Tr4 in an on state. Thus, since the drive transistor Trd is connected to the power supply Vcc, the pixel circuit transits from the no light emission period to a light emission period. In this way, during a period from the timing T6 to the timing T7 in which the sampling transistor Tr1 still remains in an on state and the switching transistor Tr4 has entered an on state, a mobility compensatory operation is carried out. That is, according to the present embodiment, the mobility compensatory operation is carried out in the period from the timing T6 to T7 in which the beginning of the light emission period overlaps with the later portion of the sampling period preceding the light emission period. It is to be noted that, at the beginning sub-period included in the light emission period as a sub-period to carry out the mobility compensatory operation, the light emitting device EL is in an inversely biased state allowing no light to be emitted. In this mobility compensation period from the timing T6 to the timing T7, the output current Ids is flowing through the drive transistor Trd with the gate G of the drive transistor Trd held at the electric potential of the video signal Vsig. With the relation of (Vss1−Vth)<VthEl holding true, the light emitting device EL is put in an inversely biased state. Thus, instead of displaying the characteristic of a diode, the light emitting device EL exhibits the simple capacitive characteristic of a capacitor. As a result, the output current Ids flowing through the drive transistor Trd is stored in a combined capacitor having a capacitance C (=Cs+Coled) where notation Cs denotes the capacitance of the pixel capacitor Cs whereas notation Coled denotes the capacitance of the capacitor Coled of the light emitting device EL. Therefore, the electric potential appearing at the source S of the drive transistor Trd is rising. In the timing charts shown in FIG. 3, the increase in source electric potential is expressed by ΔV. The source electric-potential increase ΔV is eventually subtracted from the input voltage Vgs held in the pixel capacitor CS as a voltage between the gate G and source S of the drive transistor Trd to give an effect of negative feedback. By feeding the source electric-potential increase ΔV caused by the output current Ids of the drive transistor Trd to the input voltage Vgs of the drive transistor Trd itself in a negative feedback operation in this way, the operation of the drive transistor Trd can be compensated for the carrier mobility μ. It is to be noted that, by adjusting this mobility compensation period from the timing T6 to the timing T7, the source electric-potential increase ΔV can be optimized.

With the timing T7, the first control signal WS is changed to a low level in order to put the sampling transistor Tr1 in an off state. As a result, the gate G of the drive transistor Trd is detached from the data signal line SL, terminating the application of the video signal Vsig to the drive transistor Trd. Thus, the electric potential appearing at the gate G of the drive transistor Trd is capable of rising and, as a matter of fact, the electric potential appearing at the gate G of the drive transistor Trd is rising along with the electric potential appearing at the source S of the drive transistor Trd. In the mean time, the input voltage Vgs held in the pixel capacitor CS as a voltage between the gate G and source S of the drive transistor Trd is sustained at a level represented by the expression (Vsig−ΔV+Vth). With the electric potential appearing at the source S of the drive transistor Trd rising, the inversely biased state of the light emitting device EL is terminated so that, the output current Ids is allowed to flow to the light emitting device EL, enabling the light emitting device EL to start actually emitting a light beam. A relation holding true at that time as the relation between the output current Ids and the input voltage Vgs is expressed by Eq. 2 given below. Eq. 2 is an equation obtained by substituting the expression (Vsig−ΔV+Vth) into characteristic equation 1 of the drive transistor Trd for the term of the input voltage Vgs.

$$Ids=k\mu(Vgs-Vth)2=k\mu(Vsig-\Delta V)2 \quad \text{Eq. 2}$$

Notation k used in Eq. 2 denotes an expression (1/2) (W/L) Cox. Eq. 2 no longer includes the term of the threshold voltage Vth of the drive transistor Trd. That is to say, as is obvious from Eq. 2, the output current Ids supplied to the light emitting device EL is no longer dependent on the threshold voltage Vth of the drive transistor Trd. Basically, the drain current (or the output current) Ids is determined by the voltage of the video signal Vsig. In other words, the light emitting device EL emits a light beam with a luminance according to the video signal Vsig. At that time, however, the video signal Vsig is corrected by the feedback quantity ΔV. This correction quantity ΔV is also used for just nullifying the effect of the mobility μ included in a coefficient in Eq. 2. As a result, the drain current Ids is essentially dependent on the video signal Vsig only.

Finally, with the timing T8, the second control signal DS is raised to the high level in order to put the switching transistor Tr4 in an off state. With this timing, the light emission and the field are both ended. Then, the pixel circuit 2 enters the next field, repeating the threshold-voltage compensatory operation, the mobility compensatory operation and the light emitting operation, which have been described above.

However, the pixel circuit 2 employed in this typical reference implementation of the image display apparatus requires five transistors Tr1, Tr2, Tr3, Tr4 and Trd, three power-supply lines Vss1, Vss2 and Vcc and four gate lines (or scanning lines) WS, DS, AZ1 and AZ2. The number of intersections of the gate lines (or the scanning lines) and the data signal line SL and intersections of the gate lines (or the scanning lines) and the power-supply lines is inevitably large as well. The large number of such intersections is a cause of a low yield. In addition, a high degree of fineness of the layout is difficult to achieve. In the case of a fine panel, it is necessary to reduce the number of components in order to raise the yield.

Figure 4:
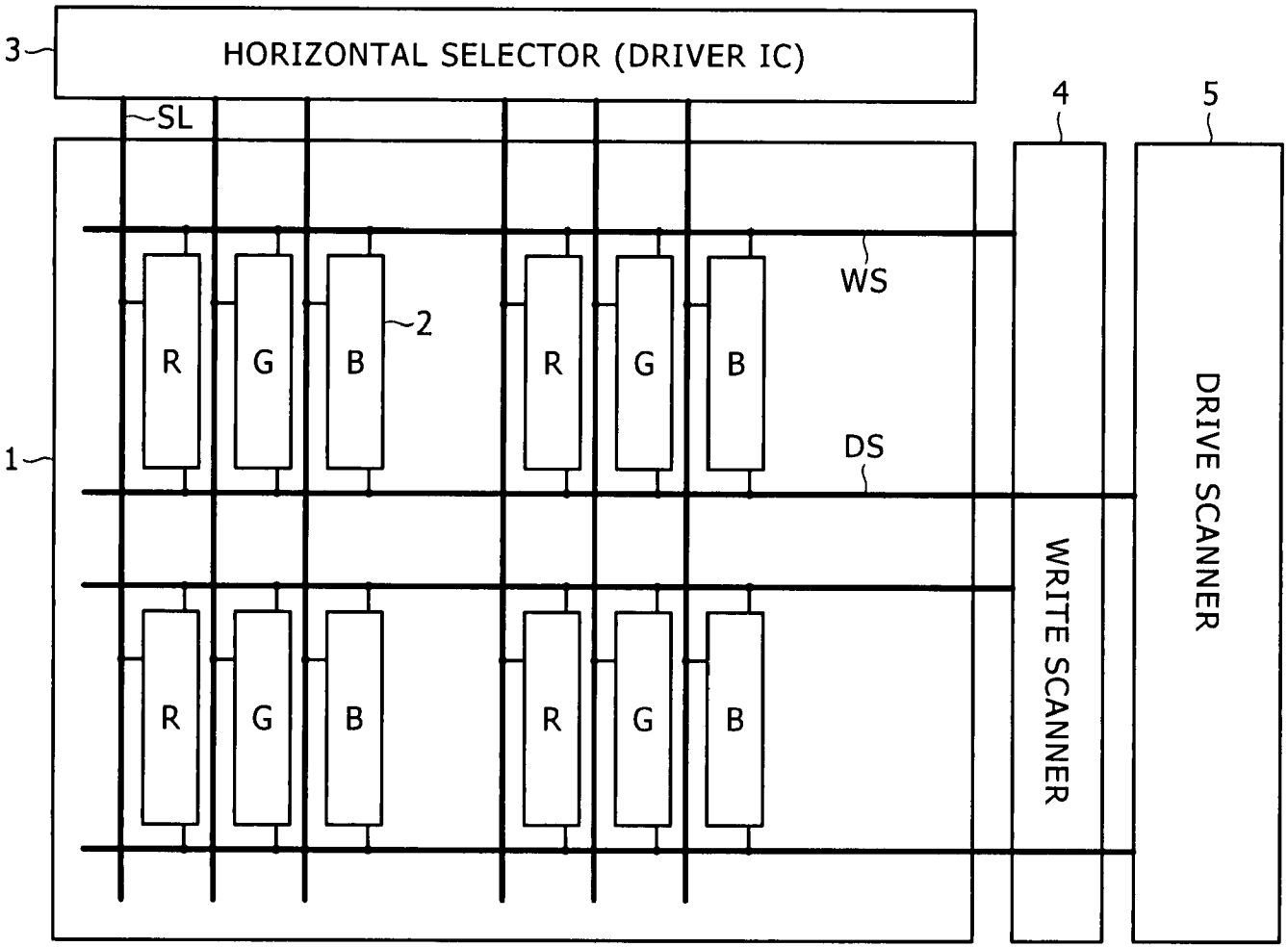
FIG. 4 is a block diagram showing the entire configuration of the image display apparatus provided by the present invention.

FIG. 4 is a block diagram showing the entire configuration of the image display apparatus provided by the present invention. The image display apparatus is an image display apparatus of the active matrix type having a threshold-voltage (Vth) compensatory function. As shown in the figure, the image display apparatus of the active matrix type includes a pixel-array unit 1 serving as the main component and its peripheral circuits. The peripheral circuits include a horizontal selector 3, a write scanner 4 and a drive scanner 5. The pixel-array unit 1 has pixel circuits 2 laid out to form a matrix. Each of the pixel circuits 2 is placed at an intersection of a first scanning line WS (or a second scanning line DS) oriented in the row direction of the matrix and a signal line SL oriented in the column direction of the matrix. The pixel circuits 2 are R, G and B pixels. The R, G and B pixels are pixels for the three R, G and B primary colors allowing a color display. However, the scope of the present invention is by no means limited to this feature. The R, G and B pixels are each a pixel circuit 2. The data signal line SL is driven by the horizontal selector 3. The horizontal selector 3 functions as a signal unit, which is generally implemented as a driver IC. The data signal line SL conveys a video signal. The first scanning line WS is driven by the write scanner 4. It is to be noted that the second scanning line DS parallel to the first scanning line WS is also provided. The second scanning line DS is driven by the drive scanner 5. The write scanner 4 and the drive scanner 5 form a scanner unit. The scanner unit sequentially drives pixels on rows for every horizontal scanning period. When a pixel circuit 2 is selected by the first scanning line WS, the pixel circuit 2 samples the video signal conveyed by the data signal line SL. When a pixel circuit 2 is selected by the second scanning line DS, the pixel circuit 2 drives a light emitting device included in the pixel circuit 2 in accordance with the sampled video signal. In addition, a pixel circuit 2 is also controlled by the first scanning line WS and the second scanning line DS to carry out compensatory operations determined in advance.

The pixel-array unit 1 cited above is created on an insulation substrate such as a piece of ordinary glass to form a flat panel. Each of the pixel circuits 2 is created from amorphous silicon TFTs (thin-film transistors) or low-temperature polysilicon TFTs. In the case of a pixel-array unit 1 composed of pixel circuits 2 each created from amorphous silicon TFTs, the scanner unit is configured as typically a TAB separated from the flat panel and connected to the flat panel by using a flexible cable. By the same token, the signal unit is configured as a driver IC external to the flat panel and connected to the flat panel by using a flexible cable. In the case a pixel-array unit 1 composed of pixel circuits 2 each created from low-temperature polysilicon TFTs, on the other hand, the scanner unit, the signal unit and the pixel-array unit 1 are integrated into a single body on the flat panel. This is because both the signal and scanner units can also be formed from low-temperature polysilicon TFTs as well.

Figure 5:
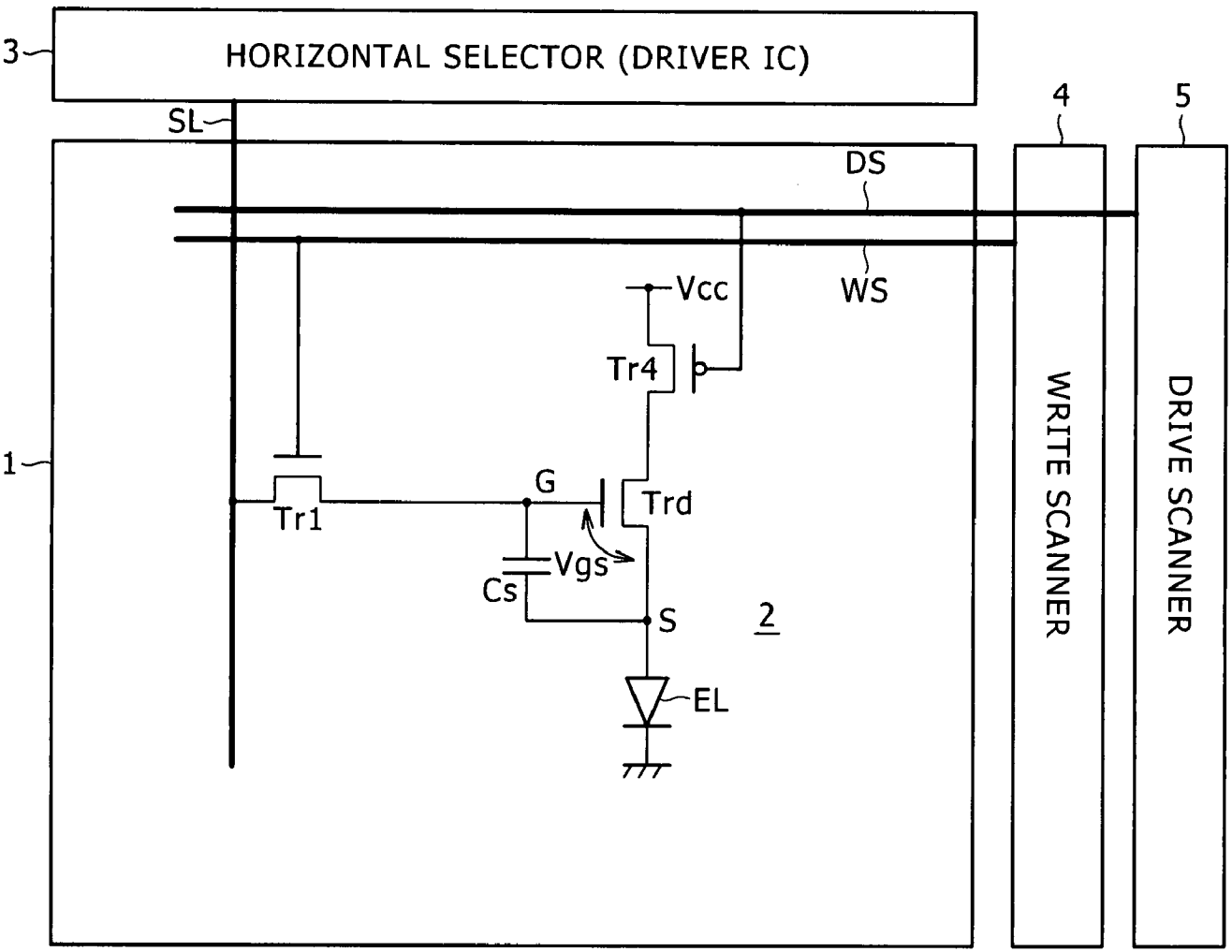
FIG. 5 is a block diagram showing the configuration of a pixel circuit embedded in the image display apparatus provided by the present invention.

FIG. 5 is a block diagram showing the configuration of a pixel circuit 2 embedded in the image display apparatus shown in FIG. 4 as an image display apparatus provided by the present invention. As shown in FIG. 5, the pixel circuit 2 includes a sampling transistor Tr1, a pixel capacitor Cs connected to the sampling transistor Tr1, a drive transistor Trd connected to the sampling transistor Tr1 and the pixel capacitor Cs, a light emitting device EL connected to the drive transistor Trd and the pixel capacitor Cs as well as a switching transistor Tr4 for connecting the drive transistor Trd to a power supply Vcc.

The first scanning signal WS supplies a first control signal WS in order to put the sampling transistor Tr1 in an on state. With the sampling transistor Tr1 put in an on state, the sampling transistor Tr1 samples the electric potential of a video signal Vsig conveyed by the data signal line SL and stores the sampled electric potential in the pixel capacitor CS. The pixel capacitor CS applies an input voltage Vgs to the gate G of the drive transistor Trd in accordance with the electric potential of the sampled video signal Vsig. In turn, the drive transistor Trd supplies an output current Ids according to the input voltage Vgs to the light emitting device EL. It is to be noted that the output current Ids exhibits a characteristic of dependence on the threshold voltage Vth of the drive transistor Trd. The output current Ids generated by the drive transistor Trd causes the light emitting device EL to emit a light beam at a luminance representing the electric potential of the video signal Vsig. The second scanning signal DS supplies a second control signal DS in order to put the switching transistor Tr4 in an on state. With the switching transistor Tr4 put in an on state, the drive transistor Trd is connected to the power supply Vcc during the light emission period, which is a period in which the light emitting device EL is emitting a light beam. In a no light emission period, on the other hand, the switching transistor Tr4 is put in an off state in order to disconnect the drive transistor Trd from the power supply Vcc.

The image display apparatus is characterized in that, during a horizontal scanning period (1H), the scanner unit including the write scanner 4 and the drive scanner 5 outputs a first control signal to the first scanning line WS connected to the write scanner 4 in order to put the sampling transistor Tr1 in an on state and a second control signal to the second scanning line DS connected to the drive scanner 5 in order to put the switching transistor Tr4 in an on state in execution of control to turn the transistors Tr1 and Tr4 on and off. In addition, in order to compensate the pixel circuit 2 for an effect of the characteristic exhibited by the output current Ids of the drive transistor Trd as a characteristic of dependence on the threshold voltage Vth of the drive transistor Trd, the pixel circuit 2 carries out: a preparatory operation to reset the pixel capacitor Cs; a compensatory operation to store a voltage in the reset pixel capacitor Cs as a voltage for canceling the effect of the threshold voltage Vth; and a sampling operation to sample the electric potential of a video signal Vsig supplied by the data signal line SL and storing the sampled electric potential in the compensated pixel capacitor Cs.

On the other hand, during a horizontal scanning period (1H), the signal unit including the horizontal selector 3 (or the driver IC 3) switches the video signal appearing on the data signal line SL among a first fixed electric potential VssH, a second fixed electric potential VssL and a signal electric potential Vsig, providing each pixel with electric potentials needed for the preparatory operation, the compensatory operation and the sampling operation through the data signal line SL.

To put it concretely, first of all, after continuously supplying the video signal at the first fixed electric potential VssH of a high level, the horizontal selector 3 switches the video signal to the second fixed electric potential VssL of a low level in order to make the preparatory operation executable. Then, while the second fixed electric potential VssL of a low level is being sustained, the compensatory operation is carried out. Subsequently, the horizontal selector 3 switches the video signal from the second fixed electric potential VssL to the signal electric potential Vsig, allowing the sampling operation to be carried out. Configured as a driver IC, the horizontal selector 3 includes a signal generation circuit for generating the signal electric potential Vsig and an output circuit for inserting the first fixed electric potential VssH and the second fixed electric potential VssL into the signal electric potential Vsig generated by the signal generation circuit in a synthesis process to generate a video signal switched among the first fixed electric potential VssH, the second fixed electric potential VssL and the signal electric potential Vsig, and outputs the video signal to each data signal line SL. Preferably, the driver IC as the horizontal selector 3 outputs a video signal synthesizing the signal electric potential Vsig not exceeding an ordinary rating value with the first fixed electric potential Vssh exceeding the rating value. In this case, the signal generation circuit included in the driver IC merely needs to have an ordinary withstand voltage for generating the signal electric potential Vsig not exceeding the rating value and, on the other hand, only the output circuit must be made capable of withstanding the high first fixed electric potential VssH exceeding the rating value.

The output current Ids generated by the drive transistor Trd exhibits a characteristic of dependence on a mobility μ of carriers in a channel area of the drive transistor Trd and the threshold voltage Vth of the drive transistor Trd. In order to cope with an effect of this dependence, after outputting a control signal to the second scanning line DS during a horizontal scanning period (1H), the scanner unit including the write scanner 4 and the drive scanner 5 further controls the switching transistor Tr4. To put it concretely, in order to nullify the effect of the dependence of the output current Ids on the mobility μ of carriers in a channel area of the drive transistor Trd, with the signal electric potential Vsig sampled, the output current Isd is drawn from the drive transistor Trd and fed back to the pixel capacitor Cs in a negative feedback process in an operation to compensate the input voltage Vgs for the effect of the dependence.

Figure 6:
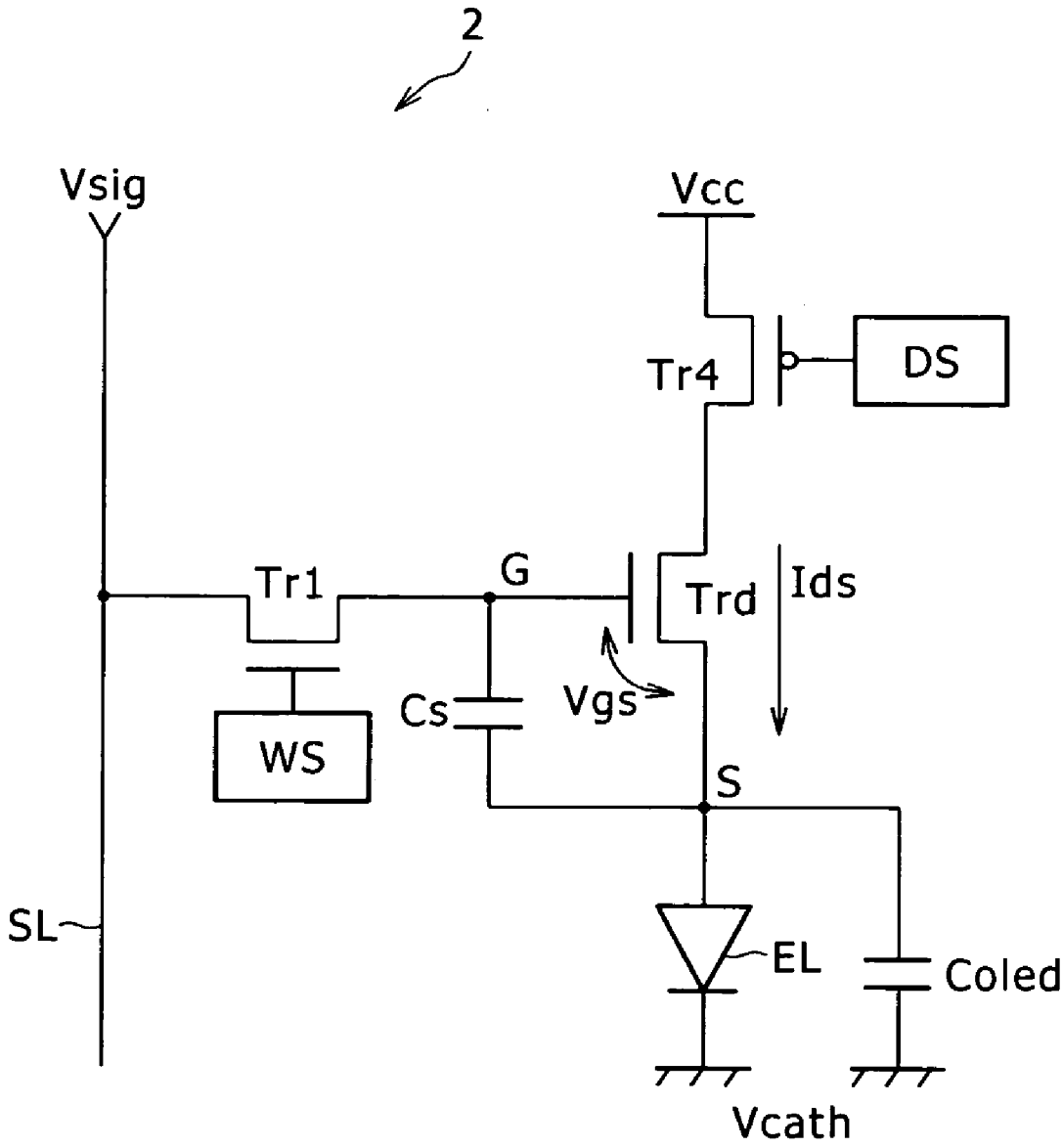
FIG. 6 is a diagram showing a model of the pixel circuit employed in the image display apparatus shown in FIG. 5.

FIG. 6 is a diagram showing a model of the pixel circuit 2 employed in the image display apparatus shown in FIG. 5. In order to make the model easy to understand, the video signal Vsig sampled by the sampling transistor Tr1, the input voltage Vgs applied to the drive transistor Trd, the output current Ids generated by the drive transistor Trd and the capacitive component Coled of the light emitting device EL are additionally shown. In addition, the first scanning line WS connected to the gate of the sampling transistor Tr1 and the second scanning line DS connected to the gate of the switching transistor Tr4 are each shown as a box. The pixel circuit 2 carries out a threshold-voltage compensation preparatory operation, an actual compensatory operation, and a signal electric potential sampling operation during a horizontal scanning period (1H). Thus, the pixel circuit 2 can be configured to include only three transistors Tr1, Tr4 and Trd, one pixel capacitor Cs and one light emitting device EL. In comparison with the pixel circuit 2 employed in typical reference implementation shown in FIG. 1 as a pixel circuit 2 including the threshold-voltage compensation preparatory operation, at least two switching transistors can be eliminated. Thus, the power-supply and gate lines of the two eliminated switching transistors can also be eliminated as well, making it possible to increase the yield of the pixel circuit 2. In addition, since the layout of the pixel circuit 2 can be made simple, the fineness of the panel can also be enhanced as well.

Figure 7:
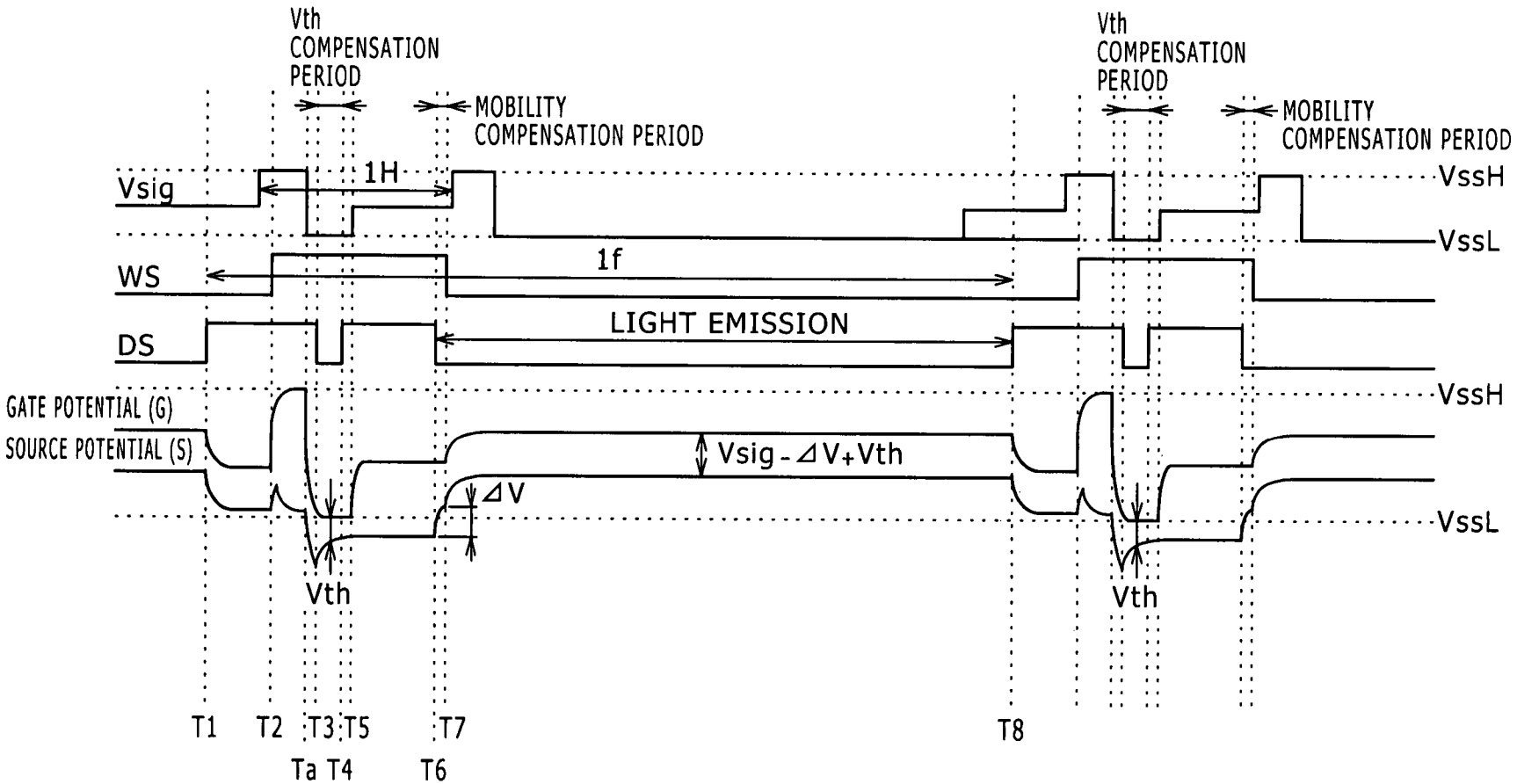
FIG. 7 shows timing charts to be referred to in explanation of operations carried out by the pixel circuit shown in FIGS. 5 and 6.

FIG. 7 shows timing charts of the pixel circuit 2 shown in FIGS. 5 and 6. Operations carried out by the circuit shown in FIGS. 5 and 6 are explained more concretely and in more detail by referring to FIG. 7 as follows. FIG. 7 shows the waveforms of control signals provided by the first and second scanning lines WS and DS along a time axis T. In order to make the diagram simple, each specific one of the control signals is denoted by a notation denoting a scanning line conveying the specific control signal. In addition, the waveform of the video signal applied to the data signal line SL is also shown along the time axis T. During every horizontal scanning period (1H), the video signal is switched sequentially among the high-level first fixed electric potential VssH, the low-level second fixed electric potential VssL and the signal electric potential vsig, which represents the true electric potential of the video signal, as shown in the figure. Since the sampling transistor Tr1 is an N-channel transistor, the first control signal conveyed by the first scanning line WS is an active-high signal set at a high level in an active state and set at a low level in order to deactivate the signal. Since the switching transistor Tr4 is a P-channel transistor, on the other hand, the second control signal conveyed by the second scanning line DS is an active-low signal set at a low level in an active state and set at a high level in order to deactivate the signal. It is to be noted that FIG. 7 shows not only the timing charts of the waveforms of the first and second control signals provided by the first and second scanning lines WS and DS respectively, but also the timing charts of the waveforms of the electric potentials appearing at the gate G and source S of the drive transistor Trd.

In the timing charts shown in FIG. 7, a period between timings T1 and T8 is one field (1f). During the period of 1f, rows of the pixel array are sequentially scanned once. The timing charts represent the waveforms of the first and second control signals WS and DS applied to pixels on each of the rows.

To begin with, with the timing T1 at the start of the field, the second control signal DS is raised from the low level to a high level, putting the switching transistor Tr4 in an off state and, hence, detaching the drive transistor Trd from the power supply Vcc. Thus, the light emission is terminated, and a no light emission period is started. As a result, since no power is supplied from the power supply Vcc to the drive transistor Trd, an electric potential appearing at the source S of the drive transistor Trd is pulled down to a cutoff voltage (or the threshold voltage) VthEL of the light emitting device EL.

Then, with the timing T2, the first control signal WS is raised from the low level to a high level, putting the sampling transistor Tr1 in an on state. It is desirable to rather raise the signal-line voltage to the high-level first fixed electric potential VssH before the sampling transistor Tr1 is put in an on state with the timing T2 in order to shorten a write time to write the video signal into the pixel capacitor Cs. With the sampling transistor Tr1 put in an on state, the high-level first fixed electric potential VssH is applied to the gate G of the drive transistor Trd as a gate electric potential and written into the pixel capacitor Cs. At that time, the electric potential appearing at the source S of the drive transistor Trd also rises due to an effect of coupling provided by the pixel capacitor Cs as coupling between the gate G and source S of the drive transistor Trd. However, the electric potential appearing at the source S of the drive transistor Trd rises only temporarily before the electric potential is discharged to the ground by way of the light emitting device EL. Thus, eventually, the electric potential appearing at the source S of the drive transistor Trd settles at the cutoff voltage (or the threshold voltage) VthEL of the light emitting device EL. At that time, the gate voltage remains at the high-level first fixed electric potential VssH as it is.

With a timing Ta, by sustaining the sampling transistor Tr1 in an on state as it is, the voltage appearing on the data signal line SL is pulled down to the low-level second fixed electric potential VssL. Due to a coupling effect provided by the pixel capacitor Cs, the change in signal-line voltage is propagated to the electric potential appearing at the source of the drive transistor Trd. The magnitude of the change propagated by the coupling is represented by the following expression:

$$Cs/(Cs+Coled)\times(VssH-VssL)$$

At that time, the electric potential appearing at the gate of the drive transistor Trd is VssL and the electric potential appearing at the source of the drive transistor Trd is represented by the following expression:

$$VthEL-Cs/(Cs+Coled)\times(VssH-VssL)$$

Since the electric potential appearing at the source of the drive transistor Trd is lower than the cutoff voltage (or the threshold voltage) VthEL of the light emitting device EL, that is, since a negative (or inverted) bias is applied to the light emitting device EL, the light emitting device EL is put in a cutoff state. In this case, it is desirable to sustain the electric potential appearing at the source of the drive transistor Trd at a value continuously putting the light emitting device EL in the cutoff state even after completions of the threshold-voltage compensatory operation and the mobility compensatory operation, which are carried out hereafter. In addition, by introducing coupling to result in an input voltage Vgs (>Vth), preparation of the threshold-voltage compensatory operation can be carried out. Thus, even in a pixel circuit 2 eliminating some switching transistors, their gate lines and their power-supply lines, preparation of the threshold-voltage compensatory operation can be carried out. That is to say, a period from the timing T2 to the timing Ta is the compensation preparation period.

With the timing T3, by sustaining the gate G at the low-level second fixed electric potential VssL, the switching transistor Tr4 is put in an on state in order to flow a current to the drive transistor Trd in execution of the threshold-voltage compensatory operation in the same way as the typical reference implementation described earlier. The current keeps flowing till the drive transistor Trd enters a cutoff state. As the drive transistor Trd enters a cutoff state, the electric potential appearing at the source of the drive transistor Trd becomes equal to a difference of (VssL−Vth). In this case, it is necessary to have the relation (VssL−Vth)<VthEL hold true.

Then, with the timing T4, the switching transistor Tr4 is put in an off state in order to end the threshold-voltage compensatory operation. Thus, a period from the timing T3 to the timing T4 is referred to as a threshold-voltage compensation period.

With the timing T5 after the threshold-voltage compensatory operation carried out during the period from the timing T3 to the timing T4 as described above, the signal appearing on the data signal line is changed from the low-level second fixed electric potential VssL to the signal electric potential Vsig. Thus, the signal electric potential Vsig of the video signal is stored in the pixel capacitor Cs. The capacitance of the pixel capacitor Cs is sufficiently small in comparison with the equivalent capacitance Coled of the light emitting device EL. As a result, most of the signal electric potential Vsig is almost all stored in the pixel capacitor Cs. Thus, the input voltage Vgs applied between the gate G and source S of the drive transistor Trd becomes equal to the sum of the threshold voltage Vth detected and held earlier and the signal electric potential Vsig—sampled this time. That is to say, the input voltage Vgs is equal to (Vsig+Vth). The process to sample the signal electric potential Vsig continues to the timing T7 with which the first control signal WS is restored to the low level. That is to say, a period from the timing T5 to the timing T7 is a sampling period.

The pixel circuit according to the present invention also carries out an operation to compensate the drive transistor Trd for the effect of the mobility μ of carriers in a channel area of the drive transistor Trd in addition to the operation to compensate the drive transistor Trd for the effect of its threshold Vth. The operation to compensate the drive transistor Trd for the effect of the mobility μ of carriers is carried out in a period from the timing T6 to the timing T7 as will be described later in detail. In conclusion, as shown in the timing charts, a compensation quantity ΔV is subtracted from the input voltage Vgs.

With the timing T7, the first control signal WS is changed to a low level in order to put the sampling transistor Tr1 in an off state. As a result, the gate G of the drive transistor Trd is detached from the data signal line SL, terminating the application of the video signal Vsig to the drive transistor Trd. Thus, the electric potential appearing at the gate G of the drive transistor Trd is capable of rising and, as a matter of fact, the electric potential appearing at the gate G of the drive transistor Trd is rising along with the electric potential appearing at the source S of the drive transistor Trd. In the mean time, the input voltage Vgs held in the pixel capacitor CS as a voltage between the gate G and source S of the drive transistor Trd is sustained at a level represented by the expression (Vsig−ΔV +Vth). With the electric potential appearing at the source S of the drive transistor Trd rising, the inversely biased state of the light emitting device EL is terminated so that, the output current Ids is allowed to flow to the light emitting device EL, enabling the light emitting device EL to start actually emitting a light beam. A relation holding true at that time as the relation between the output current Ids and the input voltage Vgs is expressed by Eq. 2 given earlier. Eq. 2 no longer includes the term of the threshold voltage Vth. That is to say, as is obvious from Eq. 2, the output current Ids supplied to the light emitting device EL is no longer dependent on the threshold voltage Vth of the drive transistor Trd. Basically, the drain current (or the output current) Ids is determined by the voltage of the video signal Vsig. In other words, the light emitting device EL emits a light beam with a luminance according to the signal voltage Vsig of the video signal. At that time, the video signal Vsig is corrected by the feedback quantity ΔV. This correction quantity ΔV is also used for just nullifying the effect of the mobility μ included in a coefficient in Eq. 2. As a result, the drain current Ids is essentially dependent on the video signal Vsig only.

Finally, with the timing T8, the second control signal DS is raised to the high level in order to put the switching transistor Tr4 in an off state. With this timing, the light emission and the field are both ended. Then, the pixel circuit 2 enters the next field in order to repeat the compensation preparatory operation, the threshold-voltage compensation operation, the mobility compensatory operation and the light emitting operation, which are described above.

As shown in the timing charts of FIG. 7, in one horizontal scanning period (1H), in order to cancel the effect of the threshold voltage Vth, the preparatory operation, the compensatory operation and the sampling operation are carried out consecutively by the pixel circuit 2, which is configured to include only three transistors and one pixel capacitor as shown in FIG. 5. Thus, the number of components composing the pixel circuit 2 can be reduced considerably in comparison with the typical reference implementation described earlier. However, since the number of pixels rises with enhancement of the fineness of the panel, the horizontal scanning period allocated to every row of pixels unavoidably becomes short. In addition, even though a high-frequency driving method for improving the picture quality has been proposed, the horizontal scanning period in the high-frequency driving method also becomes short as well. With the horizontal scanning period becoming short in this way, in some cases, it may be difficult to complete the threshold-voltage compensation preparatory operation and the actual threshold-voltage compensatory operation in one horizontal scanning period. For this reason, there is a demand for a display-apparatus driving method for a high-fineness panel and a high-frequency driving panel. A typical advanced developed implementation is explained as follows.

Also in the typical advanced developed implementation, the number of components composing the pixel circuit having the threshold-voltage compensatory function is reduced from that of the typical developed implementation described earlier and, on top of that, a display-apparatus driving method for a high-fineness panel and a high-frequency driving panel is adopted. In the typical advanced developed implementation, the threshold-voltage compensation preparatory operation and the actual threshold-voltage compensatory operation, which are carried out in one horizontal scanning period so far, are carried out at different times distributed among a plurality of horizontal scanning periods. Also in this case, about the same total operation period as that shown in the timing charts of FIG. 7 can be assured. With this time distribution method, it is possible to shorten a sub-portion included in a horizontal scanning period as a sub-period occupied by a threshold-voltage compensation preparatory operation or an actual threshold-voltage compensatory operation. Thus, sufficient time it takes to sample the signal electric potential can be assured in the horizontal scanning period due to the shortened sub-portion allocated to a threshold-voltage compensation preparatory operation or an actual threshold-voltage compensatory operation.

Figure 14:
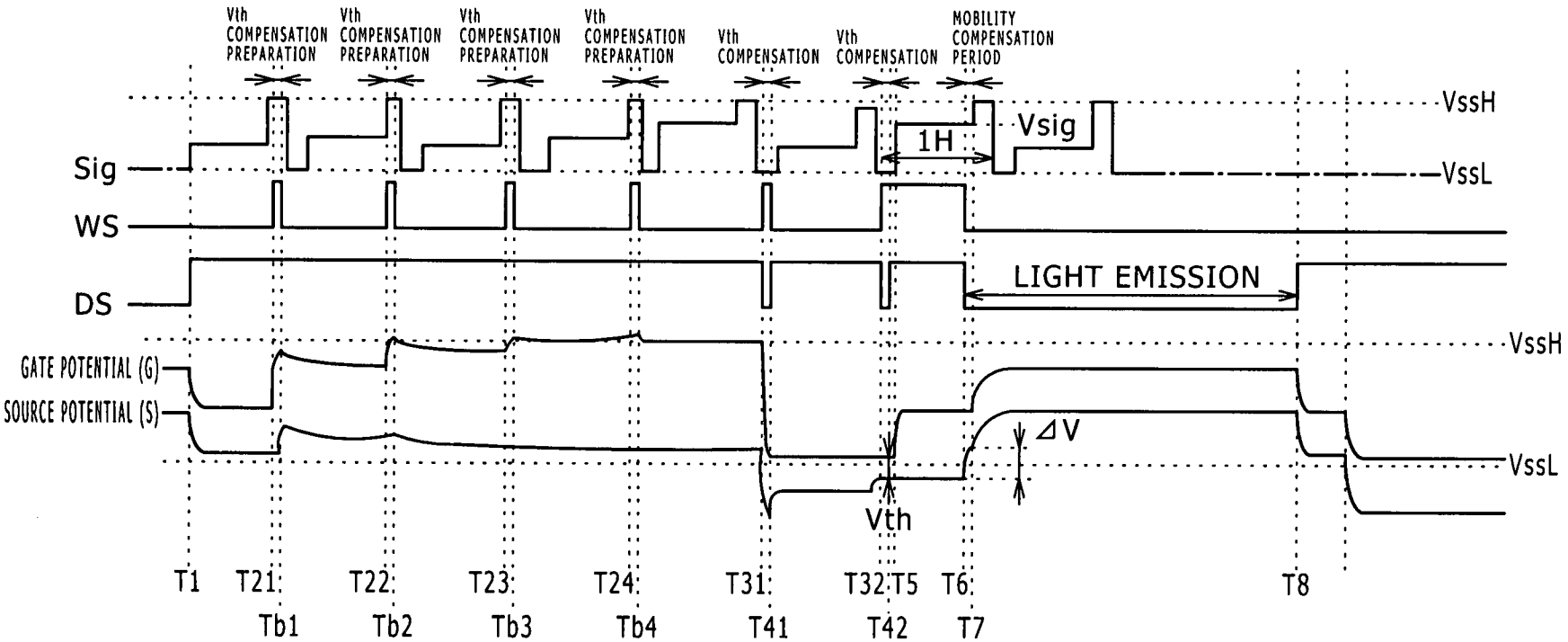
FIG. 14 shows timing charts to be referred to in explanation of operations carried out by a typical advanced developed reference implementation.

FIG. 14 shows timing charts of operations carried out by the typical advanced developed implementation. In order to make the figure easy to understand, every part identical with its counterpart component shown in FIG. 7 is denoted by the same reference notation or the same reference numeral as the counterpart component.

As shown in the figure, with the timing T1, the switching transistor Tr4 is put in an off state, causing the light emitting device EL to enter a no light transmission period. At that time, the electric potential appearing at the source S of the drive transistor Trd is pulled down to the threshold voltage VthEL of the light emitting device EL because no power is supplied from the power supply Vcc.

Then, the sampling transistor Tr1 is put in an on state during a period from a timing T21 to a timing Tb1. During this period, the video signal Sig is set at the high-level first fixed electric potential VssH needed for carrying out the threshold-voltage compensation preparatory operation. With the sampling transistor Tr1 put in an on state, the high-level first fixed electric potential VssH is applied to the gate G of the drive transistor Trd as a gate electric potential. At that time, the electric potential appearing at the source S of the drive transistor Trd also rises due to an effect of coupling provided by the pixel capacitor Cs as coupling between the gate G and source S of the drive transistor Trd. However, the electric potential appearing at the source S of the drive transistor Trd rises only temporarily before the electric potential is discharged to the ground by way of the light emitting device EL. Thus, eventually, the electric potential appearing at the source S of the drive transistor Trd approaches the cutoff voltage (or the threshold voltage) VthEL of the light emitting device EL. The first control signal WS turning on the sampling transistor Tr1 is a train of pulses each having a pulse width equal to the extremely short period from the timing T21 to the timing Tb1. Thus, the electric potential appearing at the gate G of the sampling transistor Tr1 is not capable of reaching the high-level first fixed electric potential VssH during the period from the timing T21 to the timing Tb1. For this reason, the sampling transistor Tr1 is put in an on state again during the next period from a timing T22 to a timing Tb2. During this period, the video signal Sig is set again at the high-level first fixed electric potential VssH. If necessary, this operation is carried out repeatedly till the electric potential appearing at the gate G of the drive transistor Trd reaches the high-level first fixed electric potential VssH. In the case of the example shown in the figure, this operation is carried out again two times during a subsequent period from a timing T23 to a timing Tb3 and a subsequent period from a timing T24 to a timing Tb4. Thus, the same operation is repeated a total of four times.

Then, after the fourth operation, with the video signal Sig pulled down to the low-level second fixed electric potential VssL, the sampling transistor Tr1 is put in an on state in order to change the electric potential appearing at the gate G of the drive transistor Trd from the high-level first fixed electric potential VssH to the low-level second fixed electric potential VssL. For the change of the electric potential appearing at the gate G of the drive transistor Trd, the relation Vgs>Vth holds true, allowing the preparation for a threshold-voltage compensatory operation to be completed. With the sampling transistor Tr1 put in an on state, the switching transistor Tr4 is also put in an on state during a period from a timing T31 to a timing T41, flowing a current to the drive transistor Trd in order to carry out the threshold-voltage compensatory operation. By the same token, the threshold-voltage compensatory operation is also distributed among a plurality periods. Since the width of the pulse of the second control signal DS (that is, the period from the timing T31 to the timing T41) is short, the sampling transistor Tr1 and the switching transistor Tr4 need to be put in an on state repeatedly in order to complete the threshold-voltage compensatory operation. In the case of the example shown in the figure, the sampling transistor Tr1 and the switching transistor Tr4 are put in an on state once more during a period from a timing T32 to a timing T42.

Finally, during a period from a timing T5 to a timing T7, the sampling transistor Tr1 is in an on state, allowing the signal voltage Vsig to be stored in the pixel capacitor Cs. During a period from a timing T6 to the timing T7 in the period from the timing T5 to the timing T7, a mobility compensatory operation is carried out before starting a light emission period.

As described above, a pixel circuit with reduced transistors, power-supply lines and gate lines is capable of carrying out the threshold-voltage compensation preparatory operation and the threshold-voltage compensatory operation even for a panel operation performed at a high frequency and a panel having its pixels laid out with a high degree of fineness. It is to be noted that, in the typical advanced developed reference implementation, with the sampling transistor Tr1 put in an on state, the switching transistor Tr4 is also put in an on state in order to carry out a mobility compensatory operation. Even in a simple threshold-voltage compensatory operation without overlapping the operations of the sampling transistor Tr1 and the switching transistor Tr4 on each other and, thus, without carrying out a mobility compensatory operation, however, the wiring can also be provided in the same way and the number of transistors can also be reduced as well.

As described above, in the horizontal scanning period, the scanner unit outputs control signals to the gates of the transistors in order to control the pixel circuit 2. Controlled by the scanner unit, the pixel circuit 2 carries out a compensatory process on the pixel capacitor Cs as a process to eliminate the effect of the dependence of the output current Ids generated by the drive transistor Trd on the threshold voltage Vth of the drive transistor Trd as well as an operation to sample the video signal Sig and store the sampled signal electric potential Vsig in the pixel capacitor Cs already subjected to the compensatory operation. In addition, the scanner unit also utilizes horizontal scanning periods each assigned to a row preceding a current row including a pixel circuit being observed to distribute the compensation process carried out on the pixel capacitor Cs of the observed pixel circuit among time slots each included in one of the utilized horizontal scanning periods. To put it concretely, the scanner unit has the write scanner 4 and the drive scanner 5 for outputting the first control signal WS and the second control signal DS respectively during a horizontal scanning period in order to execute control to turn on and off the sampling transistor Tr1 and the switching transistor Tr4. The pixel circuit 2 carries out the compensatory process on the pixel capacitor Cs as operations to eliminate the effect of the dependence of the output current Ids generated by the drive transistor Trd on the threshold voltage Vth of the drive transistor Trd. The compensatory process includes a compensation preparatory operation to reset the pixel capacitor Cs and an actual compensatory operation to store a voltage for canceling the effect of the threshold voltage Vth in the reset pixel capacitor Cs. After the compensatory operations, a sampling operation is carried out to sample the video signal Sig and store the sampled signal electric potential vsig in the pixel capacitor Cs already subjected to the compensatory operations. As described above, the scanner unit also utilizes horizontal scanning periods each assigned to a row preceding a current row including a pixel circuit being observed to distribute the compensation preparatory operation and the actual compensatory operation, which are carried out on the pixel capacitor Cs of the observed pixel circuit, among time slots each included in one of the utilized horizontal scanning periods.

In order to enhance the fineness of the panel, it is necessary to reduce the number of components. As described above, the threshold-voltage compensatory operation is carried out by using minus coupling and, in addition, its preparation period is spilt into a plurality of sub-periods in each of which the operation is driven into execution. However, in the case of a light emitting device having a large capacitance, the discharge time of a coupling voltage appearing as an electric potential at the source S of the drive transistor Trd inevitably becomes longer. Thus, in order to have a desired voltage between the source S and gate G of the drive transistor Trd, a number of minus-coupling operations are unavoidably needed. For this reason, there is raised a problem caused by the complexity of the panel operation.

Figure 15:
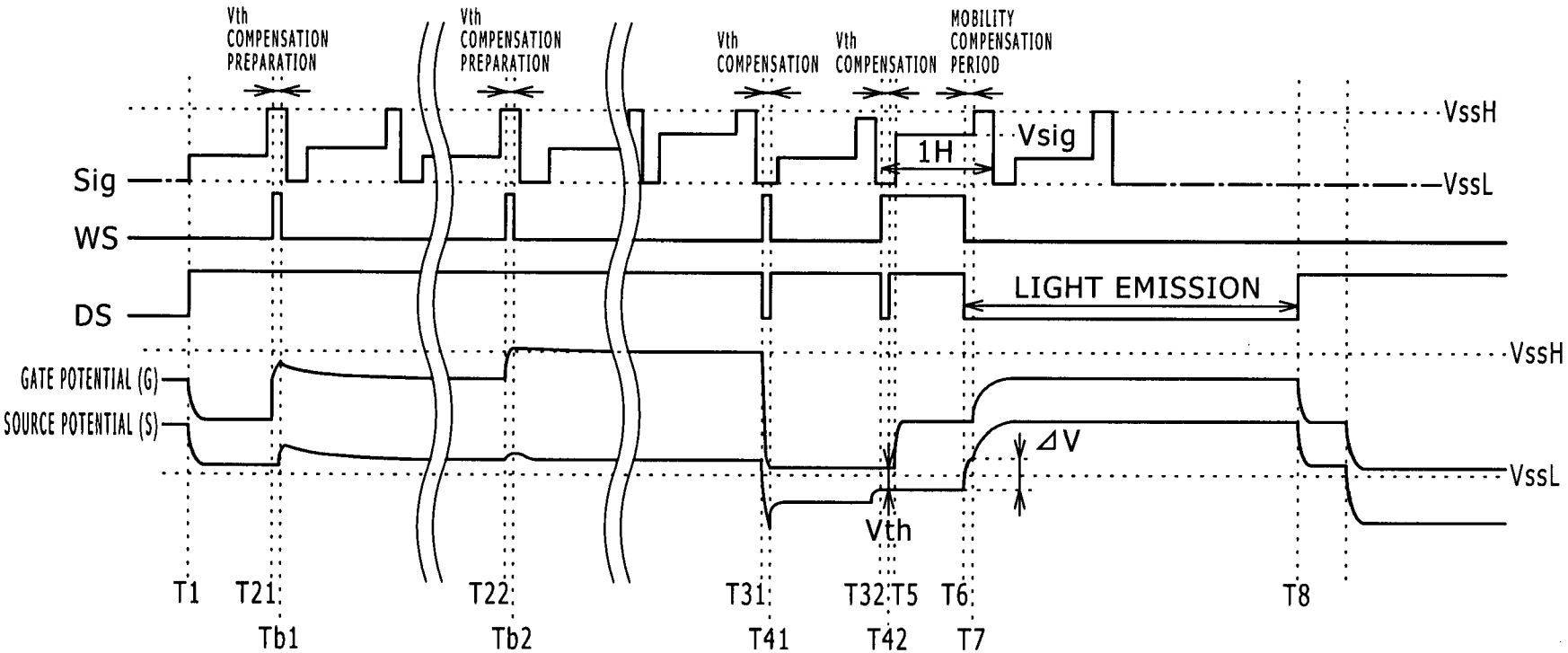
FIG. 15 shows timing charts to be referred to in explanation of operations carried out by an image display apparatus according to another preferred embodiment of the present invention.

Another typical advanced developed reference implementation is provided by the present invention to solve the problem described above. FIG. 15 shows timing charts of another preferred embodiment of the present invention. In order to make the figure easy to understand, every part identical with its counterpart component shown in FIG. 14 is denoted by the same reference notation or the same reference numeral as the counterpart component. In this embodiment, capacitance coupling is used to carry out the threshold-voltage compensation preparatory operation. The coupling operation is carried out a plurality of times by being distributed in a plurality of time slots. The width of a pulse corresponding to the time slot is long enough for the light emitting device to discharge its electric potential. Thus, the number of minus-coupling operations per row (per row) can be reduced. To put it concretely, during a period from the timing T21 to a timing Tb1, the data signal line SL is set at the high-level first fixed electric potential VssH needed for the preparation of the threshold-voltage compensatory operation and the sampling transistor Tr1 is put in an on state. Thus, during the period from the timing T21 to the timing Tb1, the high-level first fixed electric potential VssH is applied to the gate G of the drive transistor Trd. At that time, due to the effect of coupling provided by the pixel capacitor Cs, the electric potential appearing at the source S of the drive transistor Trd rises. However, the electric potential appearing at the source S of the drive transistor Trd rises only temporarily before the electric potential is discharged to the ground by way of the light emitting device EL. Thus, eventually, the electric potential appearing at the source S of the drive transistor Trd settles at the cutoff voltage (or the threshold voltage) VthEL of the light emitting device EL. Then, after the lapse of a wait time such as 5H since the light emitting device EL is cut off, during a period from the timing T22 to a timing Tb2, the data signal line SL is set at the high-level first fixed electric potential VssH and the sampling transistor Tr1 is put in an on state to carry out a second compensation preparatory operation. By carrying out the second compensation preparatory operation, the electric potential appearing at the gate G of the drive transistor Trd reaches the high-level first fixed electric potential VssH, requiring no more increasing changes in voltage. That is to say, the needed voltage between the gate G and source S of the drive transistor Trd can be obtained.

In the driving operations shown in the time charts of FIG. 14 as the driving operations of the typical advanced developed reference implementation including pixel circuits each having a light emitting device with a large capacitance, it takes very long time to decrease a coupling voltage till the light emitting device EL is cut off. The coupling voltage is introduced when the voltage appearing at the gate G of the drive transistor Trd is raised to the high-level first fixed electric potential VssH. For this reason, after the sampling transistor Tr1 is put in an off state, the electric potential appearing at the gate G also decreases as the electric potential appearing at the source S of the drive transistor Trd does. Thus, even if the sampling transistor Tr1 is put in an on state a plurality of times thereafter, the electric potential appearing at the gate G inevitably keeps decreasing till the source S is cut off by the light emitting device EL. As a result, in order for the electric potential appearing at the gate G to attain the needed voltage between the gate G and source S of the drive transistor Trd, a number of driving control pulses of the first scanning line WS are needed.

In order to solve the problem described above, in the other embodiment of the present invention, the interval between two consecutive driving control pulses applied to the gate G of the sampling transistor Tr1 from the first scanning line WS in order carry out threshold-voltage compensation preparatory operations as shown in FIG. 15 is set at such a value that the light emitting device EL is fully cut off at the end of the interval. Then, by carrying out the threshold-voltage compensation preparatory operation repeatedly a plurality of times, the electric potential appearing at the gate G reaches the high-level first fixed electric potential VssH, requiring no more increasing changes in voltage. That is to say, by carrying out the threshold-voltage compensation preparatory operation repeatedly a plurality of times, the needed voltage between the gate G and source S of the drive transistor Trd can be obtained. Therefor, sufficient interval between the consecutive pulses triggering the threshold-voltage compensation preparatory operations reduces the number of the pulses than that of the typical advanced developed reference implementation.

As described above, in the case of the other embodiment of the present invention, threshold-voltage compensation preparatory and threshold-voltage compensatory operations are carried out in a horizontal scanning period (1H) by changing the voltage appearing at the gate G of the drive transistor Trd from the high level to the low level and, in the same horizontal scanning period (1H), an operation to sample a video signal and store the sampled video signal in the pixel capacitor Cs is carried out. By carrying out these operations, the three power supplies needed in the conventional image display apparatus can be integrated into a single signal unit having only a shared signal line, which also execute the functions of all the power-supply lines of the integrated power supplies. In addition, the number of power-supply lines, the number of gate lines and the number of switching transistors can be reduced, allowing the pixel circuit to be configured to include only three transistors and one pixel capacitor. Thus, the yield of the panel can be increased. On top of that, since the layout can be simplified, the fineness of the image display apparatus can be enhanced. In the case of this embodiment, with the sampling transistor Tr1 put in an on state, the switching transistor Tr4 is also put in an on state in order to carry out a mobility compensatory operation. It is to be noted, however, that even in a simple threshold-voltage compensatory operation without overlapping the operations of the sampling transistor Tr1 and the switching transistor Tr4 on each other and, thus, without carrying out a mobility compensatory operation, the wiring can also be provided in the same way and the number of transistors can also be reduced as well.

Figure 8:
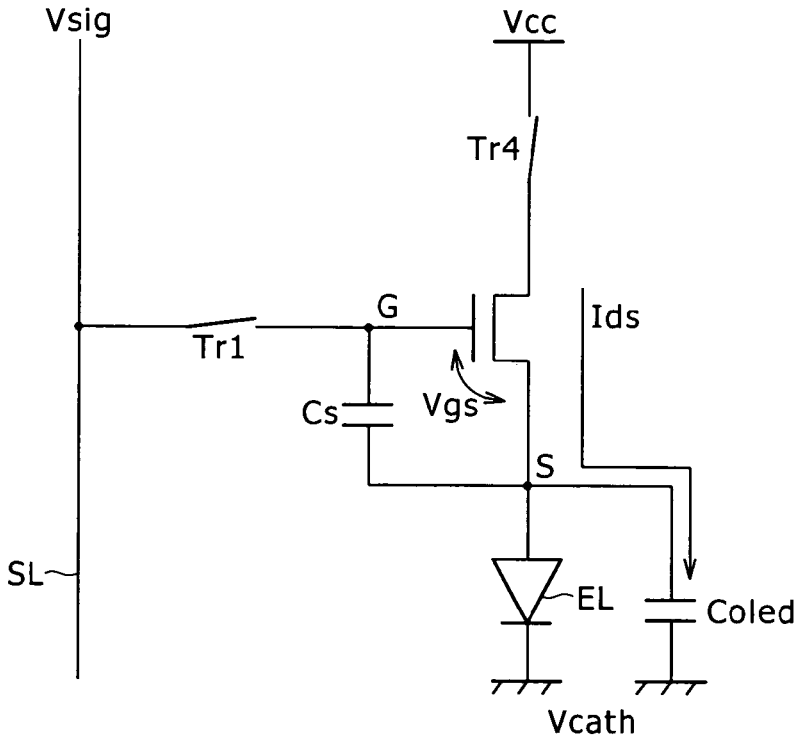
FIG. 8 is a diagram showing the state of the pixel circuit carrying out a compensatory operation.

FIG. 8 is a diagram showing the state of the pixel circuit 2 carrying out a mobility compensatory operation during a period from the timing T6 to the timing T7. As shown in the figure, in the mobility compensation period from the timing T6 to timing T7, the sampling transistor Tr1 and the switching transistor Tr4 are both in an on state, but the drive transistor Trd is in an off state. In these states, the electric potential appearing at the source S of the drive transistor Trd is equal to a difference of (VssL−Vth). The electric potential appearing at the source S of the drive transistor Trd is also the electric potential appearing at the anode of the light emitting device EL. As described before, by setting the difference of (VssL−Vth) at a value smaller than the threshold value VthEL of the light emitting device EL, that is, (VssL−Vth)<VthEL, the light emitting device EL is inversely biased. Inversely biased, the light emitting device EL exhibits the capacitance characteristic of a simple capacitor Coled instead of displaying the characteristic of a diode. Thus, the output current Ids flowing through the drive transistor Trd is accumulated in a in a combined capacitor having a capacitance C (=Cs+Coled) where notation Cs denotes the capacitance of the pixel capacitor Cs whereas notation Coled denotes the capacitance of the capacitor Coled of the light emitting device EL. In other words, a portion of the drain current Ids is fed back to the pixel capacitor CS in a negative feedback process in the so-called mobility compensatory operation.

Figure 9:
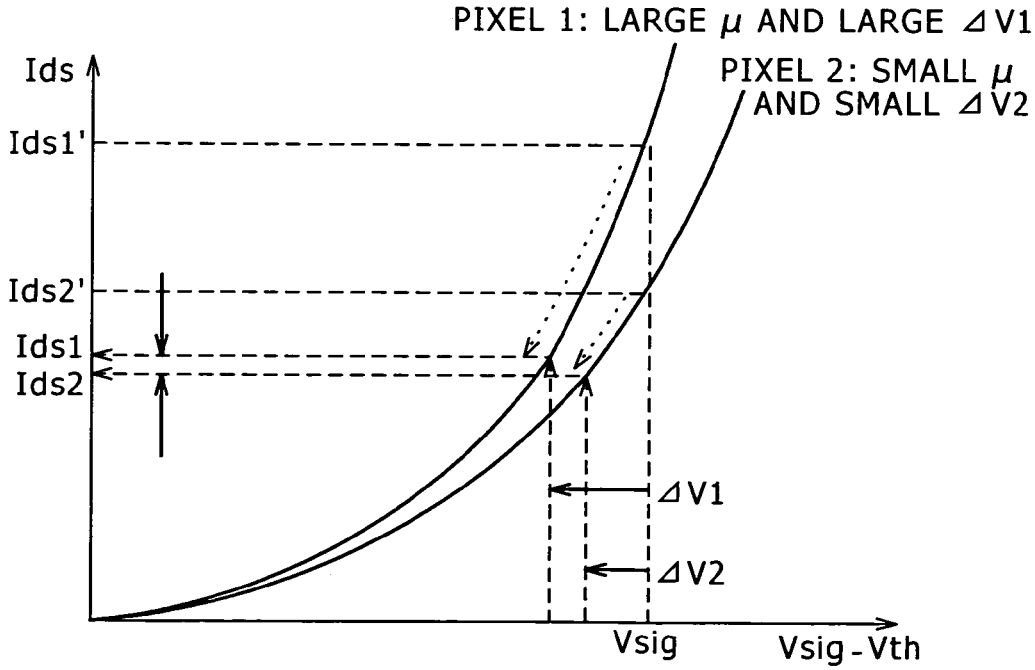
FIG. 9 is a diagram showing a graph representing the characteristics of each drive transistor employed in the pixel circuit.

FIG. 9 is a diagram showing graphs each representing Eq. 2 expressing the characteristic of the drive transistor Trd as described earlier. The vertical axis represents the output current Ids and the horizontal axis represents the video signal Vsig. At the bottom of the figure, Eq. 2 is also written as well. The graphs shown in FIG. 9 represent the characteristics of pixels 1 and 2 respectively for the purpose of comparison. Pixel 1 includes a drive transistor Trd having a relatively large mobility μ. On the other hand, pixel 2 includes a drive transistor Trd having a relatively small mobility μ. In the case of a drive transistor Trd implemented as a thin-film transistor or the like, the mobility μ unavoidably varies from transistor to transistor. Even if a video signal Vsig of the same level is applied to the gates of pixels 1 and 2, for example, the output current Ids1' flowing through pixel 1 including a drive transistor Trd having a relatively large mobility μ will be much different in magnitude from the output current Ids2' flowing through pixel 2 including a drive transistor Trd having a relatively small mobility μ unless some compensation is carried out on the transistors Trd for an effect of the difference in mobility μ. Since the output current Ids varies from transistor to transistor due to the fact that the mobility μ unavoidably varies from transistor to transistor as described above, uniformity of the display screen is lost.

In the present invention, the output current Ids is fed back to the input-voltage side in a negative feedback operation in order to cancel an effect of the variations in mobility. As is obvious from the equation expressing the characteristic of the drive transistor Trd, the larger the mobility, the larger the output current Ids. Thus, the larger the mobility, the larger the negative feedback quantity ΔV. As shown in the graphs of FIG. 9, the negative feedback quantity ΔV1 of pixel 1 including a drive transistor Trd having a relatively large mobility μ is greater than the negative feedback quantity ΔV2 of pixel 2 including a drive transistor Trd having a relatively small mobility μ. Thus, since the larger the mobility μ, the larger the negative feedback quantity ΔV, the effect of the variations in mobility can be suppressed. As shown in the figure, a compensatory operation of applying the negative feedback quantity ΔV1 to pixel 1 including a drive transistor Trd having a relatively large mobility μ results in an output current Ids1 much smaller than the output current Ids1'. On the other hand, a compensatory operation of applying the negative feedback quantity ΔV2 to pixel 2 including a drive transistor Trd having a relatively large mobility μ results in an output current Ids2 not much smaller than the output current Ids2'. This is because, the negative feedback quantity ΔV2 is smaller than the negative feedback quantity ΔV1. As a result, the output current Ids1 generated by pixel 1 including a drive transistor Trd having a relatively large mobility μ is about equal to the output current Ids2 generated by pixel 2 including a drive transistor Trd having a relatively small mobility μ, meaning that the effect of mobility is nullified. The cancellation of the effect of mobility is carried out through out the entire range of the video signal Vsig, from the black level to the white level. Thus, the uniformity of the display screen is extremely high. To put it all together, in the case of pixels 1 and 2 having different mobility values, the negative feedback quantity ΔV1 is set at a value greater than the negative feedback quantity ΔV2. That is to say, the larger the mobility, the larger the decrease in output current Ids. As a result, different pixel currents caused by differences in mobility are changed to an all but uniform current, allowing the effect of the variations in mobility to be eliminated.

Figure 10:
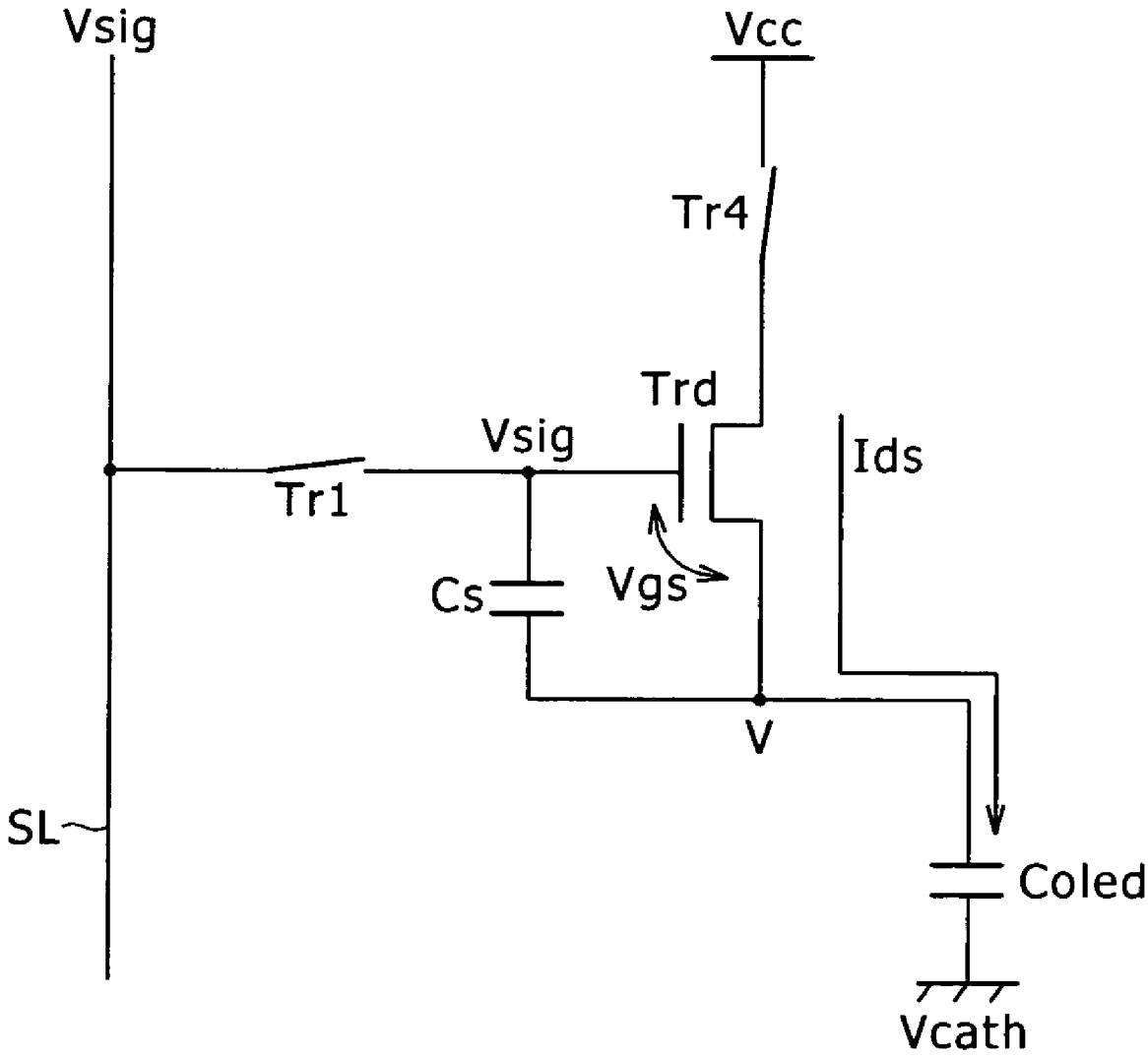
FIG. 10 is a diagram showing the state of the pixel circuit carrying out an operation.

Next, by referring to FIG. 10, a numerical analysis of the mobility compensation described above is carried out. In the following numerical analysis, notation V denotes a variable representing the electric potential appearing at the source S of the drive transistor Trd with both the sampling transistor Tr1 and the switching transistor Tr4 put in an on state as shown in FIG. 10. The drain current Ids flowing through the drive transistor Trd is expressed by Eq. 3 as follows:

$$Ids=k\mu(Vgs-Vth)^2=k\mu(Vsig-V-Vth)^2 \qquad \text{Eq. 3}$$

where notation V denotes the electric potential appearing at the source S of the drive transistor Trd.

As shown in Eq. 4, the equation Ids=dQ/dt=CdV/dt representing a relation between the drain current Ids and a capacitance C (=Cs+Coled) holds true where notation Cs denotes the capacitance of the pixel capacitor Cs and notation Coled denotes the capacitance of the light emitting device EL.

$$\begin{aligned}
&\int \frac{1}{C}dt = \int \frac{1}{Ids}dV \qquad \text{Eq. 4}\\
&\Leftrightarrow \int_0^t \frac{1}{C}dt = \int_{-Vth}^{V} \frac{1}{k\mu(Vsig-Vth-V)^2}dV\\
&\Leftrightarrow \frac{k\mu}{C}t = \left[\frac{1}{Vsig-Vth-V}\right]_{-Vth}^{V} = \frac{1}{Vsig-Vth-V} - \frac{1}{Vsig}\\
&\Leftrightarrow Vsig-Vth-V = \frac{1}{\frac{1}{Vsig}+\frac{k\mu}{C}t} = \frac{Vsig}{1+Vsig\frac{k\mu}{C}t}
\end{aligned}$$

Eq. 3 is substituted into Eq. 4 and both sides of the resulting equation are integrated with respect to time. In the integration process, the source voltage V at the initial state is −Vth and the mobility compensation period from the timing T6 to the timing T7 is t. By solving this differential equation, the pixel current for the mobility compensation period t is given by Eq. 5 as follows:

$$Ids = k\mu\left(\frac{Vsig}{1 + Vsig\frac{k\mu}{C}t}\right)^2 \quad \text{Eq. 5}$$

Figure 11:
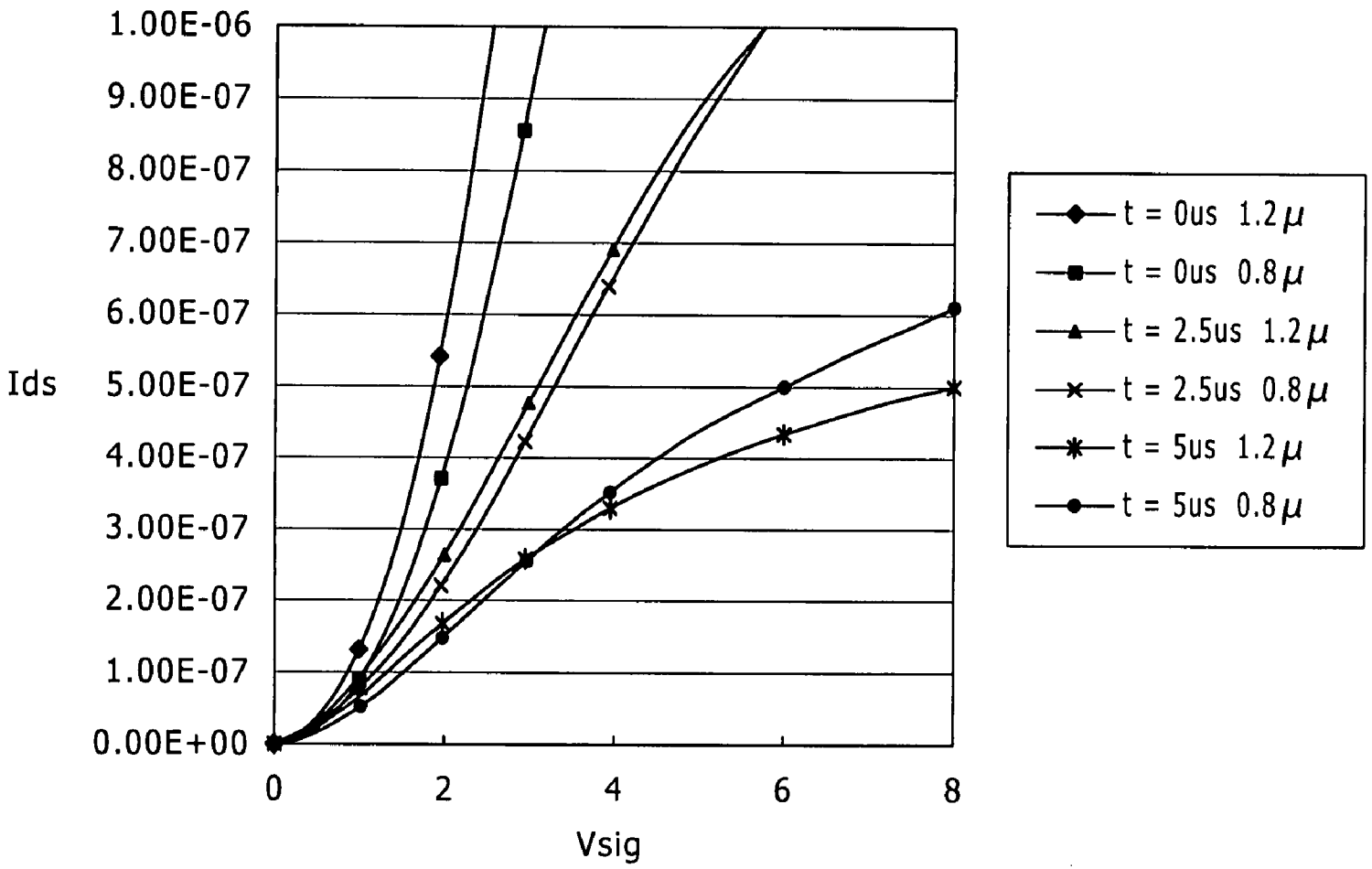
FIG. 11 is a diagram showing a graph representing a characteristic of the pixel circuit.

FIG. 11 is a diagram showing graphs each representing Eq. 5. The vertical axis represents the output current Ids and the horizontal axis represents the video signal Vsig. As parameter values, t=0 us, t=2.5 us and t=5 us are taken. The mobility μ is also taken as a parameter. For this parameter, a relatively large mobility μ of 1.2 and a relatively small mobility μ of 0.8 are taken. The parameter t=0 us represents a case of essentially no mobility compensatory operation. In comparison with t=0 us, it is obvious that the parameter t=2.5 us represents a case in which an effect of the variations in drain current Ids due to variations in mobility is corrected sufficiently. To be more specific, the parameter t=0 us represents a case in which drain-current variations of 40% exist because no mobility compensatory operation is carried out. On the other hand, the parameter t=2.5 us represents a case in which an effect of the variations in drain current Ids is suppressed by a mobility compensatory operation to a value not exceeding 10%. However, the parameter t=5 us representing a long mobility compensation period adversely indicates that variations in drain current Ids due to variations in mobility increase unavoidably. Thus, it is necessary to set the mobility compensation period t at a proper value in order to carry out a mobility compensatory operation. In the case of the graphs shown in FIG. 11, the proper value for the mobility compensation period t is approximately 2.5 us.

As described above, in the present invention, the threshold-voltage compensation preparatory operation and the actual threshold-voltage compensation preparatory operation are carried out by changing the voltage applied to the gate G of the drive transistor Trd from a high level to a low level within the horizontal scanning period (1H). Then, in the same horizontal scanning period, a sampling operation is carried out to store a video signal in the pixel capacitor Cs. By carrying out these operations, the three power supplies needed in the conventional image display apparatus can be integrated into a single signal unit having only a shared signal line, which has the functions of all the power-supply lines of the original power supplies. In addition, the number of power-supply lines, gate lines and switching transistors can be reduced, allowing the pixel circuit to be configured to include only three transistors and one pixel capacitor. Thus, the yield of the panel can be increased. On top of that, since the layout can be simplified, the fineness of the image display apparatus can be enhanced. In the case of this embodiment, with the sampling transistor Tr1 put in an on state, the switching transistor Tr4 is also put in an on state in order to carry out a mobility compensatory operation. It is to be noted, however, that even in a simple threshold-voltage compensatory operation without overlapping the operations of the sampling transistor Tr1 and the switching transistor Tr4 on each other and, thus, without carrying out a mobility compensatory operation, the wiring can also be provided in the same way and the number of transistors can also be reduced as well. Furthermore, in the pixel circuit according to the embodiment, the sampling transistor Tr1 and the drive transistor Trd are each an N-channel transistor. Only the switching transistor Tr4 is a P-channel transistor. However, any of the sampling transistor Tr1, the drive transistor Trd and the switching transistor Tr4 can be an N-channel or P-channel transistor.

The following description explains an embodiment implementing a data driver composing the horizontal selector functioning as the signal unit employed in the image display apparatus provided by the present invention. The data driver according to the embodiment is capable of switching the data signal line from a signal electric potential representing image data to a fixed electric potential for controlling the pixel circuit and vice versa. In addition, if the fixed electric potential for controlling the pixel circuit is needed to have a voltage amplitude greater than a maximum rating voltage of an ordinary data driver, only a switch functioning portion is made capable of withstanding a high voltage. In this way, in a process to manufacture the data driver, necessary functions of the data driver can be implemented without the need to change the process such as changing the process to a process capable of withstanding a high voltage, the need to change the size of the circuit and increasing the pitch between pins of the driver IC. The switch functioning portion is a portion located in close proximity to an output terminal as a portion for switching the data signal line from the signal electric potential representing image data to the fixed electric potential for controlling the pixel circuit and vice versa.

Figure 12A:
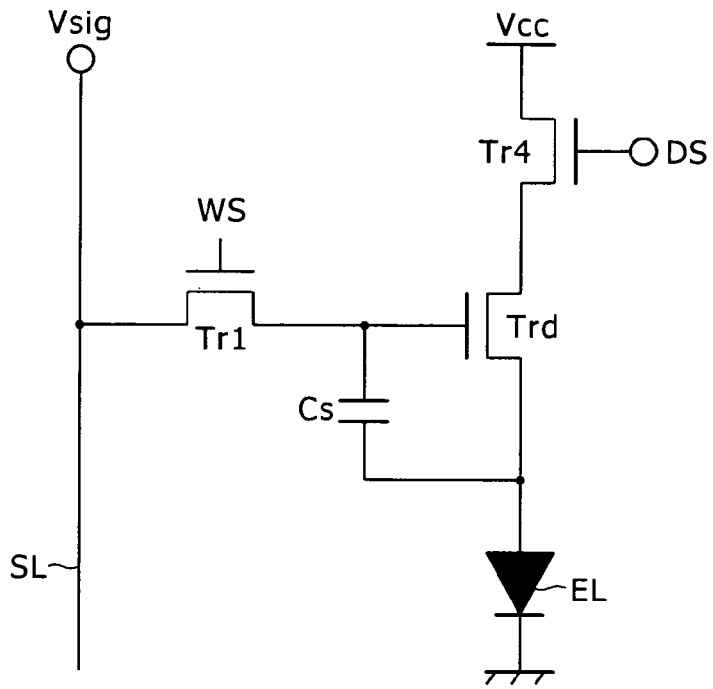
FIG. 12A is a diagram showing the pixel circuit employed in the image display apparatus provided by the present invention.
Figure 12B:
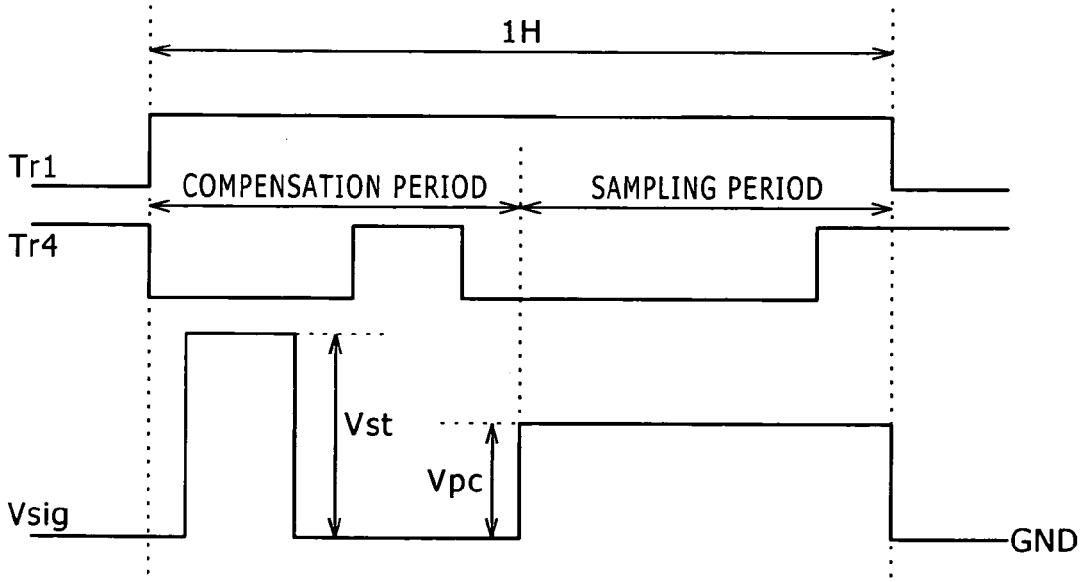
FIG. 12B shows timing charts to be referred to in explanation of operations carried out by a data driver provided by the present invention.

FIG. 12A is a diagram showing the pixel circuit employed in the image display apparatus capable of switching the data signal line from the signal electric potential representing image data to the fixed electric potential for controlling the pixel circuit and vice versa. FIG. 12B shows timing charts of the waveforms of signals driving the pixel circuit. The pixel circuit shown in FIG. 12A has three transistors Tr1, Tr4 and Trd, one pixel capacitor Cs and one light-emitting device EL. This pixel circuit is a general form of the pixel circuit 2 shown in FIG. 5 as a pixel circuit according to an embodiment of the present invention. A video signal Vsig is supplied by the data signal line SL. Depending on the voltage of the video signal Vsig, the drive transistor Trd is put in an on state, driving the light emitting device EL to emit a light beam at desired brightness. In this image display apparatus, variations in characteristics among drive transistors Trd have a direct effect on the quality of the display screen. In order to solve this problem, a compensatory operation is carried out in a compensation period by using the pixel capacitor Cs to eliminate the effect of the variations in characteristics among drive transistors Trd. In the compensatory operation, the waveform of a pulse first control signal WS is applied to the gate of the sampling transistor Tr1 in order to supply a fixed electric potential Vst conveyed by the data signal line SL as a control signal of the pixel circuit to the sampling transistor Tr1, and the waveform of a pulse second control signal DS is applied to the gate of the switching transistor Tr4 in order to supply a power-supply voltage to the dive transistor Trd through the switching transistor Tr4. In an ordinary image display apparatus, a line connected to a driving/control system as a line for conveying the fixed electric potential Vst is separated from a line connected to an image data system as a line for conveying the video signal Vsig. That is to say, in an ordinary image display apparatus, by applying the pulse first control signal WS to the gate of the sampling transistor Tr1, the electric potential Vst is supplied to the gate of the drive transistor Trd through the sampling transistor Tr1 and a line connected to the driving/control system as a line separated from a line connected to an image-data display system as a line for conveying the video signal Vsig. By adopting this configuration of the ordinary image display apparatus, however, the number of elements composing the pixel circuit increases so that the yield becomes poor due to defects of pixel circuits. In addition, since every pixel circuit occupies a larger area, the pixel circuit conceivably has a bad effect such as deterioration of the physical resolution on the ordinary image display apparatus. In order to solve these problems, it is necessary to substantially reduce the number of components composing the pixel circuit and compensate the pixel circuit for an effect of the variations in characteristics among drive transistors Trd. It is also necessary to separate a compensation period for supplying the fixed electric potential Vst to the gate of the drive transistor through the data signal line SL and the sampling transistor Tr1 as a control signal of the pixel circuit from a sampling period for supplying a signal electric potential Vpc shown in FIG. 12B to the gate of the drive transistor through the data signal line SL and the sampling transistor Tr1 as a signal representing image data.

At that time, the fixed electric potential Vst serving as a control signal of the pixel circuit is not necessarily set at about the same level as the signal electric potential Vpc representing image data. As a matter of fact, there is a conceivable case in which the fixed electric potential Vst serving as a control signal of the pixel circuit is higher than the signal electric potential Vpc representing image data as shown in the timing charts of FIG. 12B. In addition, in some cases, the fixed electric potential Vst serving as a control signal of the pixel circuit may be higher than the rating voltage of the data driver IC serving as the signal unit for outputting the fixed electric potential Vst and the signal electric potential Vpc. In addition, the signal output by an ordinary driver during a no-display period is an indefinite voltage or a high-impedance output voltage. In the case of the pixel circuit according to this embodiment, however, the compensation period for supplying the fixed electric potential Vst to the gate of the drive transistor through the sampling transistor Tr1 as a control signal of the pixel circuit is separated from a sampling period for supplying a signal electric potential Vpc to the gate of the drive transistor through the sampling transistor Tr1 as a signal representing image data and, in some cases, the video signal Vsig output by the signal unit needs to be fixed at the ground level GND.

Figure 13:
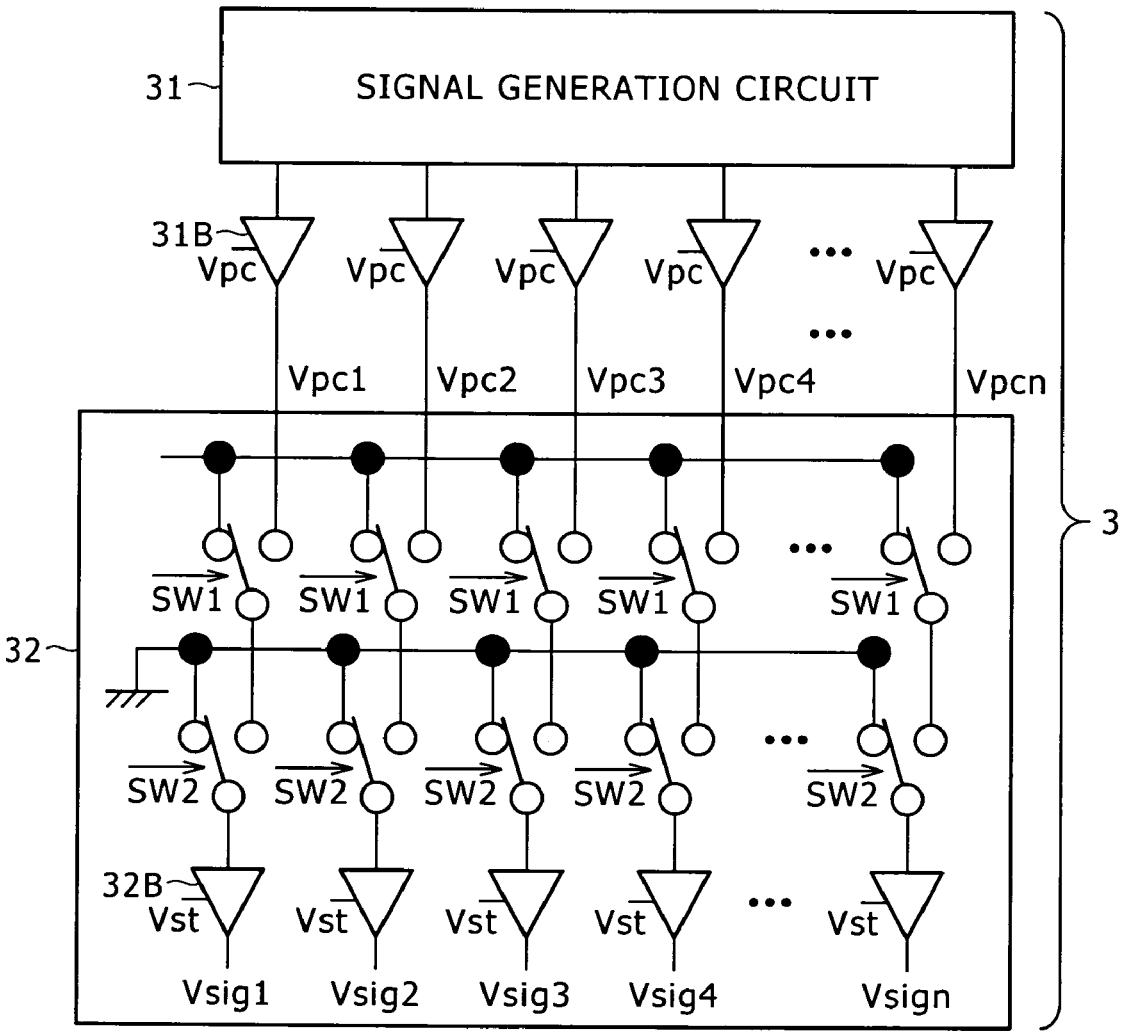
FIG. 13 is a block diagram showing the configuration of the data driver.

FIG. 13 is a block diagram showing the configuration a data driver IC 3 satisfying the conditions described above as conditions of the waveform of the control signal supplied to the pixel circuit. A large rectangular block enclosed by a solid line is an output circuit 32 included in the data driver IC 3. Only the output circuit 32 is made capable of withstanding a high voltage by, for example, increasing the thickness or a wiring film of a circuit inside the data driver IC 3. By making the output circuit 32 capable of withstanding a high voltage, a signal generation circuit 31 included in the data driver IC 3 can be manufactured in an ordinary high-voltage withstanding process as usual. The output circuit 32 includes switches SW1 and SW2 for switching voltages. Since control signals used for driving the switches SW1 and SW2 are logic signals to turn on and off the switches SW1 and SW2, however, a logic circuit for generating the logic signals does not have to be a circuit capable of withstanding a high voltage.

Output terminals 31B of the signal generation circuit 31 output respectively voltages Vpc1 to Vpcn not exceeding a maximum power-supply voltage Vpc of the image-data display system. The output voltage Vpci (where i=1 to n) is supplied to the switch SW1 for selecting either the output voltage Vpci or the fixed voltage for controlling the pixel circuit. The fixed voltage for controlling the pixel circuit is a train of logic pulses having a height equal to the voltage Vst of the power supply of the driving/control system. A signal selected by the switch SW1 is supplied to the switch SW2 for selecting either the signal selected by the switch SW1 or the voltage GND of the ground. This is because, during an operation carried out by the switch SW1 to select either the output voltage vpci or the fixed voltage Vst for controlling the pixel circuit, an output terminal 32B connected to the switch SW2 is needed to output a voltage at the ground level GND. As a result, the output terminal 32B outputs either the output voltage Vpci not exceeding a maximum power-supply voltage Vpc of the image-data display system, the fixed voltage Vst having a magnitude equal to the voltage of the power supply of the driving/control system or the voltage at the ground level GND.

Other embodiments of the present invention are explained in detail by referring to diagrams as follows. First of all, in order to clarify the background of the present invention, a general configuration of an image display apparatus of an active-matrix type is explained by referring to FIG. 16. As shown in the figure, the image display apparatus includes a pixel-array unit 1, a horizontal selector 3 and a write scanner 4. The pixel-array unit 1 is created on a panel as an integrated body. The horizontal selector 3 and the write scanner 4 can be embedded internally in the panel or externally attached to the panel. Each of pixel circuits forming a pixel matrix in the pixel-array unit 1 is provided at an intersection of a scanning line WS oriented in the row direction of the matrix as a line for supplying a control signal and a data signal line SL oriented in the column direction of the matrix as a line for supplying a video signal. The scanning line WS is connected to the write scanner 4 for sequentially outputting control signals to scanning lines WS connected to the write scanner 4 in a process to select pixel circuits 2 in row units. On the other hand, the data signal line SL is connected to the horizontal selector 3 for supplying video signals to the selected pixel circuits 2.

Figure 16:
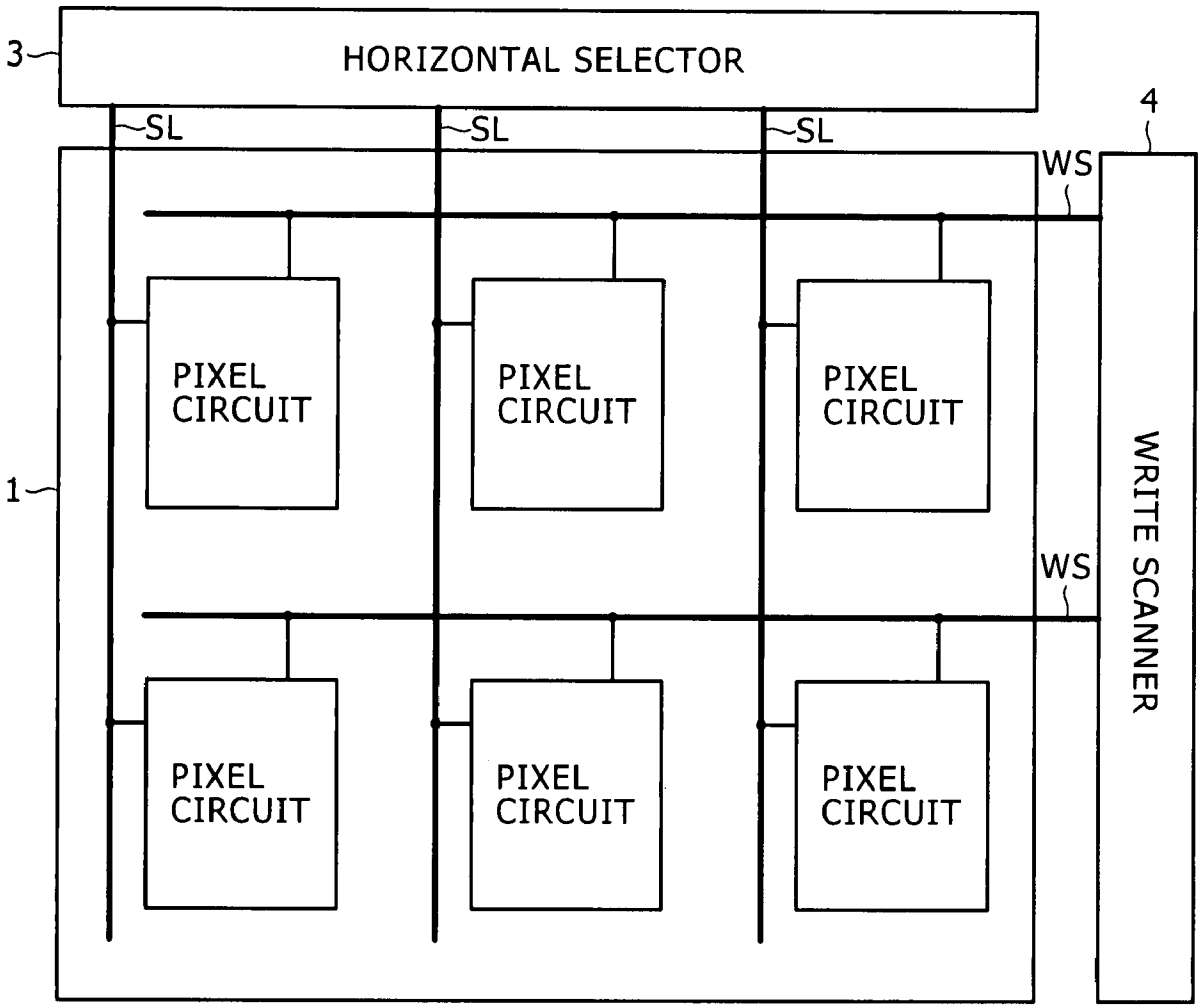
FIG. 16 is a block diagram showing a general configuration of an image display apparatus.
Figure 17:
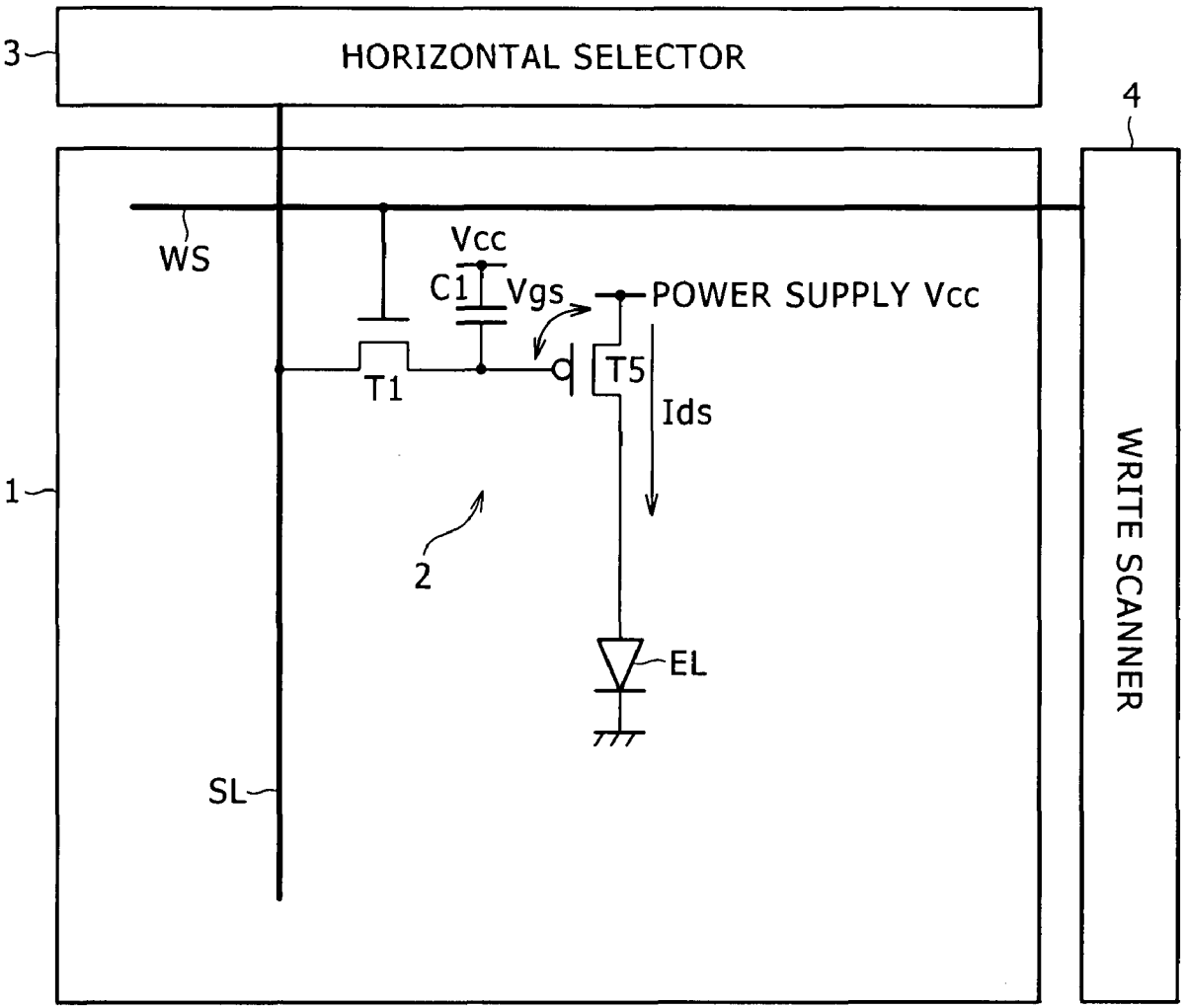
FIG. 17 is a diagram showing a typical pixel circuit employed the image display apparatus shown in FIG. 16.

FIG. 17 is a diagram showing a typical pixel circuit employed in the image display apparatus shown in FIG. 16. The configuration of the pixel circuit 2 shown in the figure is simplest, including two transistors T1 and T5, one pixel capacitor C1 and one light emitting device EL. The sampling transistor T1 is an N-channel TFT (thin-film transistor) but the drive transistor T5 is a P-channel TFT. The pixel capacitor C1 is a thin-film capacitor. The light emitting device EL is a 2-terminal device (or a diode) using typically an organic EL thin film as a light emitting layer. The sampling transistor T1, the drive transistor T5, the pixel capacitor C1 and the light emitting device EL are created as an integrated body on an insulation substrate forming a panel.

The sampling transistor T1 is connected between the data signal line SL and the gate of the drive transistor T5. The gate of the sampling transistor T1 is connected to the write scanner 4 through the scanning line WS. The gate of the drive transistor T5 is connected to the pixel capacitor C1. The source of the drive transistor T5 is connected to a power supply Vcc. The drain of the drive transistor T5 is connected to the anode of the light emitting device EL. The cathode of the light emitting device EL is connected to the ground.

In a horizontal scanning period, a control signal conveyed by the scanning line WS from the write scanner 4 is applied to the sampling transistor T1 in order to put the sampling transistor T1 in an on state. With the sampling transistor T1 put in an on state, the sampling transistor T1 samples a video signal conveyed by the data-signal line SL from the horizontal selector 3 and stores the sampled video signal in the pixel capacitor C1. In accordance with the video signal stored in the pixel capacitor C1, the drive transistor T5 supplies a drain current Ids to the light emitting device EL. Thus, the light emitting device EL emits a light beam with a luminance according to the video signal.

In accordance with the technique adopted by the pixel circuit 2 shown in FIG. 17, an input voltage vgs applied to the gate of the drive transistor T5 changes in accordance with the video signal, controlling the output current Ids flowing to the light emitting device EL through the drive transistor T5. In this embodiment, the source of the P-channel drive transistor T5 is connected to the power supply Vcc in a transistor circuit designed to make the drive transistor T5 always operate in a saturated region. Thus, the drive transistor T5 functions as a constant current source, which operates in accordance with Eq. 1. That is to say, the P-channel drive transistor T5 with its drain connected to the light emitting device EL is capable of supplying a constant output current Ids all the time to the light emitting device EL in accordance with the input voltage Vgs applied between the gate and source of the drive transistor T5 independently of the electric potential appearing at the drain of the drive transistor T5.

Figure 18:
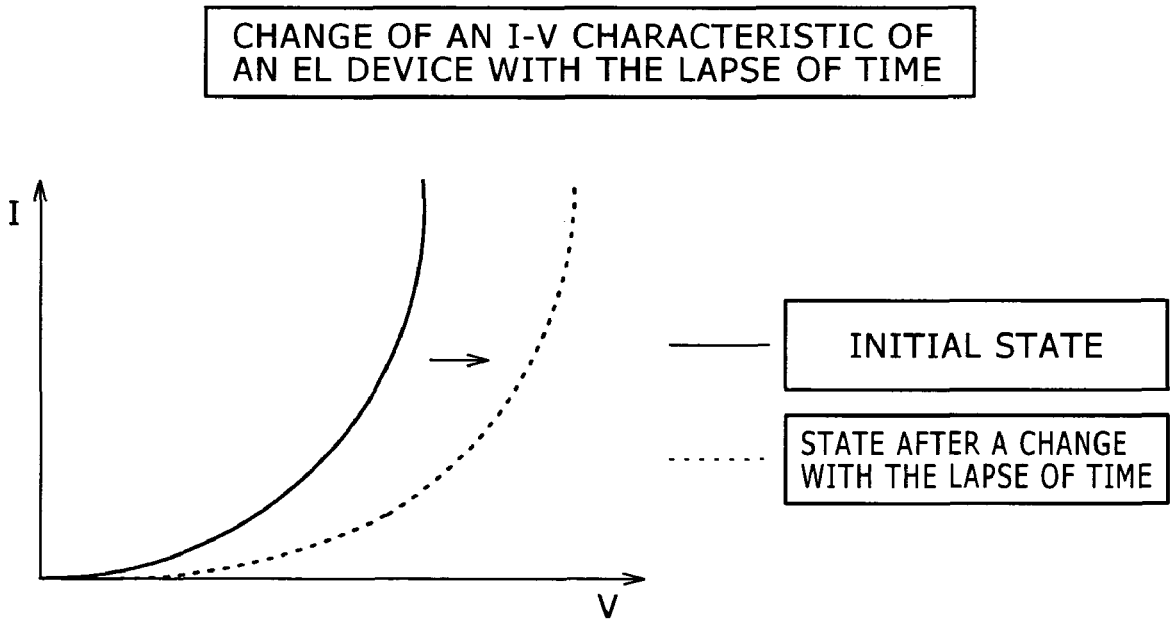
FIG. 18 is a diagram showing I-V characteristics each exhibited by a light emitting device employed in the pixel circuit shown in FIG. 17.

FIG. 18 is a diagram showing I-V characteristics each exhibited by the light emitting device EL as a characteristic representing the relation between the voltage applied to the light emitting device EL and the current flowing through the light emitting device EL due to the application of the voltage. The light emitting device EL represented typically by an organic EL device shows a tendency to have its I-V characteristic change with the lapse of time. The graph drawn as a solid line represents an I-V characteristic in an initial state while that drawn as a dashed line represents an I-V characteristic exhibited by the light emitting device EL after the lapse of time since the initial state. The voltage V represented by the horizontal axis is an anode voltage appearing at the drain of the drive transistor T5 in FIG. 17. The current I represented by the vertical axis is the output current Ids supplied by the drive transistor T5 to the light emitting device EL. As described earlier, the P-channel drive transistor T5 employed in the pixel circuit 2 shown in FIG. 17 is capable of supplying a constant output current Ids all the time to the light emitting device EL independently of the electric potential appearing at the drain of the drive transistor T5. Thus, even if the I-V characteristic of the light emitting device EL changes with the lapse of time, the drive transistor T5 is capable of supplying a constant output current Ids all the time to the light emitting device EL without being affected by the change in EL I-V characteristic with the lapse of time. Therefor, the luminance of the light emitted by the light emitting device EL does not change.

Figure 19:
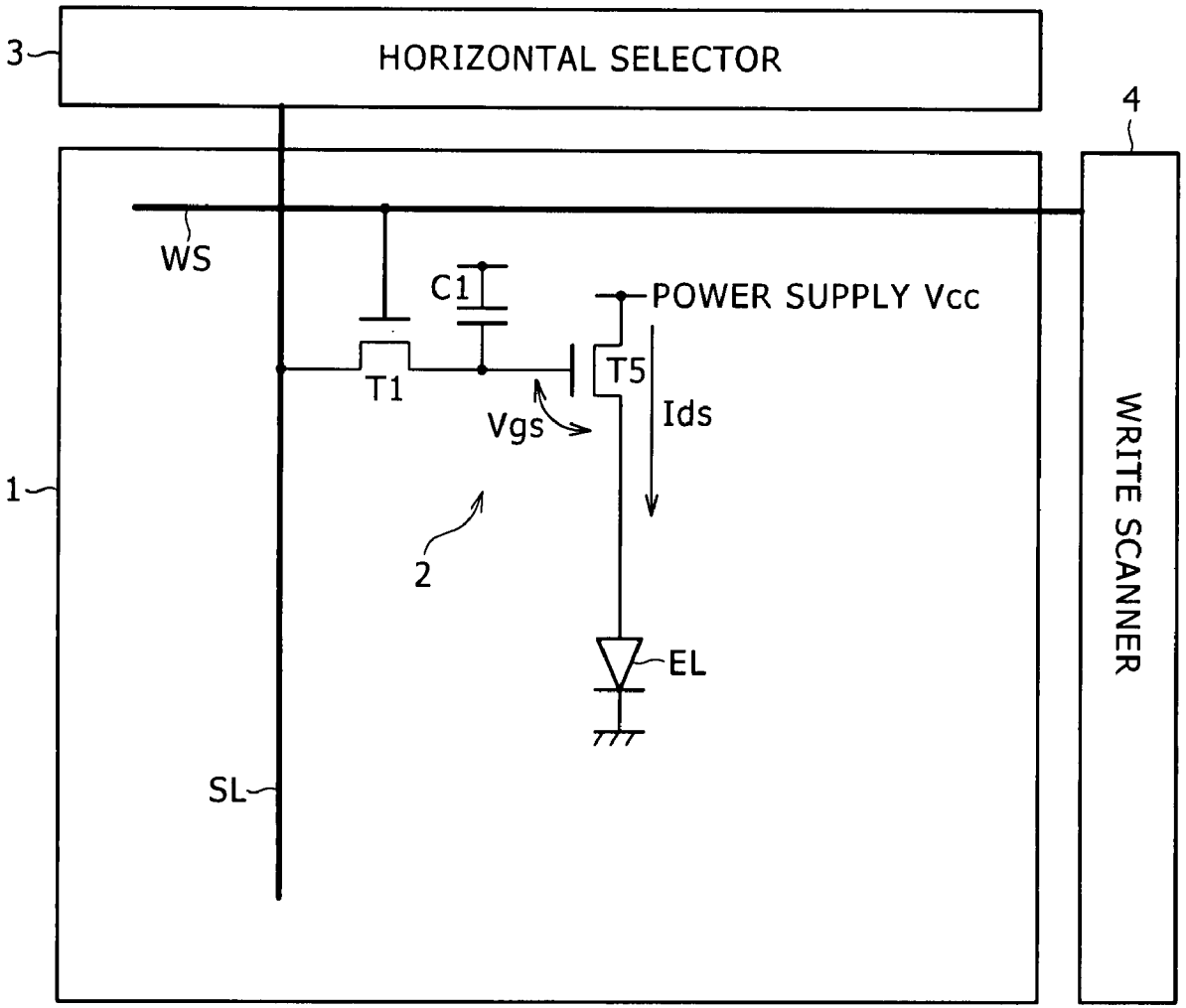
FIG. 19 is a diagram showing a typical configuration of a pixel circuit.

FIG. 19 is a diagram showing a typical configuration of a pixel circuit 2. In order to make the figure easy to understand, each component identical with a counterpart component employed the pixel circuit 2 shown in FIG. 17 is denoted by the same reference numeral or the same reference notation as the counterpart component. The pixel circuit 2 shown in FIG. 19 is different from the pixel circuit 2 shown in FIG. 17 in that, in the case of the pixel circuit 2 shown in FIG. 19, the drive transistor T5 is an N-channel transistor instead of a P-channel one. In the case of the pixel circuit 2 shown in FIG. 19, the source of the drive transistor T5 is connected to the anode of the light emitting device EL. Thus, the electric potential appearing at the source of the drive transistor T5 is affected by a change in EL I-V characteristic with the lapse of time, also varying with the lapse of time as well. That is to say, the input voltage Vgs applied between the gate and source of the drive transistor T5 also inevitably changes with the lapse of time. Thus, the magnitude of the output current Ids supplied to the light emitting device EL also changes with the lapse of time, unavoidably varying the luminance of the light emitted by the light emitting device EL. In addition, the threshold value Vth of the drive transistor T5 employed in the pixel circuit 2 also varies from transistor to transistor. Thus, as is obvious from Eq. 1, since the output current Ids varies from transistor to transistor due variations in Vth from transistor to transistor and variations in Vgs with the lapse of time, the luminance determined by the output current Ids also inevitably varies from pixel to pixel.

Figure 20:
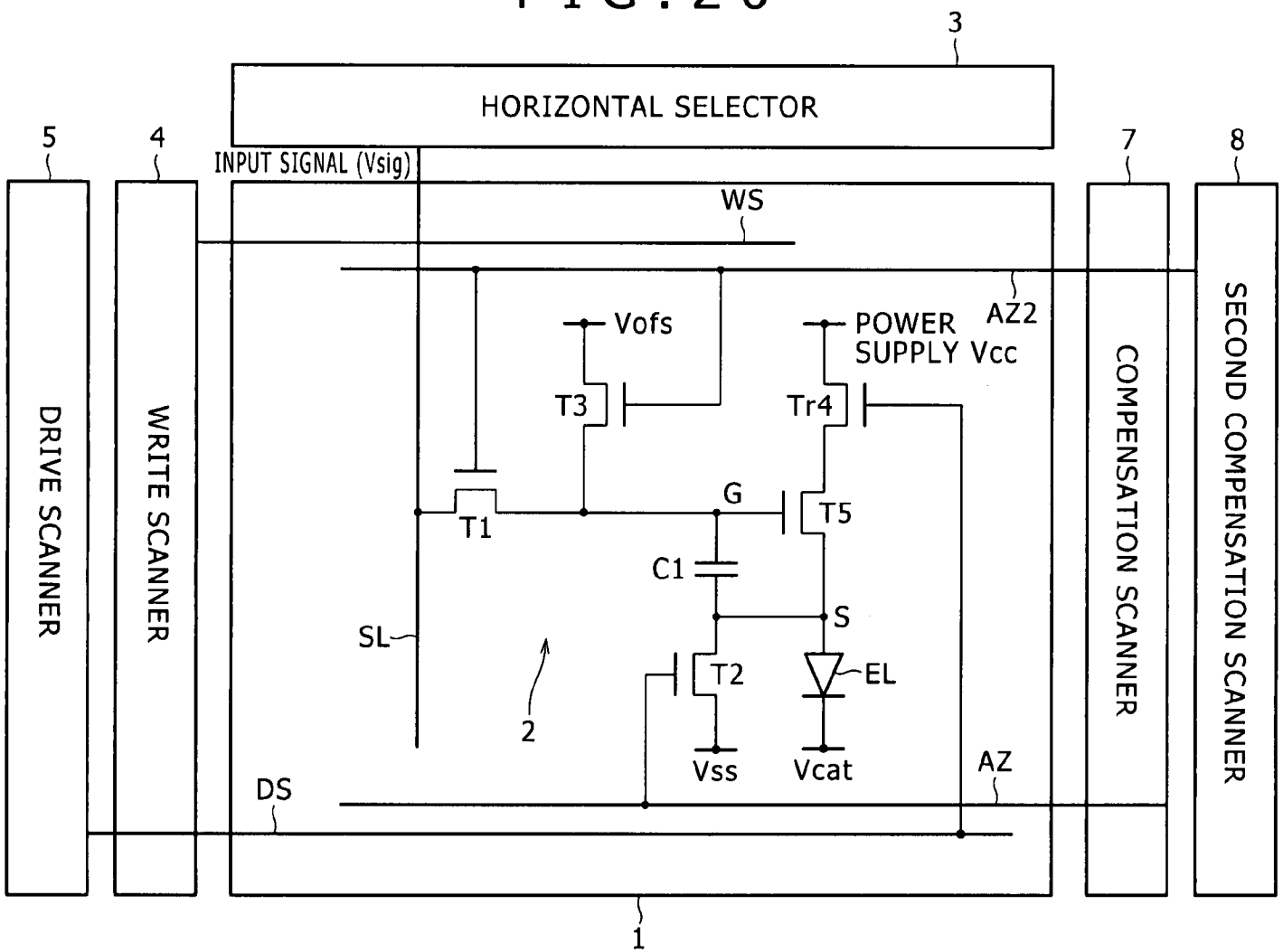
FIG. 20 is a circuit diagram showing an advanced developed reference implementation of an image display apparatus.

Inventors of the present invention have already developed an image display apparatus capable of compensating the luminance of the light beam emitted by the light emitting device EL for effects of deterioration of the light emitting device EL with the lapse of time and the variations in drive-transistor characteristics. A typical advanced developed reference implementation of the image display is shown in FIG. 20. As shown in FIG. 20, the image display apparatus has a pixel-array unit 1, a horizontal selector 3, a write scanner 4, a drive scanner 5, a compensation scanner 7 and a second compensation scanner 8. The pixel-array unit 1 includes pixel circuits 2, which are laid out to form a pixel matrix. In order to make the diagram simple, only one pixel circuit 2 is shown. The pixel circuit 2 includes five transistors T1 to T5, one pixel capacitor C1 and one light emitting device EL in a configuration having a relatively large number of components. In addition, the configuration also has a relatively large number of control lines used for driving the pixel circuit 2. The nine control lines used for driving the pixel circuit 2 include four scanning lines WS, DS, AZ and AZ2, one signal line SL and four power-supply lines connected to four power supplies Vcc, Vss, Vofs and Vcat respectively. Thus, the nine control lines occupy much of an area allocated to the pixel circuit 2. In a scanning operation, the scanning lines WS, DS, AZ and AZ2 are driven and controlled by the write scanner 4, the drive scanner 5, the compensation scanner 7 and the second compensation scanner 8 respectively. The data signal line SL conveys an input signal Vsig generated by the horizontal selector 3. In this typical implementation, the five transistors T1 to T5 are each an N-channel transistor. The source S of the drive transistor T5 serving as a central component is connected to the anode of the light emitting device EL. The cathode of the light emitting device EL is connected to the power supply Vcat. The drain of the drive transistor T5 is connected to the power supply Vcc through the switching transistor T4. The gate of the switching transistor T4 is connected to the second scanning line DS. The gate G of the drive transistor T5 is connected to the data signal line SL through the sampling transistor T1. The gate of the sampling transistor T1 is connected to the first scanning line WS. The gate G of the drive transistor T5 is also connected to the power supply Vofs through the switching transistor T3. The gate of the switching transistor T3 is connected to the scanning line AZ2. The pixel capacitor C1 is connected between the gate G and source S of the drive transistor T5. The source S of the drive transistor T5 is connected to the power supply Vss through the switching transistor T2. The gate of the switching transistor T2 is connected to the scanning line AZ.

Figure 21:
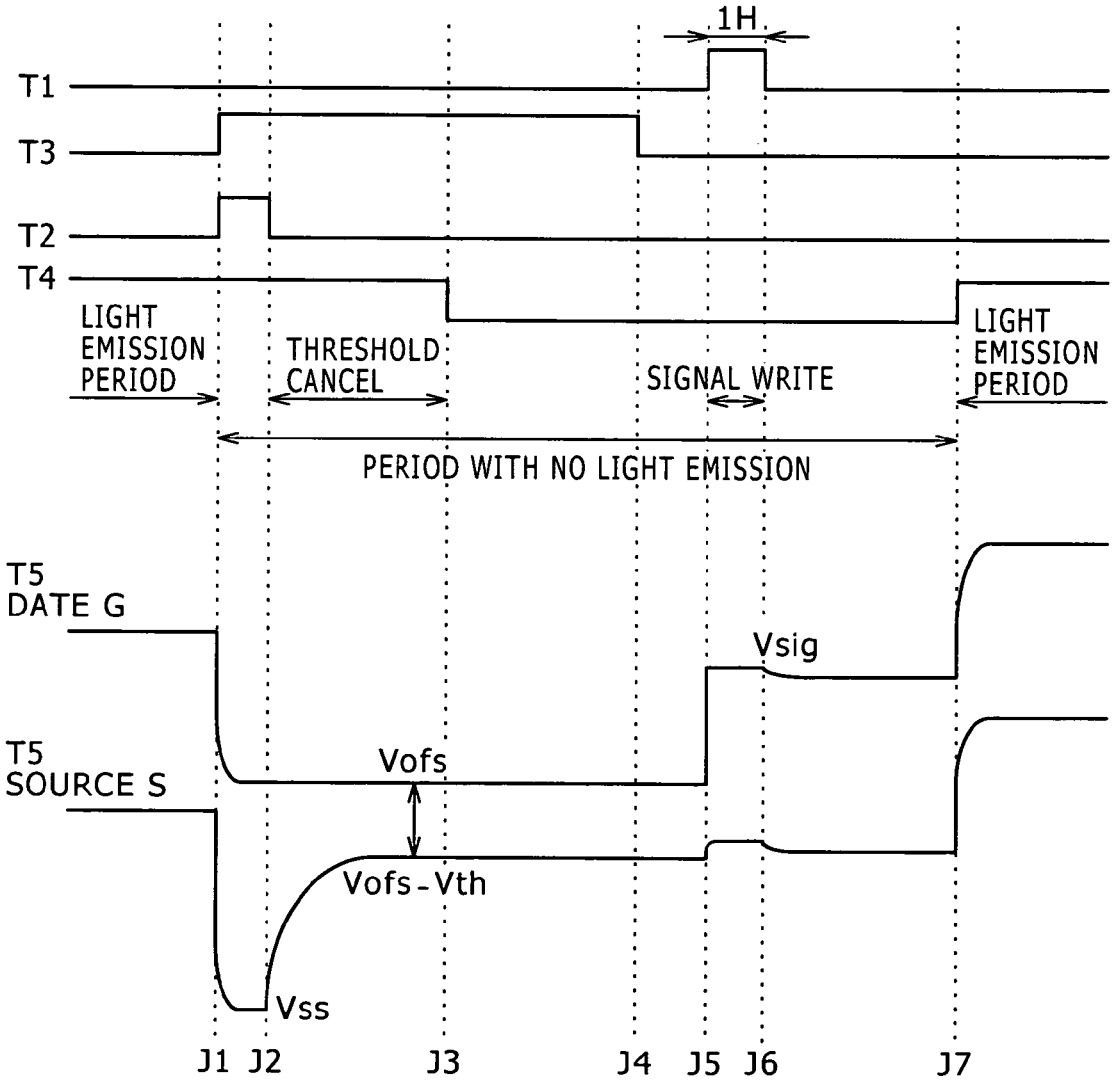
FIG. 21 shows timing charts to be referred to in explanation of operations carried out by a pixel circuit shown in FIG. 20.

FIG. 21 shows timing charts to be referred to in explanation of operations carried out by the pixel circuit 2 shown in FIG. 20. The timing charts represent changes of the on/off states of the transistors T1 to T4 along the time axis J. The states of the transistors T1 to T4 change in accordance with control signals conveyed respectively by the first scanning line WS, the scanning line AZ, the scanning line AZ2 and the second scanning line DS, which are driven by the write scanner 4, the compensation scanner 7, the second compensation scanner 8 and the drive scanner 5 respectively. The timing charts also show changes of electric potentials appearing at the gate G and source S of the drive transistor T5. Prior to a timing J1, the switching transistor T4 is in an on state. Thus, the drive transistor T5 supplies an output current Ids to the light emitting device EL, putting the light emitting device EL in a light emission state.

With the timing J1, the switching transistor T3 is put in an on state, pulling down the electric potential appearing at the gate G of the drive transistor T5 to the voltage of the power supply Vofs. In addition, since the switching transistor T2 is also in an on state, the electric potential appearing at the source S of the drive transistor T5 is pulled down to the voltage of the power supply Vss. Since the voltage of the power supply Vss is lower than the threshold voltage Vthel of the light emitting device EL, no current flows to the light emitting device EL, putting the light emitting device EL in a no light emission state. In addition, the difference in voltage between the power supplies Vofs and Vss is greater than the threshold voltage Vth of the drive transistor T5. By setting the electric potentials appearing at the two terminals of the pixel capacitor C1 at such levels, a threshold-value compensatory operation can be prepared.

With a timing J2, the switching transistor T2 is put in an off state to detach the source S of the drive transistor T5 from the power supply Vss, hence, allowing the electric potential appearing at the source S to rise. A current flows from the drive transistor T5 to the pixel capacitor C1 but is cut off when the difference Vgs in electric potential between the two terminals of the pixel capacitor C1 reaches a value just equal to the threshold voltage Vth of the drive transistor T5. As a result, such a voltage has been accumulated in the pixel capacitor C1 that the difference Vgs in electric potential between the two terminals of the pixel capacitor C1 reaches a value just equal to the threshold voltage Vth of the drive transistor T5. This operation eliminates the effect of the threshold voltage Vth of the drive transistor T5.

With a timing J3, the switching transistor T4 is put in an off state and, then, with a timing J4, the switching transistor T3 is also put in an off state. At this point of time, all the transistors T1 to T4 are in an off state.

With a timing J5, the sampling transistor T1 is put in an on state to allow the video signal Vsig conveyed by the data signal line SL to be applied to the gate G of the drive transistor T5. Then, with a timing J6 at the end of the horizontal scanning period (1H) allocated to the pixel circuit 2, the sampling transistor T1 is put in an off state. Thus, during a period from the timing J5 to the timing J6, the video signal Vsig conveyed by the data signal line SL is stored in the pixel capacitor C1.

With a timing J7, the switching transistor T4 is put in an on state to connect the drive transistor T5 to the power supply Vcc so that an output current Ids flows from the power supply Vcc to the drive transistor T5. The magnitude of the output current Ids is controlled to a fixed value by the input voltage Vgs stored in the pixel capacitor C1. As the output current Ids flows, the electric potential appearing at the source S of the drive transistor T5 starts rising. At a point of time the electric potential appearing at the source S of the drive transistor T5 exceeds the threshold voltage Vthel of the light emitting device EL, light emission begins. By a bootstrap effect, the electric potential appearing at the gate G of the drive transistor T5 also rises in a manner interlocked with the rising phenomenon of the electric potential appearing at the source S of the drive transistor T5. Thus, the input voltage Vgs appearing between the gate G and source S of the drive transistor T5 is always sustained at a constant value by the pixel capacitor C1.

Figure 22:
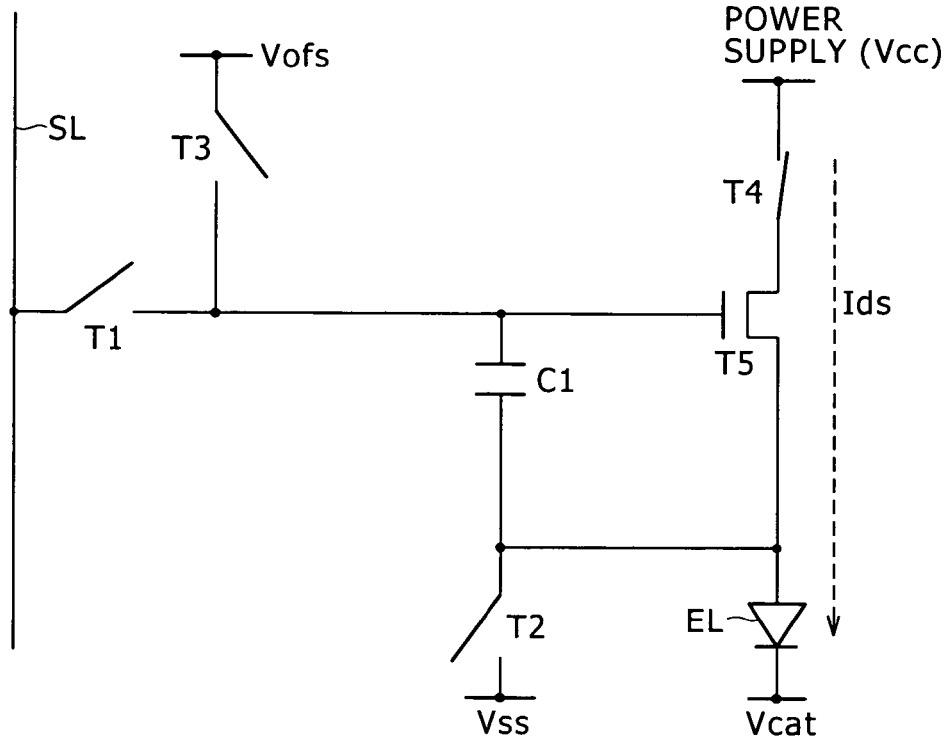
FIG. 22 is a diagram showing a state of the pixel circuit shown in FIG. 20 as a pixel circuit carrying out an operation.

By referring to FIGS. 22 to 28, the following description explains the advanced developed reference implementation, which was described briefly by referring to FIGS. 20 and 21, in detail. First of all, in a light emission state of the light emitting device EL, only the switching transistor T4 is put in an on state as shown in FIG. 22. At that time, the drive transistor T5 has been set to operate in a saturated region. Thus, the magnitude of the output current Ids flowing through the light emitting device EL is determined by the input voltage Vgs applied between the gate G and source S of the drive transistor T5 in accordance with Eq. 1 given earlier.

Figure 23:
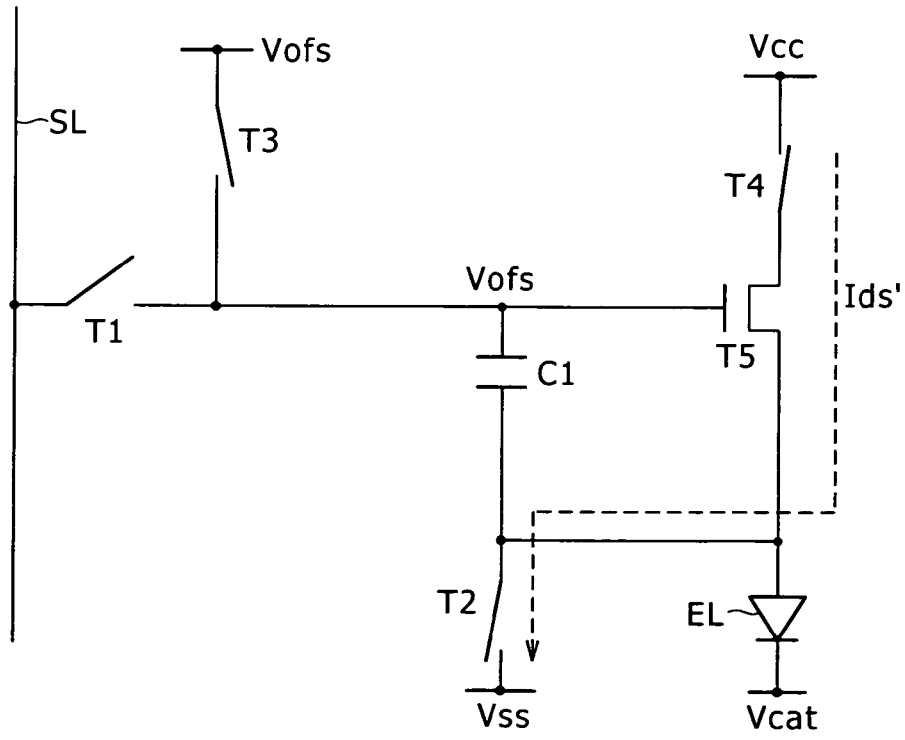
FIG. 23 is a diagram showing another state of the pixel circuit shown in FIG. 20 as a pixel circuit carrying out another operation.

Next, in a no light emission state of the light emitting device EL, the switching transistor T3 and the switching transistor T2 are each in an on state as shown in FIG. 23. At that time, the voltage of the power supply Vofs is applied to the gate G of the drive transistor T5 while the voltage of the power supply Vss is applied to the source S of the drive transistor T5. That is to say, a difference of (Vofs−Vss) is applied between the gate G and source S of the drive transistor T5. With the difference of (Vofs−Vss) applied between the gate G and source S of the drive transistor T5, an output current Ids' is flowing from the power supply Vcc to the power supply Vss, as shown in FIG. 23. In this case, in order to set the light emitting device EL in a no light emission state, it is necessary to set the voltage of the power supply Vofs and the voltage of the power supply Vss at such values that a voltage Vel applied to the light emitting device EL is smaller than the sum of the threshold voltage Vthel of the light emitting device EL and the voltage of the power supply Vcat. In addition, the switching transistor T2 can be turned on first before the switching transistor T3 is put in an on state or vice versa.

Figure 24:
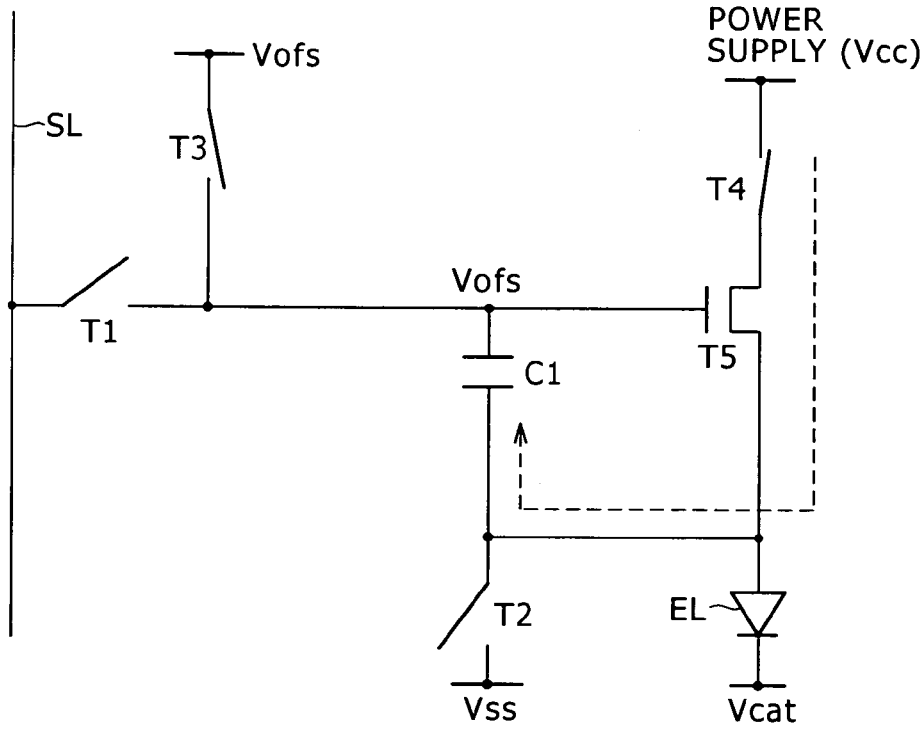
FIG. 24 is a diagram showing a further state of the pixel circuit shown in FIG. 20 as a pixel circuit carrying out a further operation.
Figure 25:
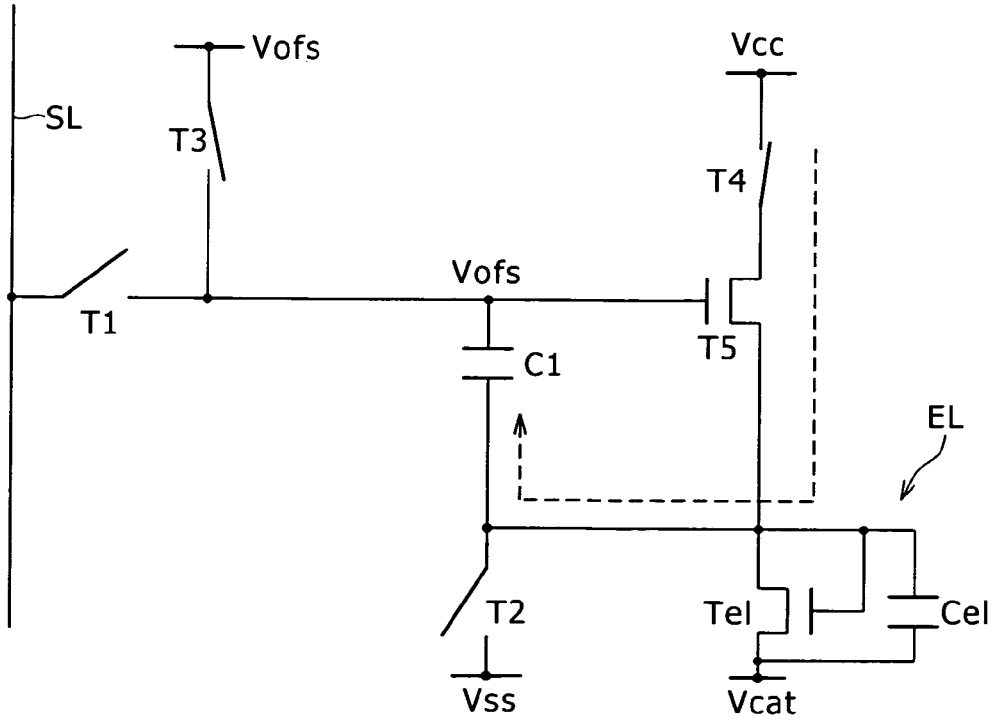
FIG. 25 is a diagram showing a still further state of the pixel circuit shown in FIG. 20 as a pixel circuit carrying out a still further operation.
Figure 26:
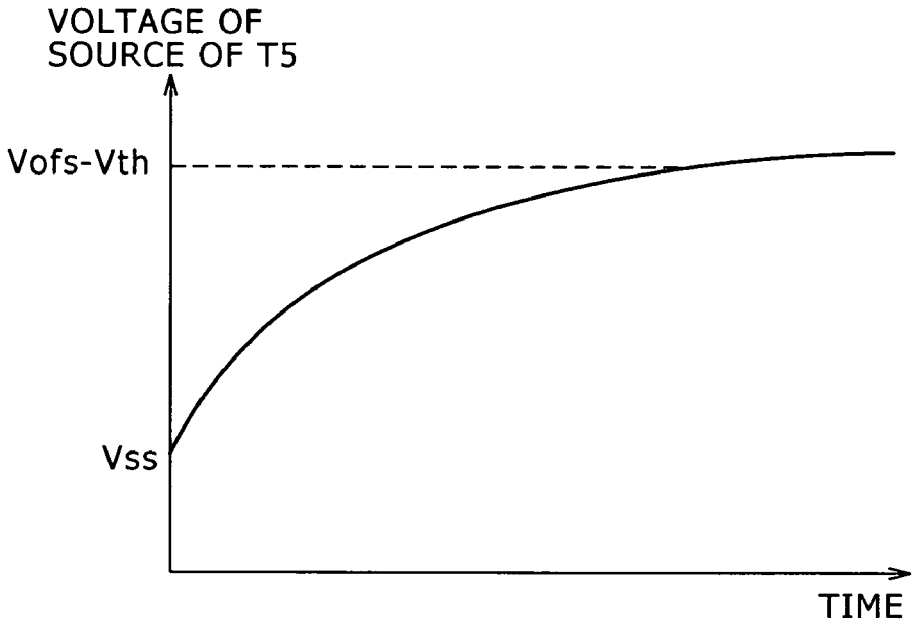
FIG. 26 is a diagram showing a graph representing voltage variation appearing on a light emitting device employed in the pixel circuit shown in FIG. 25.

Then, the switching transistor T2 is put in an on state as shown in FIG. 24. As shown in FIG. 25, an equivalent circuit of the light emitting device EL includes a diode Tel and a capacitance Cel. Thus, as long as a relation Vel≦Vcat+Vthel holds true, meaning that a leak current of the light emitting device EL is much smaller than the output current Ids flowing through the drive transistor T5, the output current Ids flowing through the drive transistor T5 is accumulated in the pixel capacitor C1 and the Cel. At that time, a voltage Vel appearing at the anode of the light emitting device EL increases with the lapse of time as shown in FIG. 26. The voltage Vel appearing at the anode of the light emitting device EL is no other than the voltage appearing at the source S of the drive transistor T5. After the lapse of predetermined time, the input voltage Vgs applied between the gate G and source S of the drive transistor T5 becomes equal to the threshold voltage Vth of the drive transistor T5. At that time, the following relation holds true:

$$Vel = Vofs - Vth \leqq Vcat + Vthel$$

Figure 27:
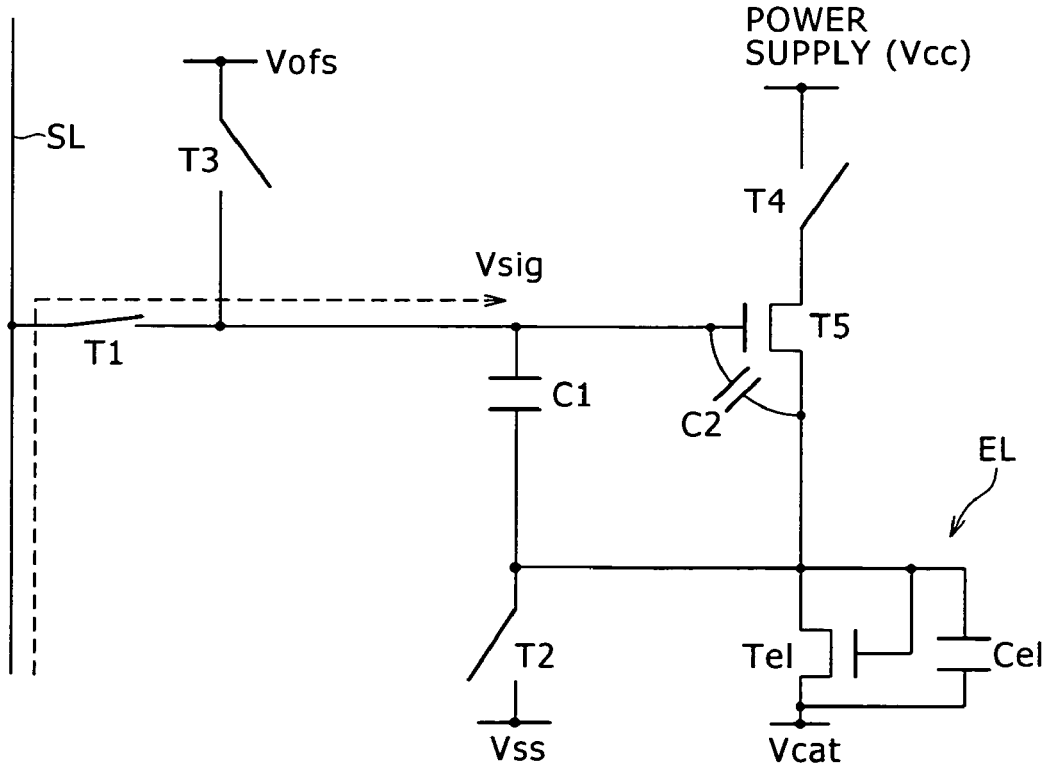
FIG. 27 is a diagram showing a still further state of the pixel circuit shown in FIG. 20 as a pixel circuit carrying out a still further operation.
Figure 28:
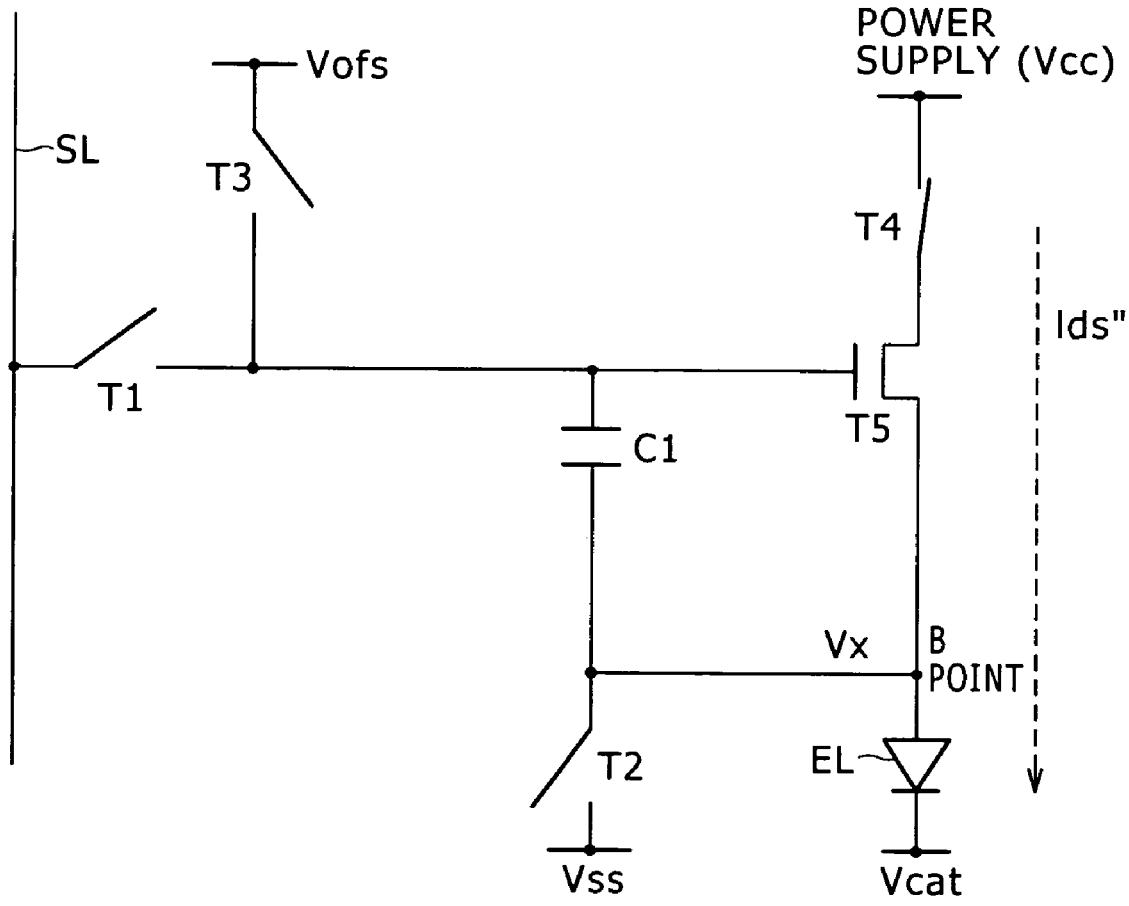
FIG. 28 is a diagram showing a still further state of the pixel circuit shown in FIG. 20 as a pixel circuit carrying out a still further operation.

After the threshold-value cancellation operation, the switching transistor T4 and the switching transistor T3 are each put in an off state. By putting the switching transistor T4 in an off state earlier than the switching transistor T3, an effect of the variations of the voltage appearing at the gate G of the drive transistor T5 can be suppressed. Then, the sampling transistor T1 is put in an on state in order to set the voltage appearing at the gate G of the drive transistor T5 at the signal voltage Vsig as shown in FIG. 27. At that time, the input voltage Vgs applied between the gate G and source S of the drive transistor T5 is determined by the capacitance of the pixel capacitor C1, the parasitic capacitance Cel of the light emitting device EL and the parasitic capacitance C2 of the drive transistor T5 in accordance with Eq. 6. Since the parasitic capacitance Cel of the light emitting device EL is greater than the capacitance of the pixel capacitor C1 and the parasitic capacitance C2 of the drive transistor T5; however, the input voltage Vgs applied between the gate G and source S of the drive transistor T5 is approximately equal to (Vsig+Vth). In this case, however, Vof2=0 is assumed for the sake of simplicity.

$$Vgs = \frac{Cel}{Cel + C1 + C2}(Vsig - Vofs) + Vth \qquad \text{Eq. 6}$$

When the operation to store signal voltage Vsig into the pixel circuit 2 is completed, the switching transistor T4 is put in an on state in order to raise the voltage appearing at the drain D of the drive transistor T5 to the voltage of the power supply Vcc. Since the voltage Vgs applied between the gate G and source S of the drive transistor T5 is fixed, the drive transistor T5 outputs a constant output current Ids" to the light emitting device EL. At that time, the voltage Vel of the light emitting device EL is rising to a voltage Vx corresponding to the constant output current Ids" shown in FIG. 28 and the light emitting device EL is emitting a light beam.

Also in this pixel circuit, when the light emission time of the light emitting device EL is long, the I-V characteristic unavoidably changes. Thus, an electric potential appearing at a point B shown in FIG. 28 also changes. Since the voltage Vgs applied between the gate G and source S of the drive transistor T5 is fixed; however, the drive transistor T5 outputs a constant output current Ids" to the light emitting device EL. Thus, even if the I-V characteristic changes, the constant output current Ids continues flowing all the time and, hence, the luminance of the light emitted by the light emitting device EL does not change.

Next, let us consider power-supply lines and gate lines in the pixel circuit of the typical advanced developed reference implementation. The pixel circuit includes 12 power-supply lines, the four power supplies Vcc, Vofs, Vss and Vsig as well as the four gate lines WS, AZ, AZ2 and DS for the three R, G and B trio primary colors. That is to say, the power-supply lines and the gate lines occupy a large area in the pixel circuit. Therefore, it is difficult to enhance the degree of fineness of the panel and raise the yield of the pixel circuit.

Figure 29:
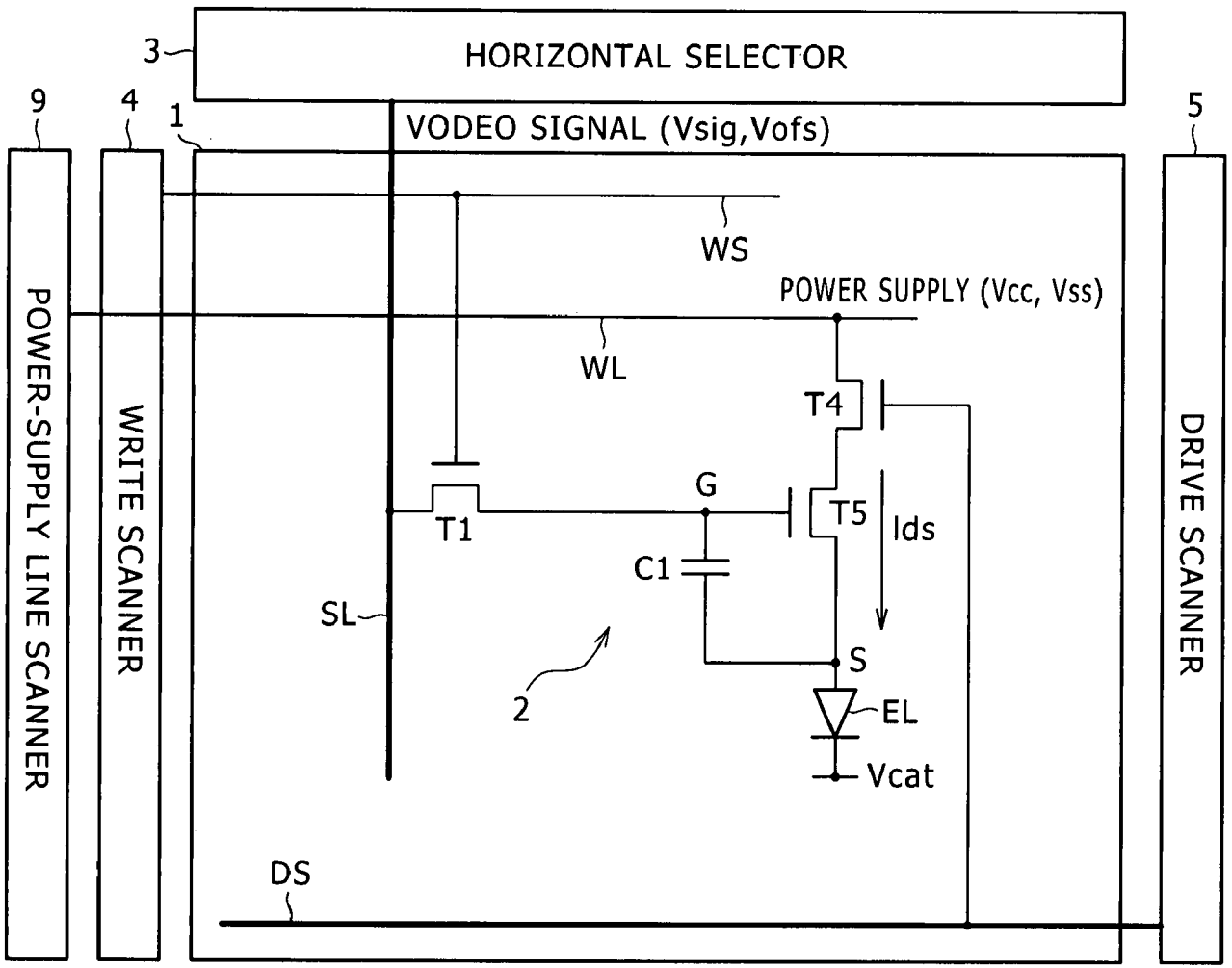
FIG. 29 is a block diagram showing an image display apparatus according to another embodiment of the present invention.

In order to solve the problem described above, the present invention provides a circuit configuration shown in FIG. 29. The configuration of the pixel circuit includes only three transistors and one pixel capacitor. In addition, the configuration of the pixel circuit has only three gate lines and three power-supply lines for the three R, G and B trio primary colors.

As shown in the figure, the image display apparatus according to the embodiment includes a pixel-array unit 1, a scanner unit and a signal unit. The scanner unit has a write scanner 4, a drive scanner 5 and a power-supply line scanner 9. A horizontal selector 3 serves as the signal unit. Pixel circuits 2 forming a pixel matrix in the pixel-array unit 1 are each provided at an intersection of a first scanning line WS and an a second scanning line DS, which are oriented in the row direction of the matrix as lines each used for supplying a control signal, and a signal line SL oriented in the column direction of the matrix as a line for supplying a video signal. The horizontal selector 3 serving as the signal unit supplies a video signal Sig to the pixel circuits through the data signal line SL. The write scanner 4 included in the scanner unit supplies a first control signal WS through the first scanning line WS. By the same token, the drive scanner 5 included in the scanner unit supplies a second control signal DS through the second scanning line DS. The first control signal WS and the second control signal DS are used to scan pixel circuits 2 on a row sequentially from one row to another. Each of the pixel circuits 2 includes a sampling transistor T1, a pixel capacitor C1 connected to the sampling transistor T1, a drive transistor T5 connected to the sampling transistor T1 and the pixel capacitor C1, an EL connected to the pixel capacitor C1 and the drive transistor T5, and a switching transistor T4 used for connected the drive transistor T5 to a power-supply line VL. The first control signal WS conveyed by the first scanning line WS puts the sampling transistor T1 in an on state allowing the sampling transistor T1 to sample the signal electric potential Vsig of the video signal Sig conveyed by the signal line SL and store the sampled signal electric potential Vsig into the pixel capacitor C1. The electric potential stored in the pixel capacitor C1 as the signal electric potential Vsig of the video signal Sig is applied between the gate G and source S of the drive transistor T5 as an input voltage Vgs. Receiving the input voltage Vgs, the drive transistor T5 generates an output current Ids according to the input voltage Vgs and supplies the output current Ids to the light emitting device EL. The output current Ids exhibits a characteristic of dependence on the threshold voltage Vth of the drive transistor T5. The light emitting device EL is connected between the source S of the drive transistor T5 and a cathode electric potential Vcat. The output current Ids supplied by the drive transistor T5 to the light emitting device EL drives the light emitting device EL to emit a light beam with a luminance according to the signal electric potential Vsig of the video signal Sig, which is applied between the gate G and source S of the drive transistor T5, in a light emission period. The second control signal DS conveyed by the second scanning line DS causes the switching transistor T4 to enter an on state of connecting the drive transistor T5 to the power-supply line VL during the light emission period. During a no light emission period, on the other hand, the switching transistor T4 is put in a non-conductive state, detaching the drive transistor T5 from the power-supply line VL.

The present invention is characterized in that the write scanner 4 employed in the scanner unit outputs the first control signal WS to the sampling transistor T1 through the first scanning line WS in an operation to turn the sampling transistor T1 on and off whereas the drive scanner 5 also employed in the scanner unit outputs the second control signal DS to the switching transistor T4 through the second scanning line DS in an operation to turn the switching transistor T4 on and off in order to carry out an operation to compensate the pixel capacitor Cl for an effect of the dependence of the output current Ids on the threshold voltage Vth of the drive transistor T5 and a sampling operation to accumulate the signal electric potential Vsig of the video signal Sig in the compensated pixel capacitor C1. In this case, the horizontal selector 3 functioning as the signal unit changes the video signal Sig from a fixed electric potential Vofs to the signal electric potential Vsig and vice versa in accordance with whether the pixel circuit 2 carries out the compensatory operation or the sampling operation in order to output the fixed electric potential Vofs needed for the compensatory operation during the compensatory operation or the signal electric potential Vsig needed for the sampling operation during the sampling operation to the sampling transistor T1 employed in the pixel circuit 2 through the data signal line SL. To put it concretely, the horizontal selector 3 supplies the fixed electric potential Vofs during the compensatory operation to the data signal line SL and, then, switches the data signal line SL to the signal electric potential Vsig during the sampling operation following the compensatory operation.

The power-supply line VL is laid out in the pixel-array unit 1 in parallel to the first control signal WS and the second control signal DS. As described earlier, the scanner unit includes the power-supply line scanner 9 for using the power-supply line VL to scan pixel circuits 2 on a row sequentially from one row to another in the same way as the write scanner 4 uses the first scanning line WS and the drive scanner 5 uses the second scanning line DS. The power-supply line scanner 9 supplies electric potentials Vcc and Vss need during predetermined operations to the drive transistor T5 through the power-supply line VL and the switching transistor T4. To put it concretely, during a compensatory operation, the power-supply line scanner 9 switches the power-supply line VL to the electric potential Vss from the normal electric potential Vcc, which is supplied during a light emission period. In this way, during the compensatory operation, the electric potential Vss needed for the operation is supplied to the drive transistor T5 through the power-supply line VL and the switching transistor T4. Thus, in this embodiment described above, during a horizontal scanning period 1H allocated to a row of pixel circuits 2, the scanner unit outputs the first control signal WS to the first scanning line WS and the second control signal DS to the second scanning line DS in order to carry out the compensation and sampling operations in the horizontal scanning period 1H.

Figure 30:
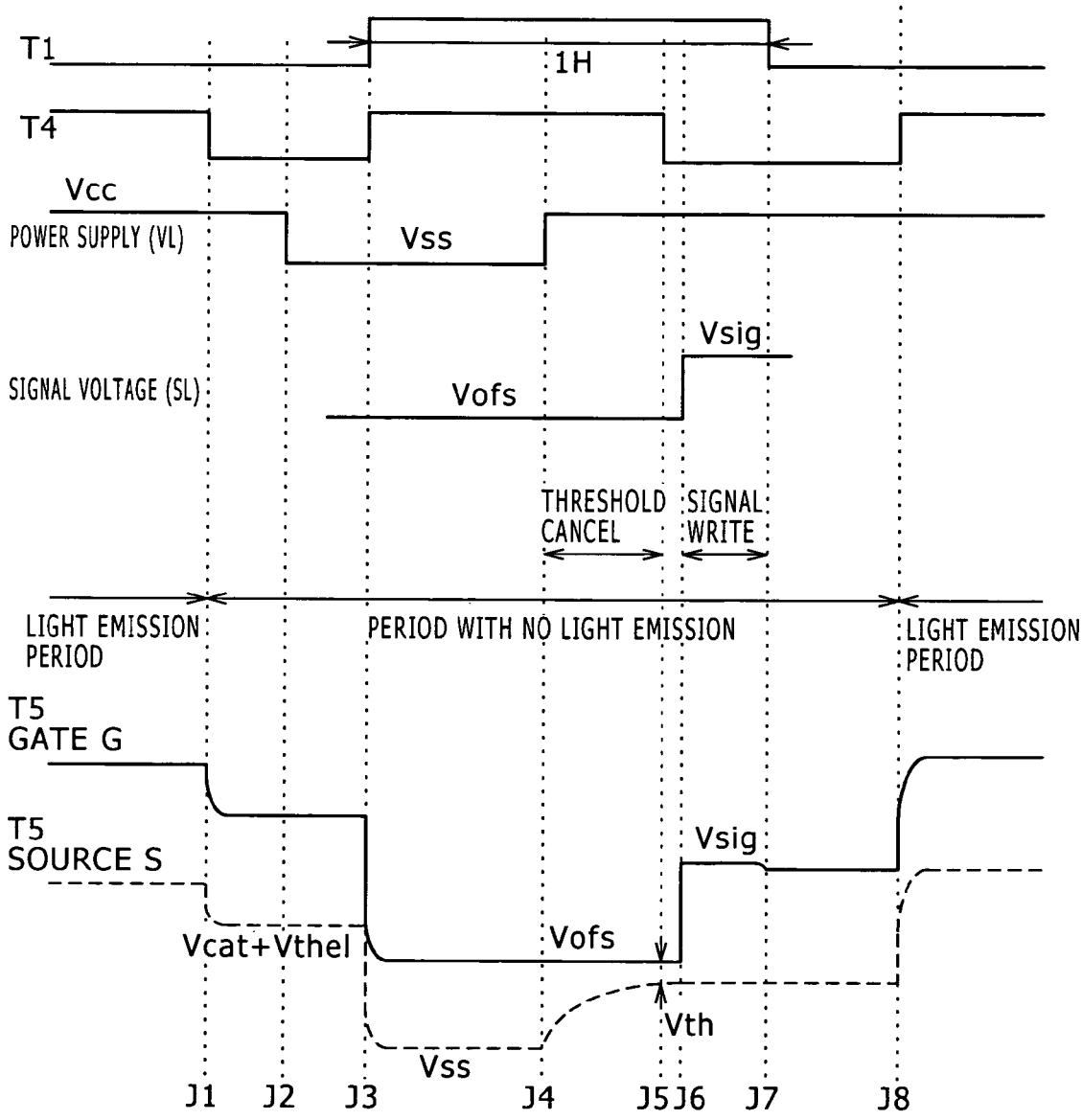
FIG. 30 shows timing charts to be referred to in explanation of operations carried out by the image display apparatus shown in FIG. 29.

FIG. 30 shows timing charts to be referred to in explanation of operations carried out by the image display apparatus shown in FIG. 29. The timing charts show that the sampling transistor T1 and the switching transistor T4 are each put in on and off states with timings along the time axis J. In addition, the timing charts also show changes of the power-supply voltage appearing on the power-supply line VL and changes of the signal voltage appearing on the data signal line SL. On top of that, the timing charts also show changes of an electric potential appearing at the gate G of the drive transistor T5 and changes of an electric potential appearing at the source S of the drive transistor T5.

As shown in the figure, prior to a timing J1 and after a timing J8, the pixel circuit 2 is in a light emission period. On the other hand, a period from the timing J1 to the timing J8 is a no light emission period. A period from a timing J4 to a timing J5 is a threshold-value compensation period during which a threshold-value compensatory operation is carried out. In addition, a period from the timing J6 to the timing J7 is a sampling period in which the sampling operation is carried out. On the other hand, period from the timing J1 to a timing J4 is a compensation preparatory period during which a compensation preparatory operation is carried out.

First of all, with the timing J1, the switching transistor T4 is put in an off state in order to detach the drive transistor T5 from the power-supply electric potential Vcc. Thus, the electric potentials appearing at the gate G and source S of the drive transistor T5 are pulled down. The electric potential appearing at the source S of the drive transistor T5 becomes just equal to a sum of (Vcat+Vthel), where notation Vcat denotes an electric potential appearing at the cathode of the light emitting device EL whereas notation Vthel denotes the threshold voltage of the light emitting device EL. Then, with the timing J2, the electric potential of the power-supply line VL is switched from the voltage Vcc to the voltage Vss. Subsequently, with the timing J3, the sampling transistor T1 and the switching transistor T4 are each put in an on state. At that time, the electric potential of the power-supply line VL is sustained at the voltage Vss and the data signal line SL is set at a predetermined fixed electric potential Vofs. Since the sampling transistor T1 is in an on state, the fixed electric potential Vofs is applied to the gate G of the drive transistor T5. Since the switching transistor T4 is in an on state, the electric potential appearing at the source S of the drive transistor T5 is pulled down to the voltage Vss.

Then, with the timing J4, the electric potential of the power supply line VL is switched back from the voltage Vss to the voltage Vcc. Thus, a current flows from the drive transistor T5 to the pixel capacitor C1, causing the electric potential appearing at the source S of the drive transistor T5 to start rising. It is to be noted that, at this point of time, the light emitting device EL is an inversely biased state. Thus, the light emitting device EL is transmitting no light. As the voltage applied between the gate G and source S of the drive transistor T5 becomes just equal to the threshold voltage Vth of the drive transistor T5, the drive transistor T5 is put in an off state. Thus, a voltage with the magnitude equal to the threshold voltage Vth is stored in the pixel capacitor C1.

Subsequently, with the timing J5, the switching transistor T4 is put in an off state. Then, with the timing J6, the data signal line SL is switched from the predetermined fixed electric potential Vofs to the signal electric potential Vsig. At that time, the sampling transistor T1 is sustained in an on state. Thus, the signal electric potential Vsig is stored in the pixel capacitor C1, being added to the threshold voltage Vth. Subsequently, with the timing J7, the sampling transistor T1 is put in an off state to complete the operation to store the signal electric potential Vsig in the pixel capacitor C1. Then, with the timing J8, the switching transistor T4 is put in an on state to start a light emission period.

Figure 31:
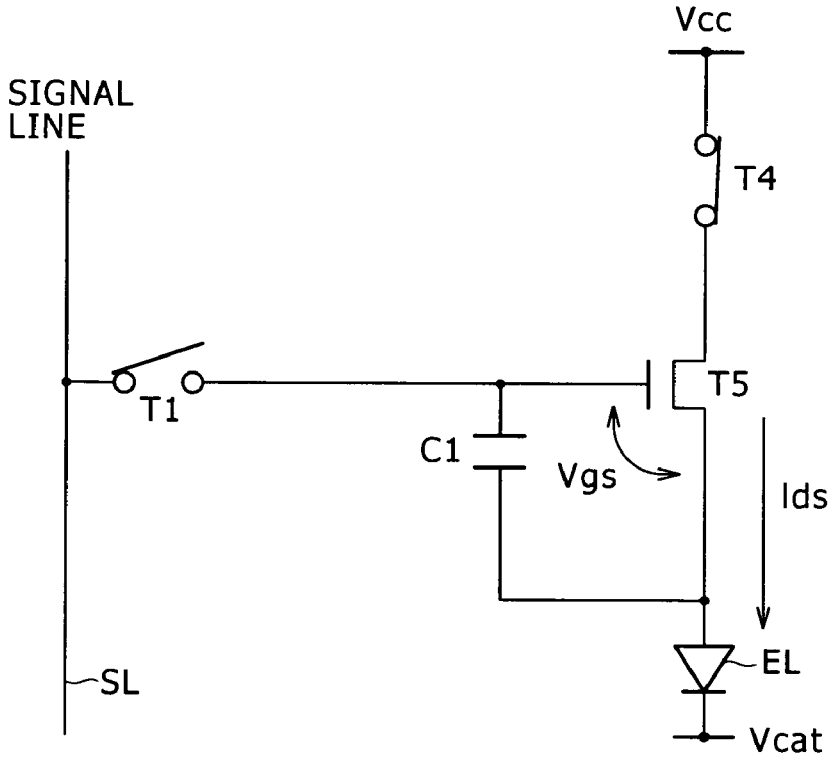
FIG. 31 is a diagram showing a state of a pixel circuit employed in the image display apparatus of FIG. 29 as a pixel circuit carrying out an operation.

By referring to FIGS. 31 to 35, the following description explains operations carried out by the pixel circuit 2 shown in FIGS. 29 and 30 as the pixel circuit 2 provided by the present invention. First of all, the light emission state of the light emitting device EL exists only when the switching transistor T4 is put in an on state as shown in FIG. 31. Since the drive transistor T5 is designed to operate in a saturated state at that time, the magnitude of a current flowing to the light emitting device EL is determined by the input voltage Vgs applied between the gate G and source S of the drive transistor T5 in accordance with Eq. 1.

Figure 32:
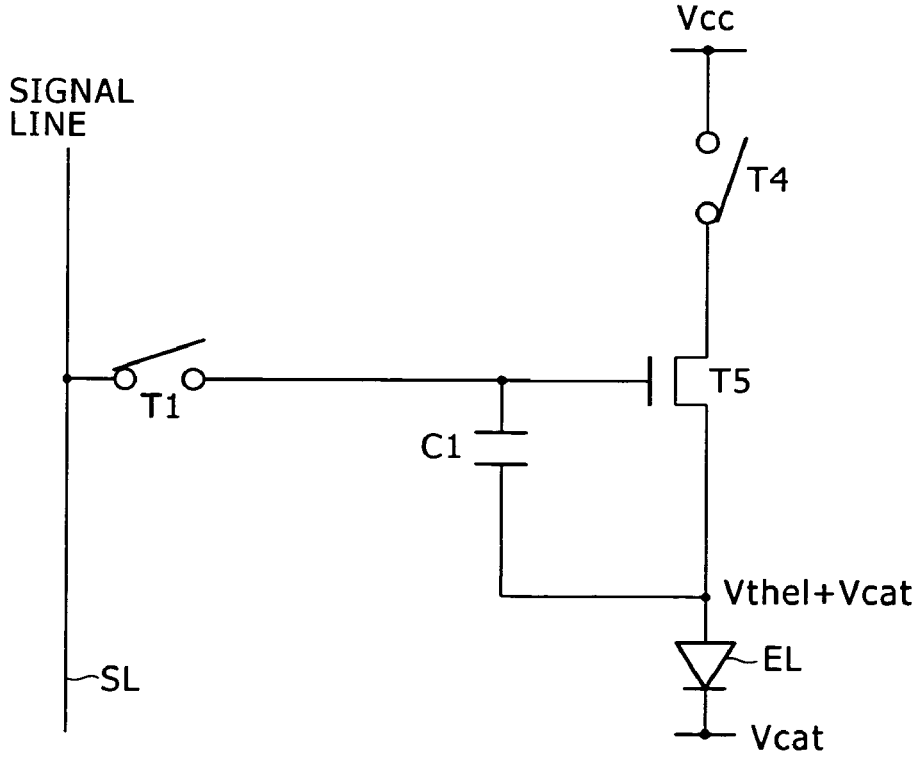
FIG. 32 is a diagram showing another state of a pixel circuit employed in the image display apparatus of FIG. 29 as a pixel circuit carrying out another operation.

Then, the switching transistor T4 is put in an off state as shown in FIG. 32. With the switching transistor T4 put in an off state, the current does not flow from the power supply to the light emitting device EL anymore so that the light emitting device EL no longer emits a light beam. At that time, the voltage appearing at the source S of the drive transistor T5 becomes equal to a sum of (Vcat+Vthel), where notation Vcat denotes an electric potential appearing at the cathode of the light emitting device EL whereas notation Vthel denotes the threshold voltage of the light emitting device EL.

Figure 33:
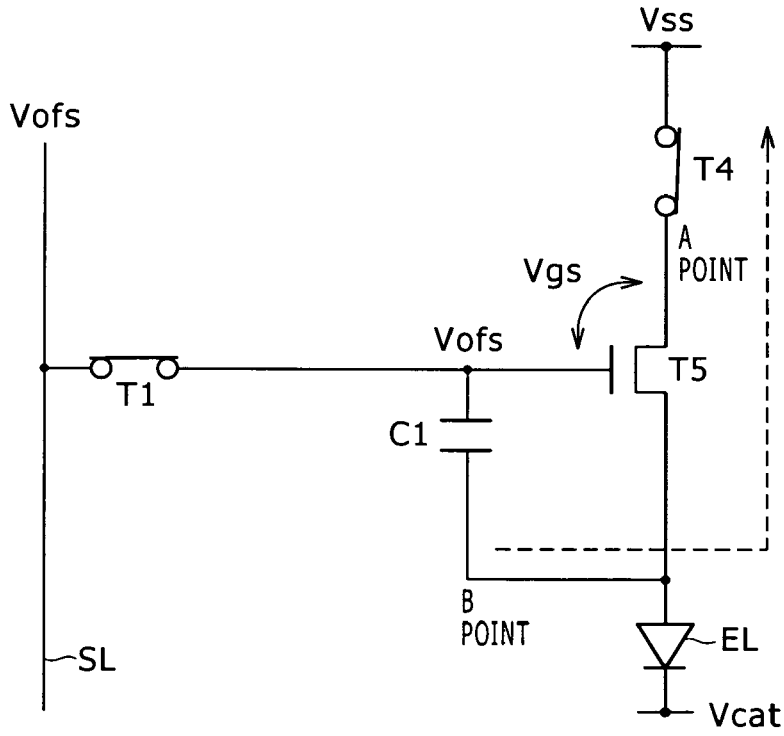
FIG. 33 is a diagram showing a further state of a pixel circuit employed in the image display apparatus of FIG. 29 as a pixel circuit carrying out a further operation.

Then, with the voltage of the power supply at Vss and the signal voltage set at Vofs, the sampling transistor T1 and the switching transistor T4 are each put in an on state as shown in FIG. 33. With the signal voltage set at Vofs and the sampling transistor T1 put in an on state, the gate G of drive transistor T5 is raised to the electric potential Vofs. In addition, since Vss is smaller than (Vcat+Vthel), an electric potential appearing at a point A shown in the figure is the electric potential of the source S of the drive transistor T5 and an electric potential appearing at a point B shown in the figure is the electric potential of the drain of the drive transistor T5. On top of that, since (Vofs−Vss) is greater than the threshold voltage Vth of the drive transistor T5, a current flows to raise the electric potential appearing at the point B to Vss as shown in the figure. As described above, since the voltage Vss of the power supply is not higher than the sum of (Vcat+Vthel), where notation Vcat denotes an electric potential appearing at the cathode of the light emitting device EL whereas notation Vthel denotes the threshold voltage of the light emitting device EL, that is, since a relation Vss≦(Vcat+Vthel) holds true, the light emitting device EL transmits no light.

Figure 34:
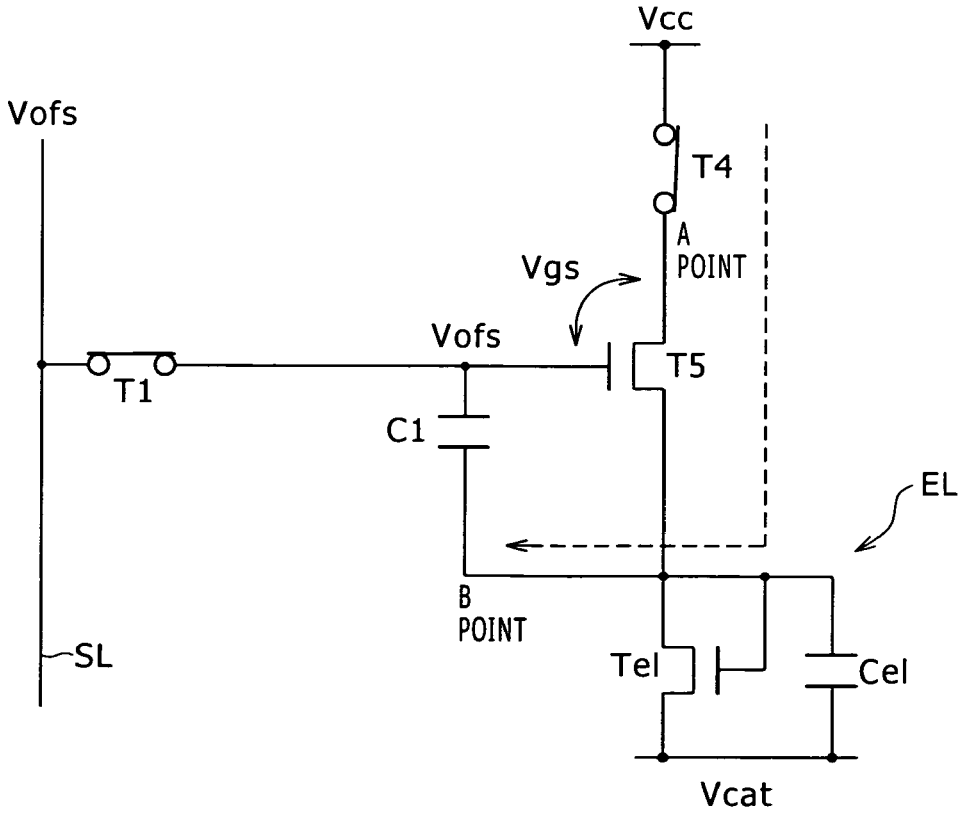
FIG. 34 is a diagram showing a still further state of a pixel circuit employed in the image display apparatus of FIG. 29 as a pixel circuit carrying out a still further operation.

In this state, the voltage of the power supply is switched back to Vcc as shown in FIG. 34. By carrying out this operation, the electric potential appearing at the point B is again the electric potential of the source S of the drive transistor T5 and an electric potential appearing at the point A is again the electric potential of the drain of the drive transistor T5. An equivalent circuit of the light emitting device EL can be expressed in terms of a diode Tel and a capacitor Cel as shown in the figure. Thus, as long as a relation Vel≦(Vcat+Vthel)

holds true, that is, as far as a leak current of the light emitting device EL is smaller than the current flowing to the drive transistor T5, the current flowing to the drive transistor T5 is accumulated in the pixel capacitor C1 and the Cel of the light emitting device EL. At that time, the voltage Vel rises with the lapse of time. After the lapse of predetermined time, on the other hand, the input voltage Vgs applied between the gate G and source S of the drive transistor T5 becomes equal to the threshold voltage Vth. At that time, a relation Vel=Vofs−Vth≦Vcat+Vthel holds true.

Figure 35:
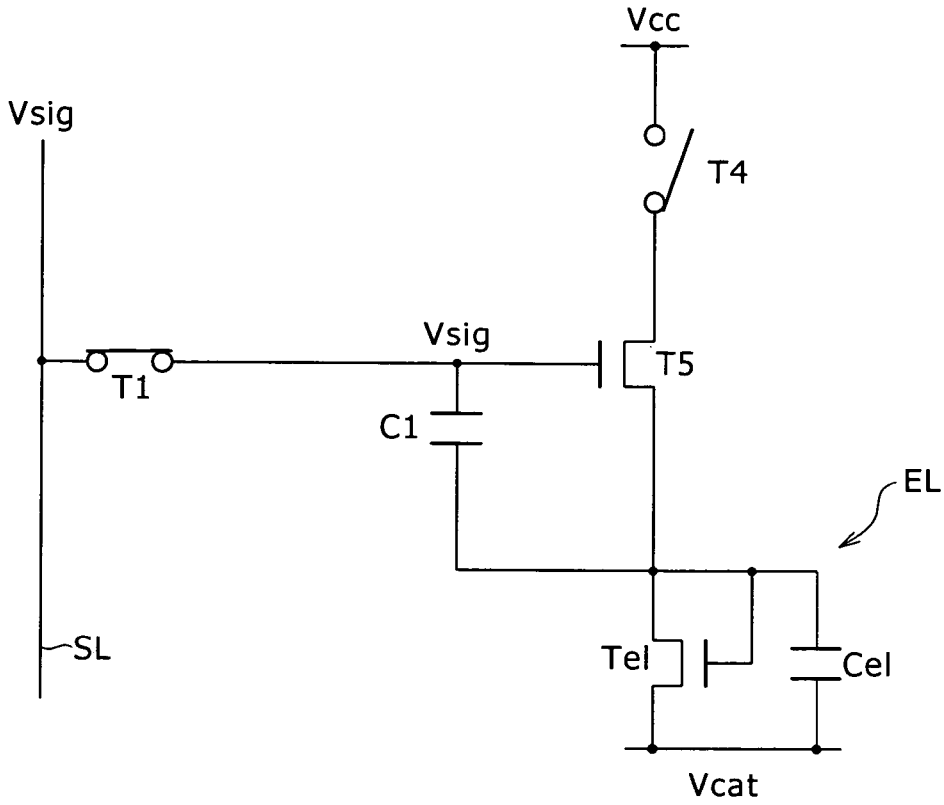
FIG. 35 is a diagram showing a still further state of a pixel circuit employed in the image display apparatus of FIG. 29 as a pixel circuit carrying out a still further operation.

After the lapse of the predetermined time, the switching transistor T4 is put in an off state. Then, the signal voltage Vsig appearing on the data signal line SL is applied to the gate G of the drive transistor T5 as a desired signal voltage as shown in FIG. 35. At that time, the input voltage Vgs applied between the gate G and source S of the drive transistor T5 is determined by the capacitance of the pixel capacitor C1, the parasitic capacitance Cel of the light emitting device EL and a parasitic capacitance C2 of the drive transistor T5 in accordance with Eq. 6 given earlier. Since the parasitic capacitance Cel of the light emitting device EL is greater than the capacitance of the pixel capacitor C1 and the parasitic capacitance C2 of the drive transistor T5; however, the input voltage Vgs applied between the gate G and source S of the drive transistor T5 is approximately equal to (Vsig+Vth).

Figure 36:
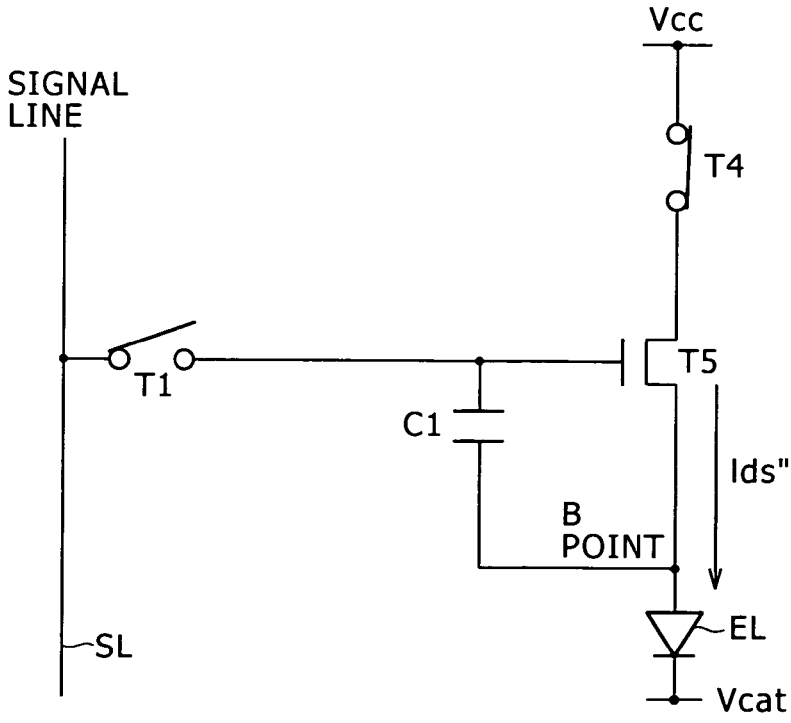
FIG. 36 is a diagram showing a still further state of a pixel circuit employed in the image display apparatus of FIG. 29 as a pixel circuit carrying out a still further operation.

When the operation to store signal voltage Vsig into the pixel circuit 2 is completed, the sampling transistor T1 is put in an off state but the switching transistor T4 is put in an on state in order to raise the voltage appearing at the drain D of the drive transistor T5 to the voltage of the power supply Vcc. Since the voltage Vgs applied between the gate G and source S of the drive transistor T5 is fixed, the drive transistor T5 outputs a constant output current Ids" to the light emitting device EL. At that time, the voltage Vel of the light emitting device EL is rising to a voltage Vx corresponding to the constant output current Ids" shown in FIG. 36 and the light emitting device EL is emitting a light beam.

Also in this pixel circuit, when the light emission time of the light emitting device EL is long, the I-V characteristic unavoidably changes. Thus, an electric potential appearing at the point B also changes. Since the voltage Vgs applied between the gate G and source S of the drive transistor T5 is fixed; however, the drive transistor T5 always outputs a constant output current Id to the light emitting device EL. Thus, even if the I-V characteristic changes, the constant output current Ids continues to flow all the time and, hence, the luminance of the light emitted by the light emitting device EL does not change. The voltage of the power supply provided by the present invention has two different magnitudes as described above. Thus, the existing gate drivers can be used, allowing the image display apparatus to be implemented at a low cost.

Figure 37:
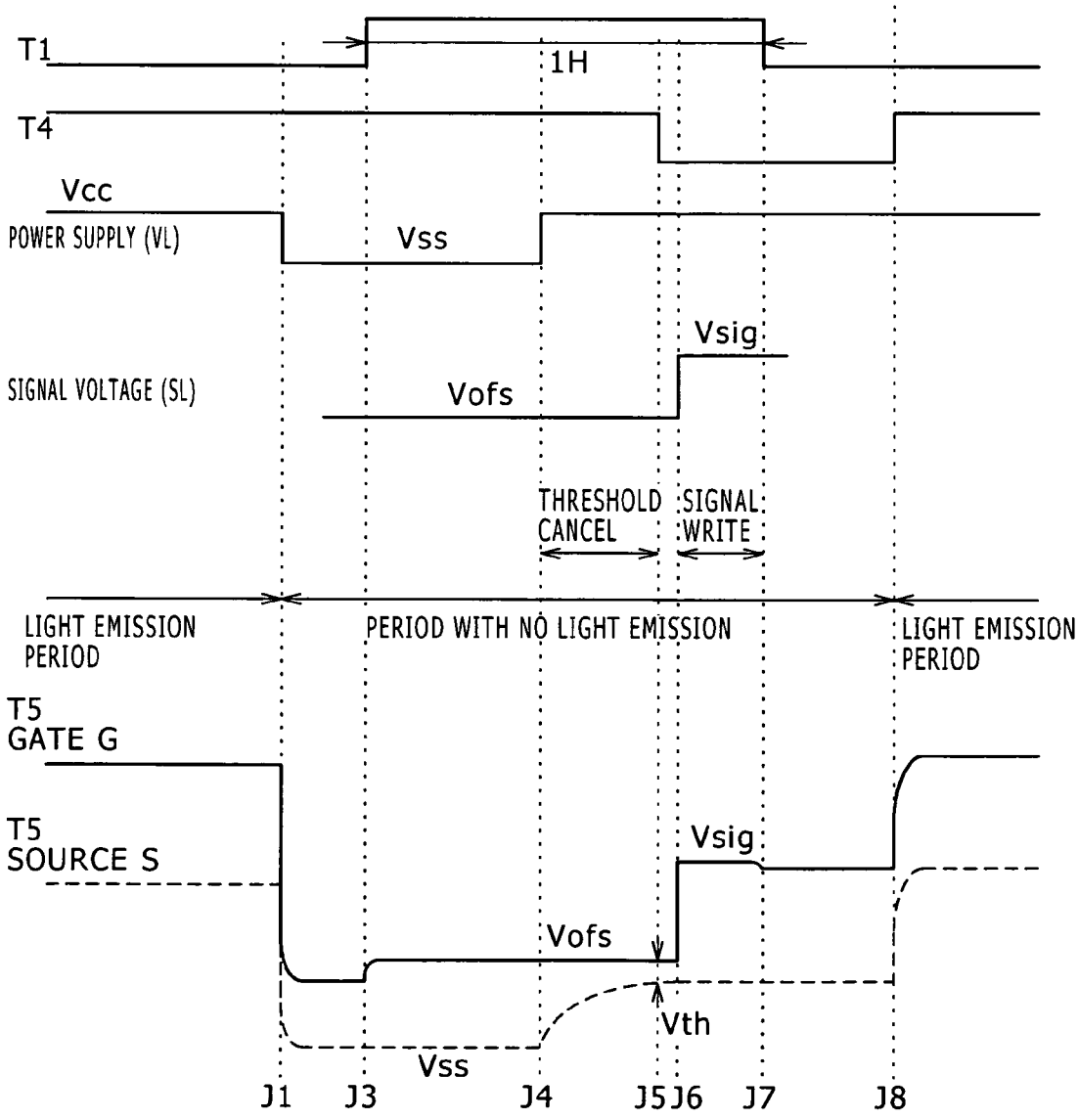
FIG. 37 shows timing charts to be referred to in explanation of operations carried out by an image display apparatus according to a further embodiment of the present invention.

A modified version of the present invention is shown in FIG. 37. The modified version of the present invention is different from the embodiment described above in that the operation timings of the switching transistor T4 of the modified version are different from that of the embodiment. In the case of the modified version of the present invention, a margin of the threshold-value compensation period can be extended by a rise time of the switching transistor T4.

Since the present invention is capable of suppressing an effect of variations in threshold value among drive transistors, it is possible to obtain a uniform picture quality without unevenness and dispersions. In addition, since the voltage of the power supply provided by the present invention has a pulse waveform with two different magnitudes as described above, the existing gate drivers can be used, allowing the image display apparatus to be implemented at a low cost. On top of that, since the pixel circuit provided by the present invention has only a small number of components including three transistors and one pixel capacitor, a high degree of fineness and a high yield can be expected. Furthermore, for each of the three primary RGB trio colors, the pixel circuit provided by the present invention includes only three gate lines and three power lines. Thus, the size of an area allocated in the pixel circuit as an area for the power-supply and gate lines can be decreased. As a result, a high degree of fineness and a high yield can be expected. Moreover, in the present invention, a voltage applied between the gate and source of the drive transistor is sustained at a constant level. Thus, an output current Ids flowing to the light emitting device EL does not change either. As a result, even if the I-V characteristic of the light emitting device EL varies with the lapse of time, the constant current Ids continues to flow all the time, never causing the luminance of a light beam emitted by the light emitting device EL to change.

In addition, it should be understood by those skilled in the art that a variety of modifications, combinations, sub-combinations and alterations may occur in dependence on design requirements and other factors insofar as they are within the scope of the appended claims or the equivalents thereof.

What is claimed is:

1. A display apparatus including a pixel-array unit, a scanner unit and a signal unit, wherein:

said pixel-array unit has pixels laid out to form a matrix and each provided at an intersection of first and second scanning lines each oriented in a row direction of said matrix and a signal line oriented in a column direction of said matrix;

said signal unit provides a video signal to said signal line;

said scanner unit sequentially scans said pixels of said matrix in row units by supplying first and second control signals to said first and second scanning lines respectively;

each of said pixels includes a sampling transistor, a pixel capacitor connected to said sampling transistor, a drive transistor connected to said sampling transistor as well as said pixel capacitor, a light emitting device connected to said drive transistor, and a switching transistor for connecting said drive transistor to a power supply;

said first control signal supplied by said scanner unit through said first scanning line causes said sampling transistor to enter a conductive state of sampling the electric potential of a video signal supplied by said signal unit to said signal line and storing said sampled electric potential in said pixel capacitor;

said pixel capacitor applies an input voltage to the gate of said drive transistor in accordance with said sampled electric potential of said video signal;

said drive transistor supplies an output current according to said input voltage to said light emitting device as an output current exhibiting a characteristic of dependence on the threshold voltage of said drive transistor;

the output current generated by said drive transistor causes said light emitting device to emit a light beam with a luminance according to said electric potential of said video signal during a light emission period;

said second control signal supplied by said scanner unit through said second scanning line causes said switching transistor to enter a conductive state of connecting said drive transistor to said power supply during said light emission period;

during a period other than said light emission period, said switching transistor is put in a non-conductive state in order to disconnect said drive transistor from said power supply;

during a horizontal scanning period, said scanner unit supplies said first control signal to said first scanning line in a control operation to put said sampling transistor in on and off states and said second control signal to said second scanning line in a control operation to put said switching transistor in on and off states and, in order to compensate said pixel capacitor for an effect of said characteristic exhibited by the output current of said drive transistor as a characteristic of dependence on said threshold voltage of said drive transistor, said pixel carries out:

a preparatory operation to reset said pixel capacitor, a compensatory operation to compensate said pixel capacitor by storing a voltage in said reset pixel capacitor as a voltage for canceling an effect of said threshold voltage, and a sampling operation to sample the signal electric potential of a video signal supplied by said signal unit to said signal line and store said sampled electric potential in said compensated pixel capacitor;

wherein said drive transistor exhibits a characteristic displaying dependence of an output current generated by said drive transistor on a mobility of carriers in a channel area in said drive transistor in addition to dependence on a threshold voltage of said drive transistor; and a mobility compensatory operation to compensate an input voltage applied to said drive transistor for an effect of said characteristic showing dependence of the output current on said mobility of carriers by drawing the output current from said drive transistor with a signal electric potential sampled and feeding back said drawn output current to said pixel capacitor in a negative feedback operation.

2. The display apparatus according to claim 1 wherein, during said horizontal scanning period, said signal unit switches a video signal appearing on said signal line among a first fixed electric potential, a second fixed electric potential and a signal electric potential of said video signal in order to provide each pixel with electric potentials needed for said preparatory operation, said compensatory operation and said sampling operation through said signal line.

3. The display apparatus according to claim 2 wherein, first of all, after continuously supplying a video signal to said signal line at said first fixed electric potential of a high level, said signal unit switches said video signal to said second fixed electric potential of a low level in order to make said preparatory operation executable and, then, while said second fixed electric potential of a low level is being sustained, said compensatory operation is carried out before said signal unit switches said video signal appearing on said signal line from said second fixed electric potential to said signal electric potential in order to allow said sampling operation to be carried out.

4. The display apparatus according to claim 2 wherein said signal unit includes:

a signal generation circuit for generating said signal electric potential; and an output circuit for carrying out a synthesis process by inserting said first fixed electric potential and said second fixed electric potential into said signal electric potential output by said signal generation circuit to generate a video signal switched among said first fixed electric potential, said second fixed electric potential and said signal electric potential and for outputting said video signal to each signal line.

5. The display apparatus according to claim 4 wherein:

said signal unit outputs a video signal synthesizing said signal electric potential not exceeding an ordinary rating value with said first fixed electric potential of a high level exceeding said rating value;

said signal generation circuit has an ordinary withstand voltage for generating said signal electric potential not exceeding said rating value; and said output circuit is made capable of withstanding said first fixed electric potential of a high level exceeding said rating value.

6. The display apparatus according to claim 1 wherein:

in the horizontal scanning period, said scanner unit outputs said second control signal to said second scanning line as a control signal for further controlling said switching transistor in order to carry out the mobility compensatory operation.

7. A driving method adopted by a display apparatus including a pixel-array unit, a scanner unit and a signal unit wherein said pixel-array unit has pixels laid out to form a matrix and each provided at an intersection of first and second scanning lines each oriented in a row direction of said matrix and a signal line oriented in a column direction of said matrix, and each of said pixels includes a sampling transistor, a pixel capacitor connected to said sampling transistor, a drive transistor connected to said sampling transistor as well as said pixel capacitor, a light emitting device connected to said drive transistor and a switching transistor for connecting said drive transistor to a power supply, said driving method comprising the steps of:

providing, by said signal unit, a video signal to said signal line;

sequentially scanning, by said scanner unit, said pixels of said matrix in row units by supplying first and second control signals to said first and second scanning lines respectively;

supplying said first control signal by said scanner unit through said first scanning line to cause said sampling transistor to enter a conductive state of sampling the electric potential of a video signal supplied by said signal unit to said signal line and storing said sampled electric potential in said pixel capacitor;

applying, by said pixel capacitor, an input voltage to the gate of said drive transistor in accordance with said sampled electric potential of said video signal;

supplying, by said drive transistor, an output current according to said input voltage to said light emitting device as an output current exhibiting a characteristic of dependence on the threshold voltage of said drive transistor;

causing, by the output current, said light emitting device to emit a light beam with a luminance according to said electric potential of said video signal during a light emission period;

supplying said second control signal by said scanner unit through said second scanning line, to cause said switching transistor to enter a conductive state of connecting said drive transistor to said power supply during said light emission period;

placing said switching transistor in a non-conductive state in order to disconnect said drive transistor from said power supply during a period other than said light emission period;

supplying, by said scanner unit, said first control signal to said first scanning line in a control operation to put said sampling transistor in on and off states during a horizontal scanning period and said second control signal to said second scanning line in a control operation to put said switching transistor in on and off states during said horizontal scanning period while letting said pixel compensate said pixel capacitor for an effect of said characteristic exhibited by the output current of said drive transistor as a characteristic of dependence on said threshold voltage of said drive transistor by carrying out:

a preparatory operation to reset said pixel capacitor, a compensatory operation to compensate said pixel capacitor by storing a voltage in said reset pixel capacitor as a voltage for canceling an effect of said threshold voltage, and a sampling operation to sample the signal electric potential of a video signal supplied by said signal unit to said signal line and store said sampled electric potential in said compensated pixel capacitor;

wherein said drive transistor exhibits a characteristic displaying dependence of an output current generated by said drive transistor on a mobility of carriers in a channel area in said drive transistor in addition to dependence on a threshold voltage of said drive transistor; and a mobility compensatory operation to compensate an input voltage applied to said drive transistor for an effect of said characteristic showing dependence of the output current on said mobility of carriers by drawing the output current from said drive transistor with a signal electric potential sampled and feeding back said drawn output current to said pixel capacitor in a negative feedback operation.

8. A display apparatus including a pixel-array unit, a scanner unit and a signal unit wherein:

said pixel-array unit has pixels laid out to form a matrix and each provided at an intersection of first and second scanning lines each oriented in a row direction of said matrix and a signal line oriented in a column direction of said matrix;

said signal unit provides a video signal to said signal line;

said scanner unit sequentially scans said pixels of said matrix in row units by supplying first and second control signals to said first and second scanning lines respectively;

each of said pixels includes at least a sampling transistor, a pixel capacitor connected to said sampling transistor, a drive transistor connected to said sampling transistor as well as said pixel capacitor, a light emitting device connected to said drive transistor, and a switching transistor for connecting said drive transistor to a power supply;

said first control signal supplied by said scanner unit through said first scanning line causes said sampling transistor to enter a conductive state of sampling the electric potential of a video signal supplied by said signal unit to said signal line and storing said sampled electric potential in said pixel capacitor;

said pixel capacitor applies an input voltage to the gate of said drive transistor in accordance with said sampled electric potential of said video signal;

said drive transistor supplies an output current according to said input voltage to said light emitting device as an output current exhibiting a characteristic of dependence on the threshold voltage of said drive transistor;

said second control signal supplied by said scanner unit through said second scanning line causes said switching transistor to enter a conductive state of connecting said drive transistor to said power supply during said light emission period;

during a period other than said light emission period, said switching transistor is put in a non-conductive state in order to disconnect said drive transistor from said power supply;

the output current generated by said drive transistor causes said light emitting device to emit a light beam with a luminance according to said electric potential of said video signal during a light emission period;

during a horizontal scanning period, said scanner unit supplies said first control signal to said first scanning line in a control operation to put said sampling transistor in on and off states and said second control signal to said second scanning line in a control operation to put said switching transistor in on and off states and, in order to compensate said pixel capacitor for an effect of said characteristic exhibited by the output current of said drive transistor as a characteristic of dependence on said threshold voltage of said drive transistor, said pixel carries out preparatory operations to reset said pixel capacitor, a compensatory operation to store a voltage in said reset pixel capacitor as a voltage for canceling an effect of said threshold voltage, and a sampling operation to sample said signal electric potential of a video signal supplied by said signal unit to said signal line and store said sampled electric potential in said compensated pixel capacitor; and said scanner unit utilizes previous horizontal scanning periods allocated to rows of pixels preceding the current row of pixels to carry out said preparatory operations at different times by distributing said preparatory operations among said previous horizontal scanning periods and sets an interval between any two of said preparatory operations at a value large enough for discharging a voltage from said light emitting device.

9. The display apparatus according to claim 8 wherein said scanner unit carries out said compensatory operation at different times by utilizing previous horizontal scanning periods allocated to rows of pixels preceding said current row of pixels and distributing said compensatory operation among said previous horizontal scanning periods after completion of said preparatory operations.

10. The display apparatus according to claim 8 wherein, during a horizontal scanning period, said signal unit switches a signal appearing on said signal line among a first fixed electric potential, a second fixed electric potential and a signal electric potential of said video signal in order to provide each pixel with electric potentials needed for said preparatory operation, said compensatory operation and said sampling operation through said signal line.

11. The display apparatus according to claim 10 wherein said signal unit supplies said first fixed electric potential of a high level during said preparatory operation, said second fixed electric potential of a low level during said compensatory operation and said signal electric potential of said video signal during said sampling operation.

12. The display apparatus according to claim 8 wherein:

said drive transistor exhibits a characteristic displaying dependence of an output current generated by said drive transistor on a mobility of carriers in a channel area in said drive transistor in addition to dependence on a threshold voltage of said drive transistor; and in a horizontal scanning period, said scanner unit outputs said second control signal to said second scanning line as a control signal for further controlling said switching transistor in order to carry out an operation to compensate an input voltage applied to said drive transistor for an effect of said characteristic showing dependence of the output current on said mobility of carriers by drawing the output current from said drive transistor with a signal electric potential sampled and feeding back said drawn output current to said pixel capacitor in a negative feedback operation.

13. A driving method adopted by a display apparatus including a pixel-array unit, a scanner unit and a signal unit wherein, said pixel-array unit includes pixels laid out in said pixel-array unit to form a pixel matrix and each provided at an intersection of first and second scanning lines oriented in a row direction of said matrix and a signal line oriented in a column direction of said matrix, and each of said pixels includes at least a sampling transistor, a pixel capacitor connected to said sampling transistor, a drive transistor connected to said sampling transistor as well as said pixel capacitor, a light emitting device connected to said drive transistor and a switching transistor for connecting said drive transistor to a power supply, said driving method comprising the steps of:

providing, by said signal unit, a video signal to said signal line;

sequentially scanning, by said scanner unit, said pixels of said matrix in row units by supplying first and second control signals to said first and second scanning lines respectively;

supplying said first control signal by said scanner unit through said first scanning line to cause said sampling transistor to enter a conductive state of sampling the electric potential of a video signal supplied by said signal unit to said signal line and storing said sampled electric potential in said pixel capacitor;

applying, by said pixel capacitor, an input voltage to the gate of said drive transistor in accordance with said sampled electric potential of said video signal;

supplying, by said drive transistor, an output current according to said input voltage to said light emitting device as an output current exhibiting a characteristic of dependence on the threshold voltage of said drive transistor;

causing said light emitting device to emit a light beam with a luminance according to said electric potential of said video signal during a light emission period;

supplying said second control signal by said scanner unit through said second scanning line to cause said switching transistor to enter a conductive state of connecting said drive transistor to said power supply during said light emission period;

placing said switching transistor in a non-conductive state in order to disconnect said drive transistor from said power supply during a period other than said light emission period;

supplying said first control signal to said first scanning line in a control operation to put said sampling transistor in on and off states during a horizontal scanning period and said second control signal to said second scanning line in a control operation to put said switching transistor in on and off states during said horizontal scanning period while letting said pixel compensate said pixel capacitor for an effect of said characteristic exhibited by the output current of said drive transistor as a characteristic of dependence on said threshold voltage of said drive transistor by carrying out:

a preparatory operation to reset said pixel capacitor, a compensatory operation to compensate said pixel capacitor by storing a voltage in said reset pixel capacitor as a voltage for canceling an effect of said threshold voltage, and a sampling operation to sample the signal electric potential of a video signal supplied by said signal unit to said signal line and store said sampled electric potential in said compensated pixel capacitor; and utilizing, by said scanner unit, previous horizontal scanning periods allocated to rows of pixels preceding the current row of pixels to carry out said preparatory operations at different times by distributing said preparatory operations among said previous horizontal scanning periods and set an interval between any two of said preparatory operations at a value large enough for discharging a voltage from said light emitting device.

14. A display apparatus including a pixel-array unit, a scanner unit and a signal unit wherein:

said pixel-array unit has pixels laid out to form a matrix and each provided at an intersection of first and second scanning lines each oriented in a row direction of said matrix and a signal line oriented in a column direction of said matrix;

said signal unit provides a video signal to said signal line;

said scanner unit sequentially scans said pixels of said matrix in row units by supplying first and second control signals to said first and second scanning lines respectively;

each of said pixels includes at least a sampling transistor, a pixel capacitor connected to said sampling transistor, a drive transistor connected to said sampling transistor as well as said pixel capacitor, a light emitting device connected to said drive transistor and a switching transistor for connecting said drive transistor to a power-supply line;

said first control signal supplied by said scanner unit through said first scanning line causes said sampling transistor to enter a conductive state of sampling the electric potential of a video signal supplied by said signal unit to said signal line and storing said sampled electric potential in said pixel capacitor;

said pixel capacitor applies an input voltage to the gate of said drive transistor in accordance with said sampled electric potential of said video signal;

said drive transistor supplies an output current according to said input voltage to said light emitting device as an output current exhibiting a characteristic of dependence on the threshold voltage of said drive transistor;

the output current causes said light emitting device to emit a light beam with a luminance according to said electric potential of said video signal during a light emission period;

said second control signal supplied by said scanner unit through said second scanning line causes said switching transistor to enter a conductive state of connecting said drive transistor to said power-supply line during said light emission period;

during a period other than said light emission period, said switching transistor is put in a non-conductive state in order to disconnect said drive transistor from said power-supply line;

said scanner unit supplies said first control signal to said first scanning line in a control operation to put said sampling transistor in on and off states and said second control signal to said second scanning line in a control operation to put said switching transistor in on and off states in order to control said pixel to carry out:

a compensatory operation of compensating said pixel capacitor for an effect of said characteristic exhibited by the output current of said drive transistor as a characteristic of dependence on said threshold voltage of said drive transistor, and a sampling operation of sampling said signal electric potential of a video signal supplied by said signal unit to said signal line and storing said sampled electric potential in said compensated pixel capacitor;

wherein said drive transistor exhibits a characteristic displaying dependence of an output current generated by said drive transistor on a mobility of carriers in a channel area in said drive transistor in addition to dependence on a threshold voltage of said drive transistor; and a mobility compensatory operation to compensate an input voltage applied to said drive transistor for an effect of said characteristic showing dependence of the output current on said mobility of carriers by drawing the output current from said drive transistor with a signal electric potential sampled and feeding back said drawn output current to said pixel capacitor in a negative feedback operation.

15. The display apparatus according to claim 14 wherein said signal unit switches a signal appearing on said signal line between a fixed electric potential and a signal electric potential of said video signal in order to provide each pixel with electric potentials needed for said compensatory operation and said sampling operation through said signal line.

16. The display apparatus according to claim 15 wherein said signal unit supplies said fixed electric potential during said compensatory operation and, then, said signal electric potential of said video signal during said sampling operation.

17. The display apparatus according to claim 14 wherein:

said power-supply line is provided in said pixel-array unit in parallel to said first and second scanning lines;

said scanner unit includes a power-supply line scanner for scanning said power-supply lines in the same way as said scanning lines are scanned; and an electric potential needed for said compensatory operation is supplied to each of said pixels through said power-supply line.

18. The display apparatus according to claim 17 wherein, during a period of said compensatory operation, said power-supply line scanner switches a power-supply electric potential appearing on said power-supply line from an ordinary power-supply electric potential supplied during a light emission period to said electric potential needed for said compensatory operation and supplies said electric potential needed for said compensatory operation to said pixels through said power-supply line.

19. The display apparatus according to claim 14 wherein said scanner unit outputs said first and second control signals to said first and second scanning lines respectively during a horizontal scanning period allocated to a row of pixels in order to carry out said compensatory and sampling operations during said horizontal scanning period.

20. A driving method adopted in a display apparatus including a pixel-array unit, a scanner unit and a signal unit wherein, said pixel-array unit has pixels laid out to form a matrix and each provided at an intersection of first and second scanning lines each oriented in a row direction of said matrix and a signal line oriented in a column direction of said matrix, and each of said pixels includes a sampling transistor, a pixel capacitor connected to said sampling transistor, a drive transistor connected to said sampling transistor as well as said pixel capacitor, a light emitting device connected to said drive transistor and a switching transistor for connecting said drive transistor to a power-supply line, said driving method comprising the steps of:

providing, by said signal unit, a video signal to said signal line;

sequentially scanning, by said scanner unit, said pixels of said matrix in row units by supplying first and second control signals to said first and second scanning lines respectively;

supplying said first control signal by said scanner unit through said first scanning line to cause said sampling transistor to enter a conductive state of sampling the electric potential of a video signal supplied by said signal unit to said signal line and storing said sampled electric potential in said pixel capacitor;

applying, by said pixel capacitor, an input voltage to the gate of said drive transistor in accordance with said sampled electric potential of said video signal;

supplying, by said drive transistor, an output current according to said input voltage to said light emitting device as an output current exhibiting a characteristic of dependence on the threshold voltage of said drive transistor;

causing, by the output current, said light emitting device to emit a light beam with a luminance according to said electric potential of said video signal during a light emission period;

supplying said second control signal by said scanner unit through said second scanning line to cause said switching transistor to enter a conductive state of connecting said drive transistor to said power-supply line during said light emission period;

placing said switching transistor in a non-conductive state in order to disconnect said drive transistor from said power-supply line during a period other than said light emission period;

supplying said first control signal to said first scanning line in a control operation to put said sampling transistor in on and off states during a horizontal scanning period and said second control signal to said second scanning line in a control operation to put said switching transistor in on and off states in order to control said pixel to carry out:

a compensatory operation of compensating said pixel capacitor for an effect of said characteristic exhibited by the output current of said drive transistor as a characteristic of dependence on said threshold voltage of said drive transistor, and a sampling operation of sampling said signal electric potential of a video signal supplied by said signal unit to said signal line and storing said sampled electric potential in said compensated pixel capacitor;

wherein said drive transistor exhibits a characteristic displaying dependence of an output current generated by said drive transistor on a mobility of carriers in a channel area in said drive transistor in addition to dependence on a threshold voltage of said drive transistor; and a mobility compensatory operation to compensate an input voltage applied to said drive transistor for an effect of said characteristic showing dependence of the output current on said mobility of carriers by drawing the output current from said drive transistor with a signal electric potential sampled and feeding back said drawn output current to said pixel capacitor in a negative feedback operation.

* * * * *